US007721638B2

(12) United States Patent
Verhalen et al.

(10) Patent No.: US 7,721,638 B2
(45) Date of Patent: May 25, 2010

(54) SLICING MACHINE, AND METHOD OF USE AND COMPONENTS THEREOF

(75) Inventors: Amy Verhalen, Sun Prairie, WI (US); Scott Biba, Mazomainie, WI (US); Scott Sullivan, Madison, WI (US); William Lindeman, Marshall, WI (US); Sheldon Roberts, Sun Prairie, WI (US); Kent Bradley Chase, Madison, WI (US)

(73) Assignee: ITW Food Equipment Group, LLC, Troy, OH (US)

( * ) Notice: Subject to any disclaimer, the term of this patent is extended or adjusted under 35 U.S.C. 154(b) by 93 days.

(21) Appl. No.: 11/862,501

(22) Filed: Sep. 27, 2007

(65) Prior Publication Data

US 2008/0083310 A1 Apr. 10, 2008

Related U.S. Application Data

(62) Division of application No. 11/358,561, filed on Feb. 21, 2006, now abandoned, which is a division of application No. 09/980,921, filed as application No. PCT/US00/11766 on Apr. 29, 2000, now Pat. No. 7,073,421.

(60) Provisional application No. 60/131,788, filed on Apr. 30, 1999.

(51) Int. Cl.
*B26D 7/22* (2006.01)

(52) U.S. Cl. ..... 83/718; 83/932; 83/DIG. 1

(58) Field of Classification Search ..... 83/703, 83/707, 932, 373, 718, 734, DIG. 1
See application file for complete search history.

(56) References Cited

U.S. PATENT DOCUMENTS

| | | | | |
|---|---|---|---|---|
| 1,418,063 | A * | 5/1922 | Braun | 83/730 |
| 1,675,745 | A | 7/1928 | Barton | |
| 1,912,922 | A * | 6/1933 | Streckfuss | 83/421 |
| 1,939,740 | A | 12/1933 | Van Berkel | |
| 1,945,269 | A | 1/1934 | Freudenberg | |
| 1,954,043 | A | 4/1934 | Fryer | |
| 1,972,250 | A | 9/1934 | Strachan et al. | |
| 2,412,962 | A | 12/1946 | Brookhart et al. | |

(Continued)

FOREIGN PATENT DOCUMENTS

DE 3201520 * 7/1983

(Continued)

*Primary Examiner*—Stephen Choi
(74) *Attorney, Agent, or Firm*—Thompson Hine LLP

(57) ABSTRACT

An ergonomically designed food slicing machine including a rotatable blade for slicing bulk food product, a motor operably connected to the rotating blade, and a base portion located below the rotatable blade which defines a food slice receiving area. The machine may be provided with a sliced food receptacle operably connected to a scale, a visible indicia correlating to the distance between the gauge plate and rotatable blade, a blade sharpening assembly, a sled for securing the food product and an operator adjusted optimum stroke setting system for automatic operation of the slicing machine.

6 Claims, 49 Drawing Sheets

U.S. PATENT DOCUMENTS 2,691,397 A * 10/1954 Klingens ..... 83/717
2,851,074 A 9/1958 Talge et al.
3,182,700 A 5/1965 Engi
3,320,990 A 5/1967 Anecki
3,515,191 A 6/1970 Anecki et al.
3,702,150 A 11/1972 Muller et al.
3,704,736 A 12/1972 Pratley
3,938,602 A 2/1976 Sly et al.
3,958,478 A 5/1976 Camper
3,986,304 A 10/1976 Shie, III
4,246,821 A 1/1981 Fuse
4,273,013 A 6/1981 Artin et al.
4,306,385 A 12/1981 Burton
4,345,498 A 8/1982 Best
4,397,206 A 8/1983 Czala
4,685,364 A 8/1987 Scheflow et al.
4,793,228 A 12/1988 Etter et al.
4,813,316 A 3/1989 Johnson et al.
4,817,480 A 4/1989 Young
5,101,704 A 4/1992 Jones et al.
5,209,150 A 5/1993 Arconada
5,224,407 A 7/1993 Koch et al.
5,245,898 A 9/1993 Somal et al.
5,591,072 A 1/1997 Tweed et al.
5,615,591 A 4/1997 Scherch et al.
5,630,348 A 5/1997 Kuchler
5,666,866 A 9/1997 Huang et al.
5,687,626 A * 11/1997 Scherch et al. ..... 83/719
5,787,776 A 8/1998 Nishimoto
5,862,730 A 1/1999 Cartwright et al.
5,970,840 A 10/1999 Yan et al.
6,016,734 A * 1/2000 Koch ..... 83/707
6,092,448 A 7/2000 Cartwright et al.
6,164,161 A 12/2000 Young

FOREIGN PATENT DOCUMENTS

GB 2072785 10/1981
GB 2325615 12/1998

* cited by examiner 900
902
216
200
318
310
309
303
300
301
313
417a
417
414
402
400
406
401
103
102
100
101
204
212a
800
503
500
307
603
306
604
304
600
605
606
607
701
700

310
303
305
318
205
210
209
204
216

310
318
205
204
210
209
216
303
305

303
210
318
205
204
209
216
305

310
318
205
210
204
209
216

SLICING MACHINE, AND METHOD OF USE AND COMPONENTS THEREOF

CROSS-REFERENCE TO RELATED APPLICATIONS

This application is a divisional of U.S. application Ser. No. 11/358,561, filed Feb. 21, 2006 now abandoned, which was a divisional of U.S. application Ser. No. 09/980,921, filed Oct. 26, 2001 now U.S. Pat. No. 7,073,421, which was a national phase filing of PCT/US00/11766, filed Apr. 29, 2000, which in turned claimed priority to U.S. Provisional Application Ser. No. 60/131,788, filed Apr. 30, 1999.

FIELD OF THE INVENTION

The present invention relates to a slicing machine, such as the kind often used to slice deli meats, cheeses and similar items. The invention also relates to various parts and components of such a slicing machine.

BACKGROUND OF THE INVENTION

Various commercial meat slicing machinery are currently used by delicatessens, supermarkets, and butcher shops to slice bulk meat or cheese product for sale to retail customers. The slicer operator typically stands in front of the machine and adjusts the slicer to provide slices of pre-determined thickness by rotating a knob having numerical indicia of the slice thickness. The rotation of the knob adjusts the distance between a gauge plate and a slicing blade to correlate with the numerical value selected for slice thickness. The slicer operator typically stands in front of the machine with the product to be sliced held on a movable table on the right side of the operator. The operator turns on the blade motor, places the food product onto a sliding table, secures the food product on the table with a pusher, rotates a gauge plate adjustment knob to select a numerical value for the thickness of slice to be cut, and begins to manually operate the slicer by grasping a handle below the table on the right side of the machine and sliding it back and forth to bring the product into contact with the rotating. As the slices are cut, they fall from the slicing area toward a tray area on the left side of the slicer, and the operator typically gathers the product and views the width of the slices being cut for conformity with the desires of a given customer.

Many times, the operator or customer will find the resulting slices to be of an unsatisfactory thickness so the operator will again rotate the gauge plate adjustment knob and check the numerical indicia of slice thickness on the knob. During the period of adjustment, the operator frequently needs to refer back to the indicia and visually inspect the thickness of the slices in order to arrive at an acceptable slice thickness. This process causes the operator to shift his or her attention from the blade area to the front of the machine where the slice thickness selector knob is located. This shifting of attention from the cutting area to the selector knob is undesirable since it impairs the efficiency of operation. Accordingly, there is a need for a slicing machine which allows the operator to maintain the focus of his or her attention on the blade area during the slicing operation.

During operation of the slicer, it is common for the spinning blade to eject debris and juices from the sliced product. Those juices and debris are deposited on the exterior surfaces of the slicer. For this reason, it has been common to design exterior portions of the slicer to be removable for cleaning in a dishwasher or sink at the end of a work shift. One such removable portion of the slicer is typically a sharpening stone assembly which is used to sharpen and deburr the blade edge. If the sharpening stones become encrusted or coated with juices and/or debris, it cannot properly sharpen the blade. Thus, from time to time, the sharpening stone assembly is removed from the slicer and washed. When conventional sharpening stones are washed, they typically require twenty four hours of drying time before they can be returned to service. One approach to this problem has been to provide "washable" sharpening stones that may be washed and immediately returned to service without extended drying time. However, such "washable" stones suffer from the drawback of being many times more costly to manufacture than conventional stones.

Another problem with the prior sharpening stone assembly was that they required periodic maintenance to maintain proper alignment with the blade. Such periodic maintenance required a service call from a trained technician to insure that the sharpening stones engaged the blade at the proper angle to optimize sharpening. Typically, prior stone sharpening assemblies were mounted on a portion of the slicing machine frame and pivoted into contact with the blade for sharpening. As the blade is continually sharpened over its service life, it becomes reduced in diameter due to wearing away of metal from the blade edge. Thus, when the diameter of the blade has been reduced significantly, the angle of engagement with the stone varies from the optimal angle for sharpening the blade. This misalignment of the sharpening stone with the blade edge precludes an optimally sharpened edge. Accordingly, there is a need for a sharpening assembly that requires less frequent washing or maintenance.

Another portion of the slicer that has typically been designed to be removable for washing is the slidable support arm and table assembly of the slicer. In prior slicers the removable arm and table assembly are heavy and bulky and thus cumbersome to remove, wash, and reinstall on the slicer. Moreover, the weight and bulk of the arm and table assembly made it difficult to load into a conventional dishwasher or fit into a sink. A further problem with the prior slicing machines was the inconvenience of the process for removal of the table and support arm assembly. Typically, the adjustable gauge plate must be adjusted to its fully closed in the "0" slice thickness position to protect operators from inadvertently cutting themselves on the slicing blade. Unless the gauge plate was in that closed position, an interlock system prevented the support arm and table assembly from being removed from the slicer. Once the gauge plate was in the fully closed position, the prior interlock systems required, as an additional step, that the operator slide the table support arm assembly into its fully retracted position. In this position, the table support arm is locked into a stationary position which further impedes the cleaning process.

Another drawback with conventional removable arm and table assembly is that they were difficult to "quick clean" between slicing jobs during periods of extended operation. Such "quick cleaning" should be done between each change of product to be sliced on the slicing machine to prevent any cross-contamination between different food products. Thus, there is a need for a slicing machine with a table and support arm assembly that is configured to facilitate quick cleaning and for easy removal of the table for end of shift cleaning in a dishwasher or sink.

Another problem with prior slicing machines is that the prior designs included a pusher mechanism which did not adequately hold the product during slicing. Such prior pushers included a bar that is slidable and pivotally mounted on an adjustment rod which spans the length of the table. The bar is rotated nearly three hundred and sixty degrees from a "park position" to a "pusher position" behind the product. In this "pusher position," the front surface of the pusher engages the back end of the food product. Since the table is typically angled at forty five degrees relative to the horizon, the force of gravity acts on the food product and pusher to draw them toward the blade during the slicing operation. The force exerted on the product by the sliding motion of the table and contact with the rotating blade can cause the product to jump and/or become cocked which results in the production of inferior slices having differing thickness along the length of a slice. This failure to adequately secure the food product can also result in the product heel having an angled surface. Acceptable slices cannot be made from such an angled heel and thereby a portion of the product may be wasted.

The problem of a cocked product is particularly acute where the length of the product is greater than the length of the table of the slicer. In that case, the product extends past the end of the table such that the front surface of the pusher bar cannot engage the back end of the food product. For this reason, prior pushers were designed to be rotated down upon the top of the product so that their bottom surface engaged the top surface of the food product. To adequately secure the food product, hooks or other protrusions were frequently provided to pierce the top surface of the product to secure it to the pusher. This process can result in undesirable damage to the product. Thus, there is a need for a pusher design which can hold a food product securely to avoid cocking or jumping, readily accommodate products longer than the slicer table, and/or avoid damage to the top of a food product.

Another problem with typical pusher design is that the pusher must be rotated almost three hundred sixty degrees back behind the table to a "park position" prior to loading the product onto the table. This step requires a large arm rotation movement by the operator which is cumbersome and time consuming. Thus, there is a need in the slicing field for a slicer which eliminate the step of rotating the pusher arm to a park position to increase ease of use and operator efficiency.

Another problem with prior meat slicers was that the handles for sliding the table during manual operation were not sufficiently convenient for the operator to use. The handles were typically positioned and angled so that the operator had to grasp the handle with his or her right hand in a single hand position. This arrangement can lead to operator fatigue during long periods of manual slicing. Frequently, the prior handles were placed in position that made it extremely uncomfortable to manually slide the table using the operator's left hand. Thus, there is a need for an ergonomically designed slicing machine that can assist in relieving operator fatigue during long period of manual slicing.

A further problem with prior slicing machines was that the height of the stack of sliced materials was limited by the distance between the top surface of the tray of the machine and the bottom surface of the blade assembly. This is so because, during automatic mode operation, slices fall from the blade area onto the top surface of a tray area formed by the base of the slicer into a stack whose height cannot exceed the bottom surface of the blade assembly. Thus, when the machine was used in automatic mode for slicing a large amount of product, the operator was required to make repeated trips to the slicer to remove a stack of sliced product when a maximum stack height was reached. Accordingly, there is a need for a slicing machine that can accommodate a larger stack height for sliced product.

Another difficulty with prior slicing machines was the efficiency of their operation during the automatic slicing mode. Typically, such machines included only three discrete settings for the distance traveled by the table during an automatic slice stroke. Thus, the operator had to choose a stroke length that exceeded the width of the product to be sliced. The difference between the length of the stroke and the width of the product was wasted motion by the slicing machine which increased the time necessary to produce a given number of slices. Furthermore, the efficiency of such automatic slicers was further limited by the small number of speed settings for the movement of the table. Typically the prior machines included only a limited number of stroke speed settings, e.g., from one to three stroke speed settings. Thus, prior machines did not allow the stroke length and stroke speed to be optimized for a given task to maximize efficiency of the production of slices during automatic operation. Accordingly, there is a need for a slicing machine which can increase the efficiency of the automatic slicing mode.

Another problem with prior meat slicers was the difficulty of cleaning underneath the slicer at the end of work shifts. One approach to this problem is disclosed in U.S. Pat. No. 5,245,898 issued to Somal, et al. which discloses a lift arrangement for a slicing machine. The patent discloses a lever assembly located on the right side of the slicing machine. Since the slicing machine is typically oriented with its front side facing the operator and the counter supporting the machine limiting access to the right side of the machine, some operators found it uncomfortable to lift the lever arm due to the length of reach required. Accordingly, there is need for a slicing machine lifting apparatus which can be more easily accessed and operated by the operator.

SUMMARY OF INVENTION

The present invention is generally directed to an ergonomically designed food slicing machine which provides improved quality of sliced product and is more efficient to operate in both manual and automatic mode.

In one embodiment of the invention, the slicing machine includes a rotatable blade for slicing bulk food product, a motor operably connected to the rotating blade, and a base portion located below the rotatable blade which defines a portion of the periphery of a food slice receiving area for accepting the sliced food product as it falls from the blade after slicing. This design provides a substantially open area below the blade to receive the sliced food product so that slices generated during automatic operation may reach a substantial stack height. Prior food slicing machines typically included a tray area of substantial thickness below the slicing blade which limited the attainable height of the food slice stack. This tray area of the base of prior slicing machines typically housed a portion of the motor for rotating the blade or other internal workings of the machine.

In another embodiment of the invention, a visible slice thickness indicia is located adjacent to the blade so that it can be viewed by the operator at the same time as the slicing blade. The visible indicia correlated to the distance between one adjustable gauge plate and the slicing blade which distance determines slice thickness. The visible indicia includes a support surface which is connected to a portion of the slicing machine adjacent to the rotatable blade and adjustable gauge plate and a visible indicia located on the support which correlates with the distance between an adjustable gauge plate and the blade so that the operator may view the visible indicia simultaneously with viewing the blade during food product slicing. This feature of one embodiment of the invention allows the operator to maintain his or her attention on the slicing area and blade during periods of thickness adjustment which can increase operator efficiency and safety.

In a further embodiment of the invention, the bulk food product slicing machine includes a blade sharpening assembly having a retractable shield mounted adjacent to sharpening stones. The shield is adapted to retract from the surface of the sharpening stones when the operator places the blade sharpening assembly in position to sharpen the blade edge. Optionally, the blade sharpening assembly may be provided with a guide which directs the movement of the sharpening stone along a linear path toward the blade edge for sharpening and away from the blade edge after sharpening. In that embodiment of the invention, the blade sharpening assembly also includes a spring for biasing the sharpening stone away from the blade edge when the stone is not sharpening the blade edge, and an actuator for the operator to depress and move the sharpening stone downward into the blade sharpening position. Optionally, the slicing machine may be provided with a blade sharpening assembly position sensor for detecting the presence of the assembly on the slicing machine and disabling the motor for rotating the blade should the blade sharpener assembly be absent.

A still further embodiment of the invention, a slidably mounted table for supporting the bulk food product as it is moved in a table movement direction toward the blade and away from the blade is provided. The table includes slidably mounted sled having a base portion for supporting the underside of the food product during slicing. The sled also includes a securing surface extending from the base portion for engaging at least one side of the food product. The securing surface is slidably mounted to the base for movement in the table movement direction to adjust to the width of the food product. The securing surface extends from the base portion of the sled and preferably is provided with one or more lock(s) for securing the sled into a stationary position in the table movement direction and transversely to the table movement direction. The sled may also include a second surface extending from the base portion of the sled for engaging the back end of the food product for securing the food product during slicing. The preferred sled arrangement of this invention provides improved security for holding the food product in place during the slicing operation. It further has the advantage of allowing greater flexibility since the food product may be engaged by the securing surface from either the side or from the back end of the food product.

In another embodiment of the invention, the food product slicing machine is provided with a carriage slidably mounted to a base for providing movement in a table movement direction toward said rotatable blade and away from said rotatable blade, a support arm pivotally mounted to the carriage and including a pivot actuator for selectively pivoting the arm away from the body of the slicing machine to easy access for cleaning, as well as a table releasably mounted to the support arm having a release mechanism for disengaging the table from the support arm to allow the table to be disengaged from the support arm and cleaned remotely from the machine in either a sink or a dishwasher.

In a further embodiment of the invention, a system for providing operator adjustment of optimum stroke length during automatic operation of the bulk food slicing machine is provided. The system includes a selector for activating automatic slicing operation of the bulk food slicing machine, a first position sensor for detecting a table start position during an operator controlled slicing stroke of the food product, a switch for activating the first position sensor prior to operator controlled slicing, a processor electrically connected to the first position sensor and having memory for recording the table start position and table end position signal, the processor being electrically connected to the table drive motor and providing a table start position signal to said motor to drive said motor to a table start position, said processor sending a stroke commencement signal to the drive motor after the table is in the table start position, the motor driving the table to the end of the stroke length.

DETAILED DESCRIPTION OF THE INVENTION

Figure 1:
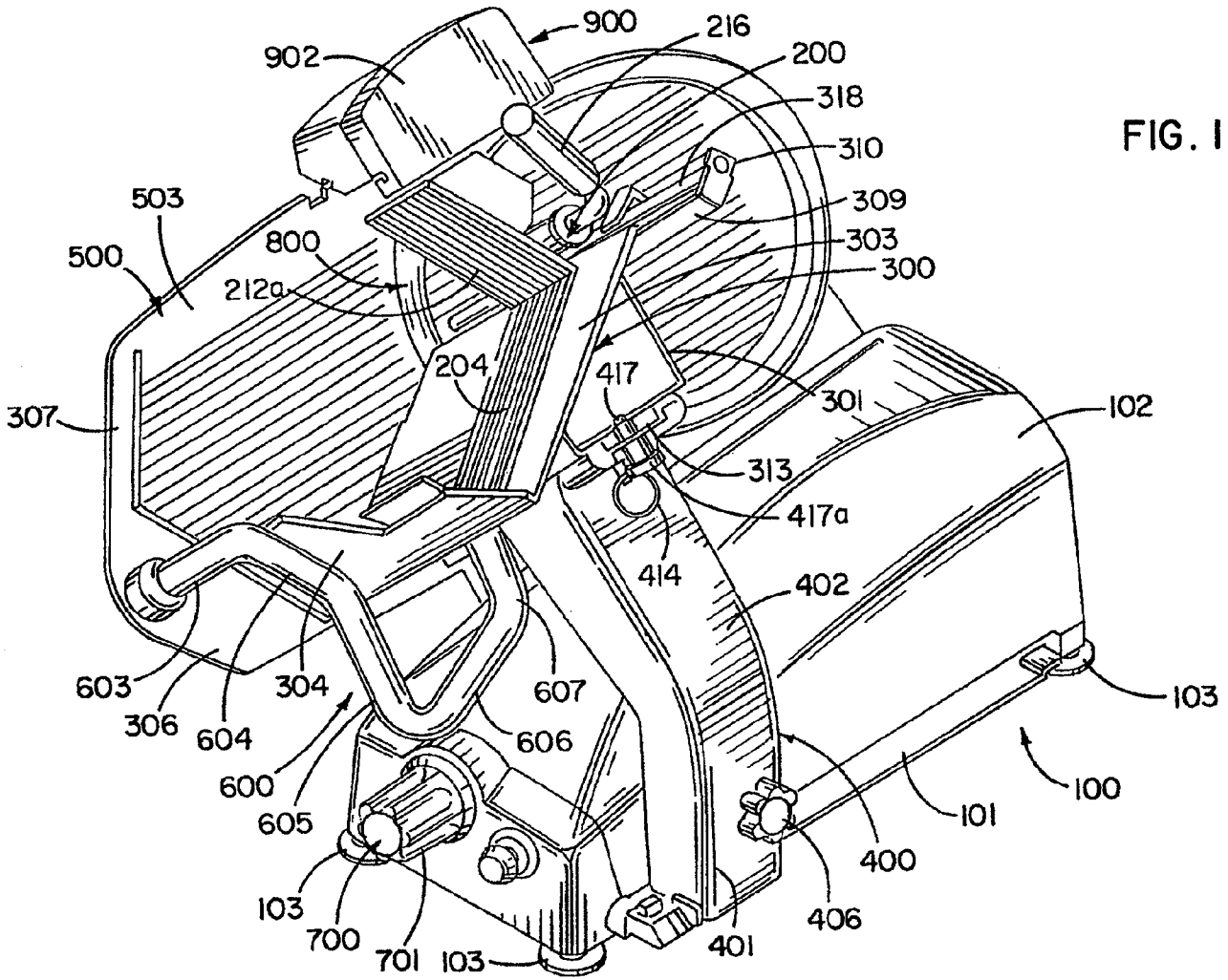
FIGS. 1 and 2 are perspective views of a slicing machine and its various components according to one embodiment of the present invention.
Figure 2:
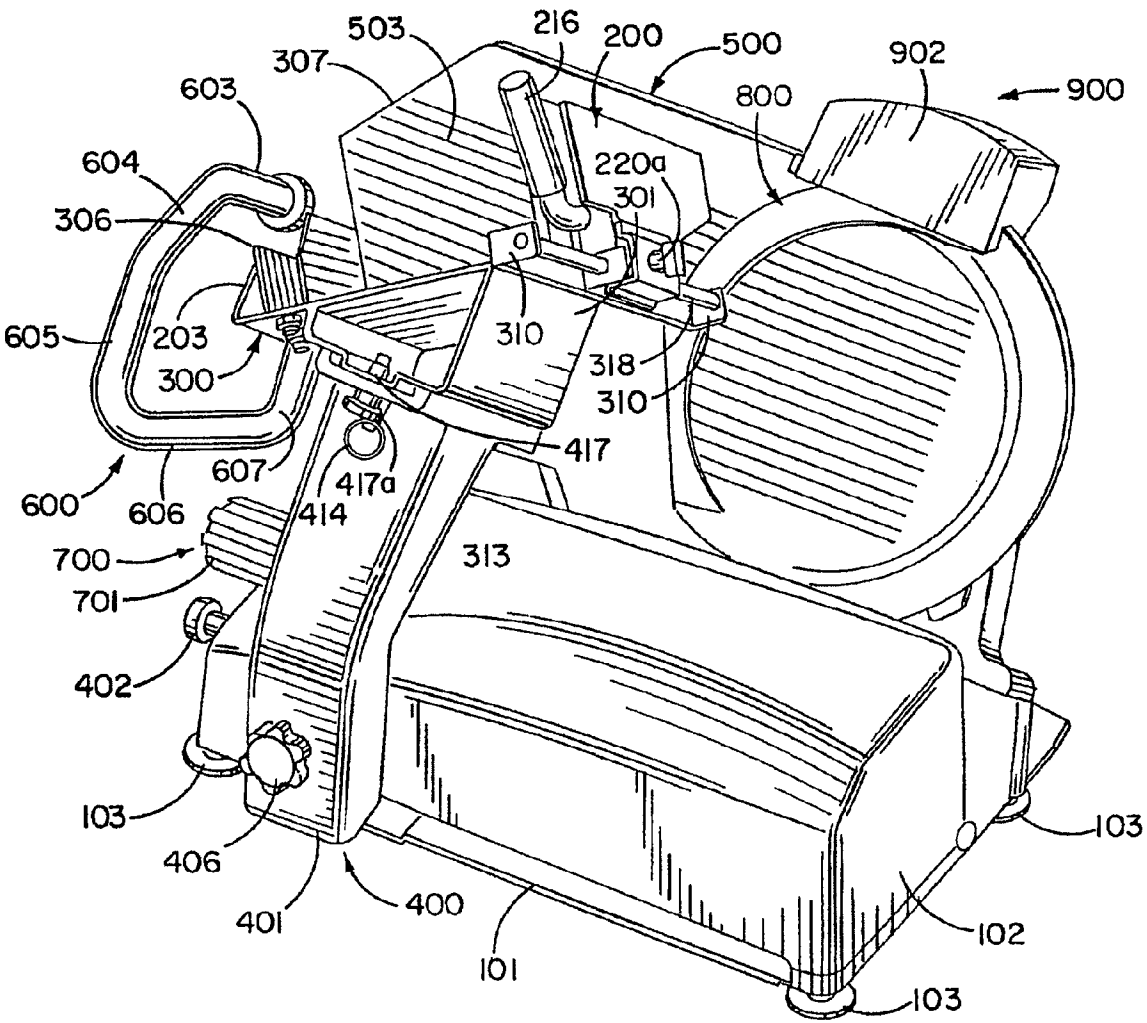
Figure 3:
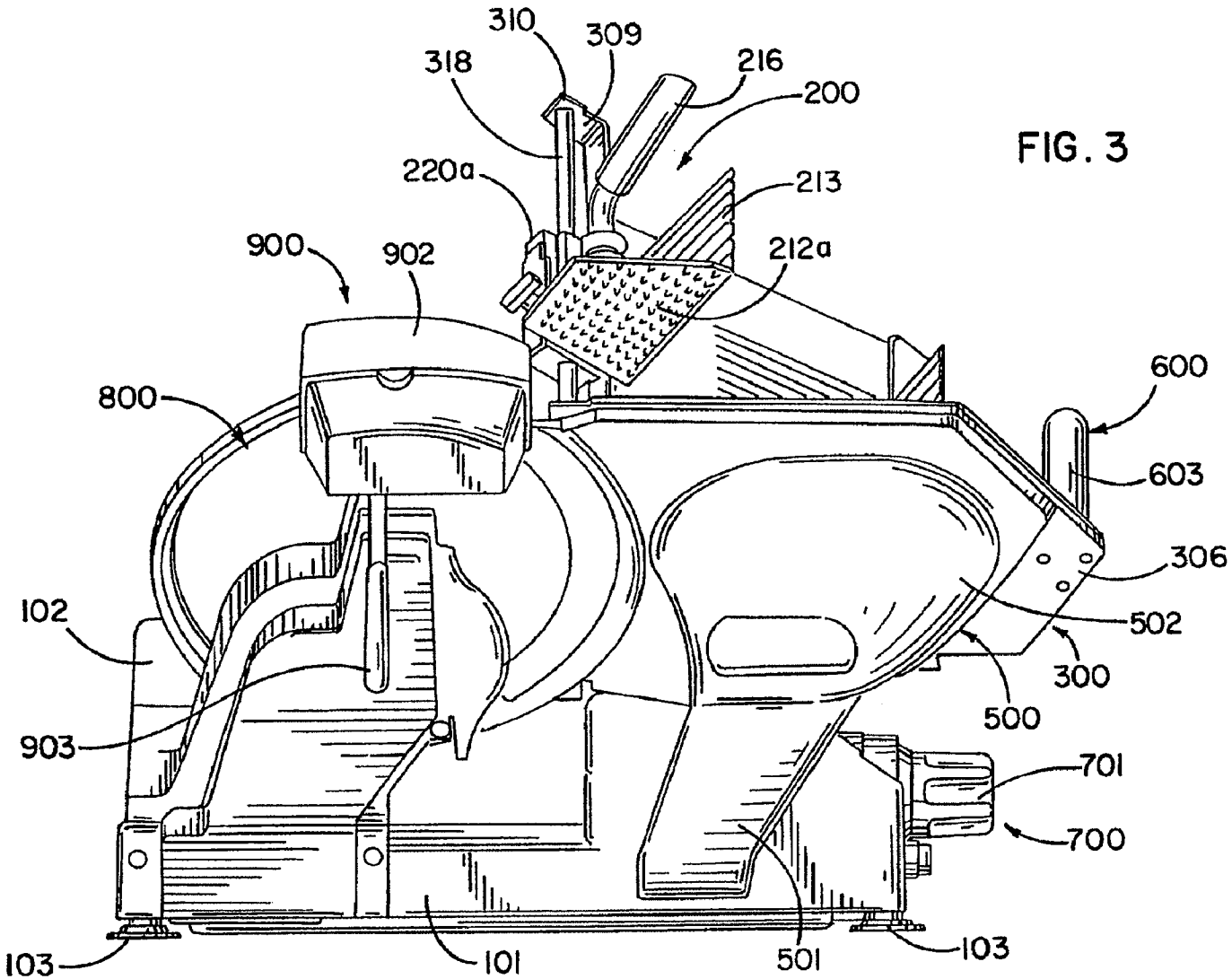
FIG. 3 is a front elevational view of the slicing machine shown in FIGS. 1 and 2.
Figure 4:
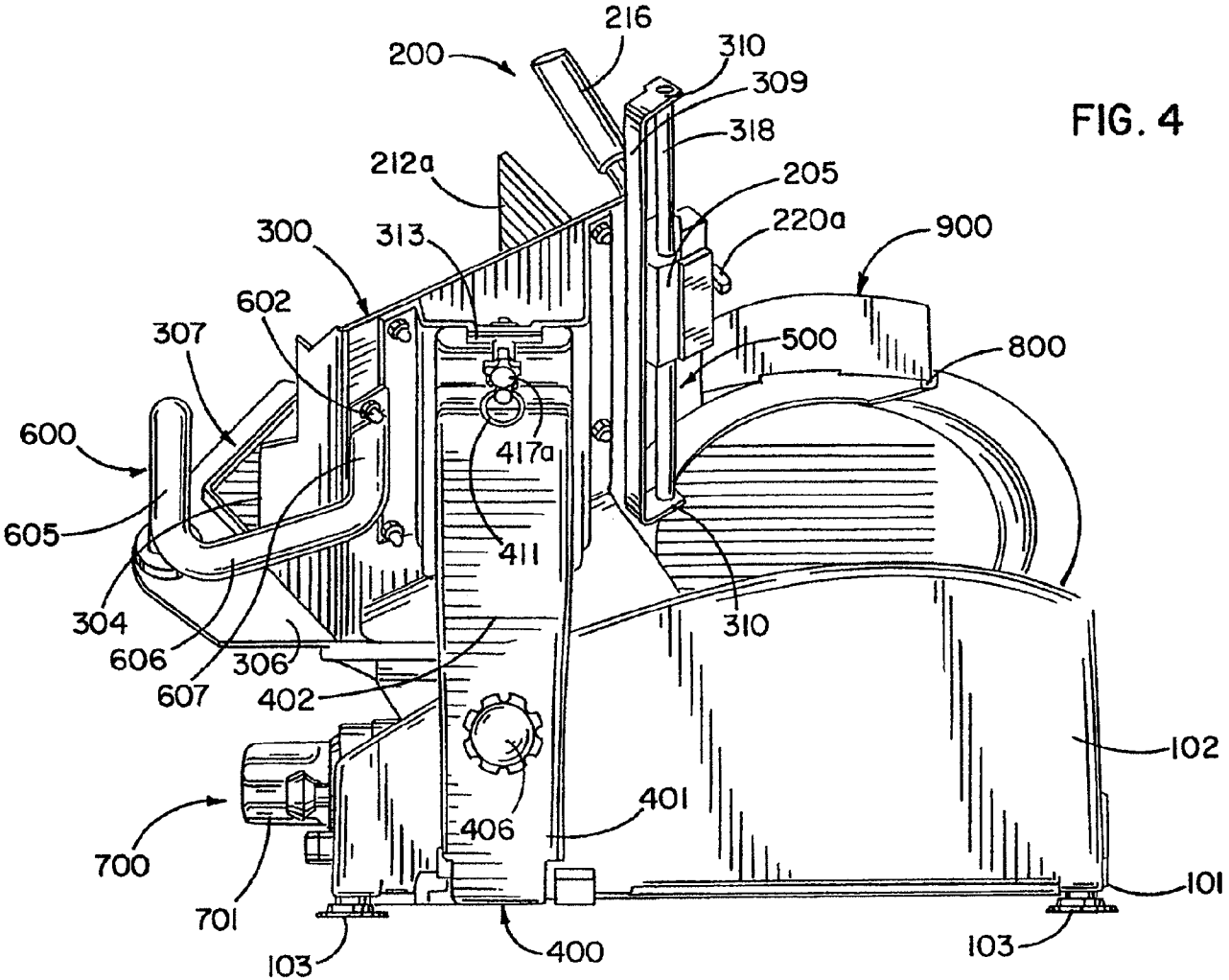
FIG. 4 is a rear elevational view of the slicing machine shown in FIGS. 1 and 2.
Figure 5:
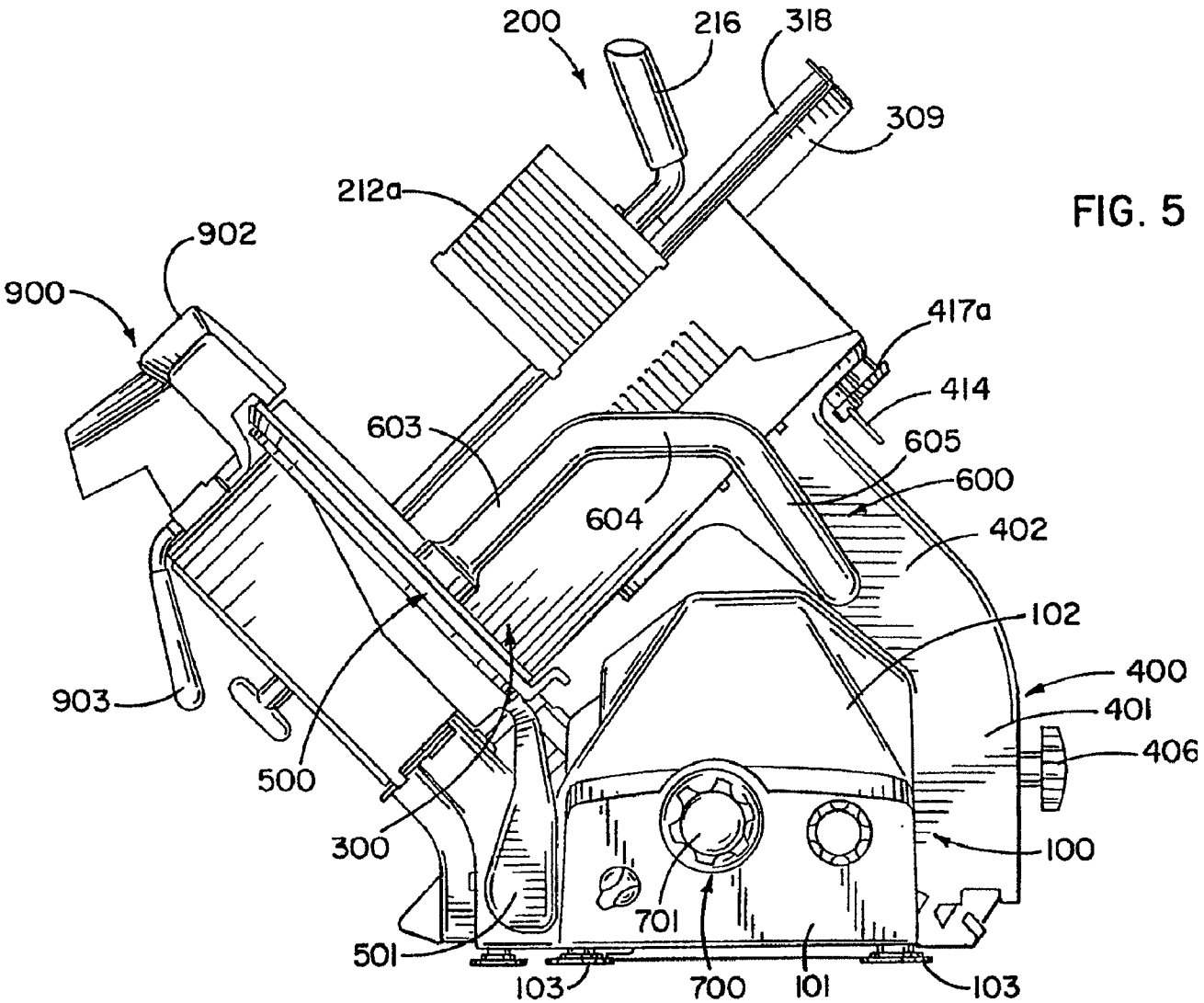
FIG. 5 is a right elevational view of the slicing machine shown in FIGS. 1 and 2.
Figure 6:
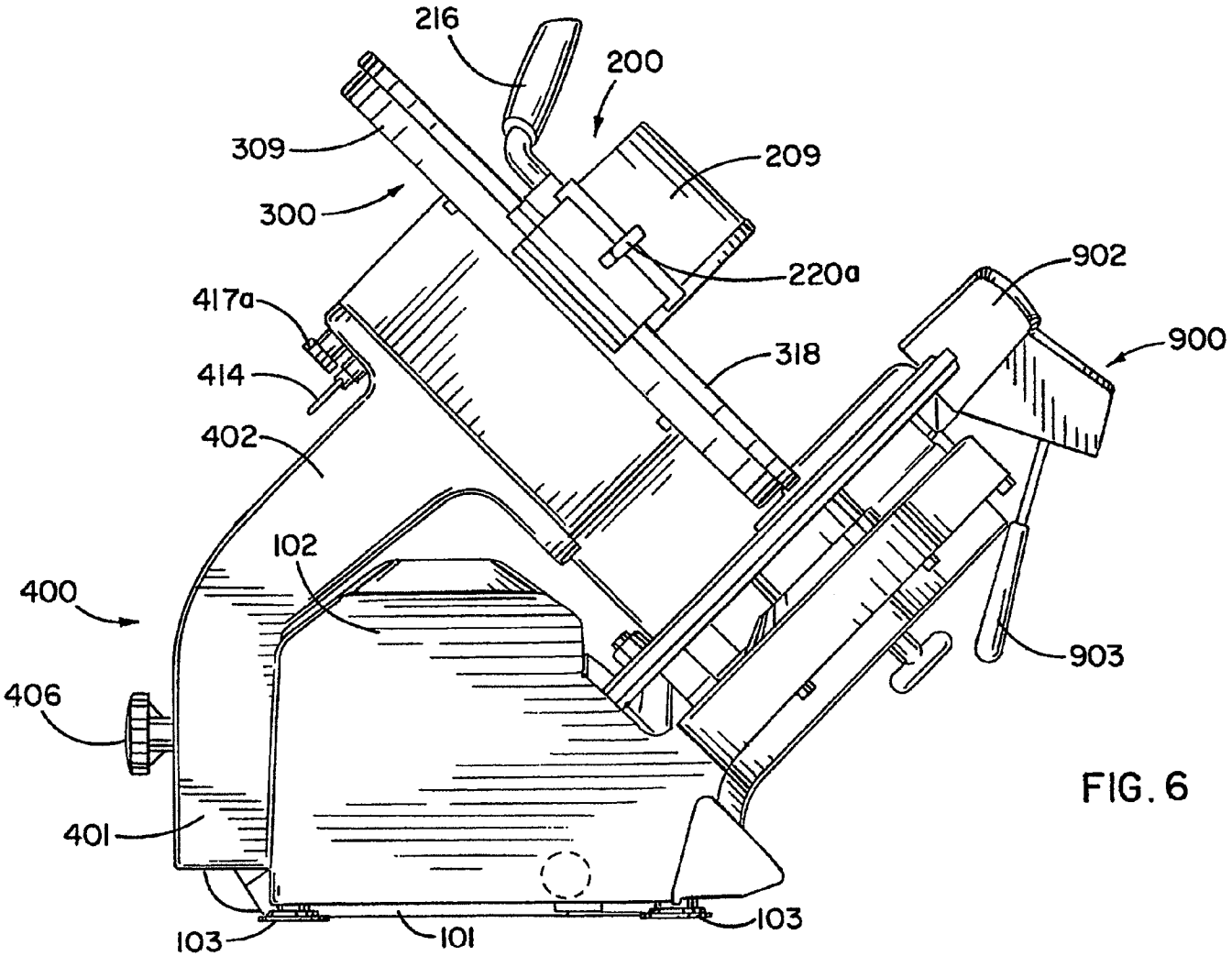
FIG. 6 is a left elevational view of the slicing machine shown in FIGS. 1 and 2.
Figure 7:
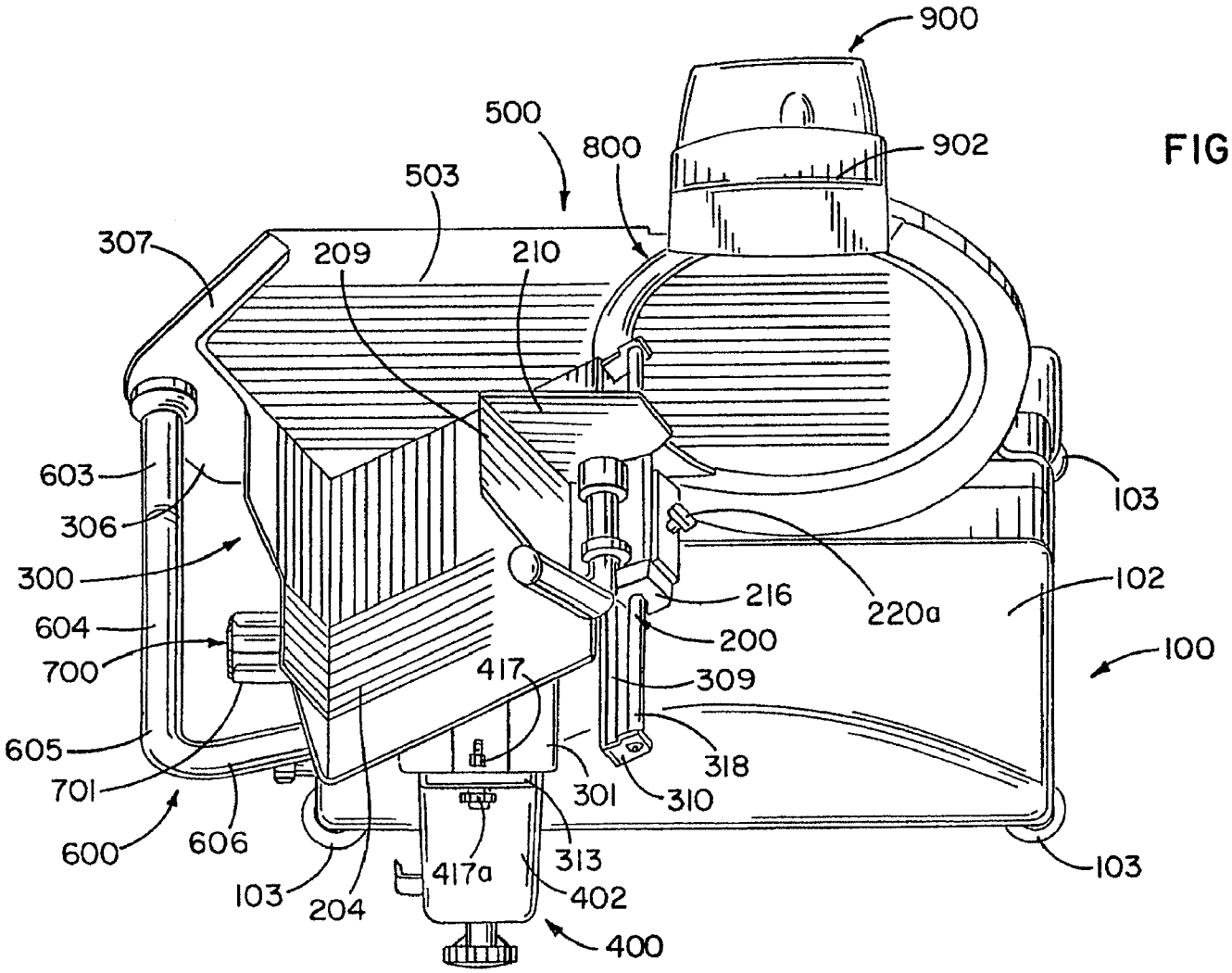
FIG. 7 is a top plan view of the slicing machine shown in FIGS. 1 and 2.
Figure 8:
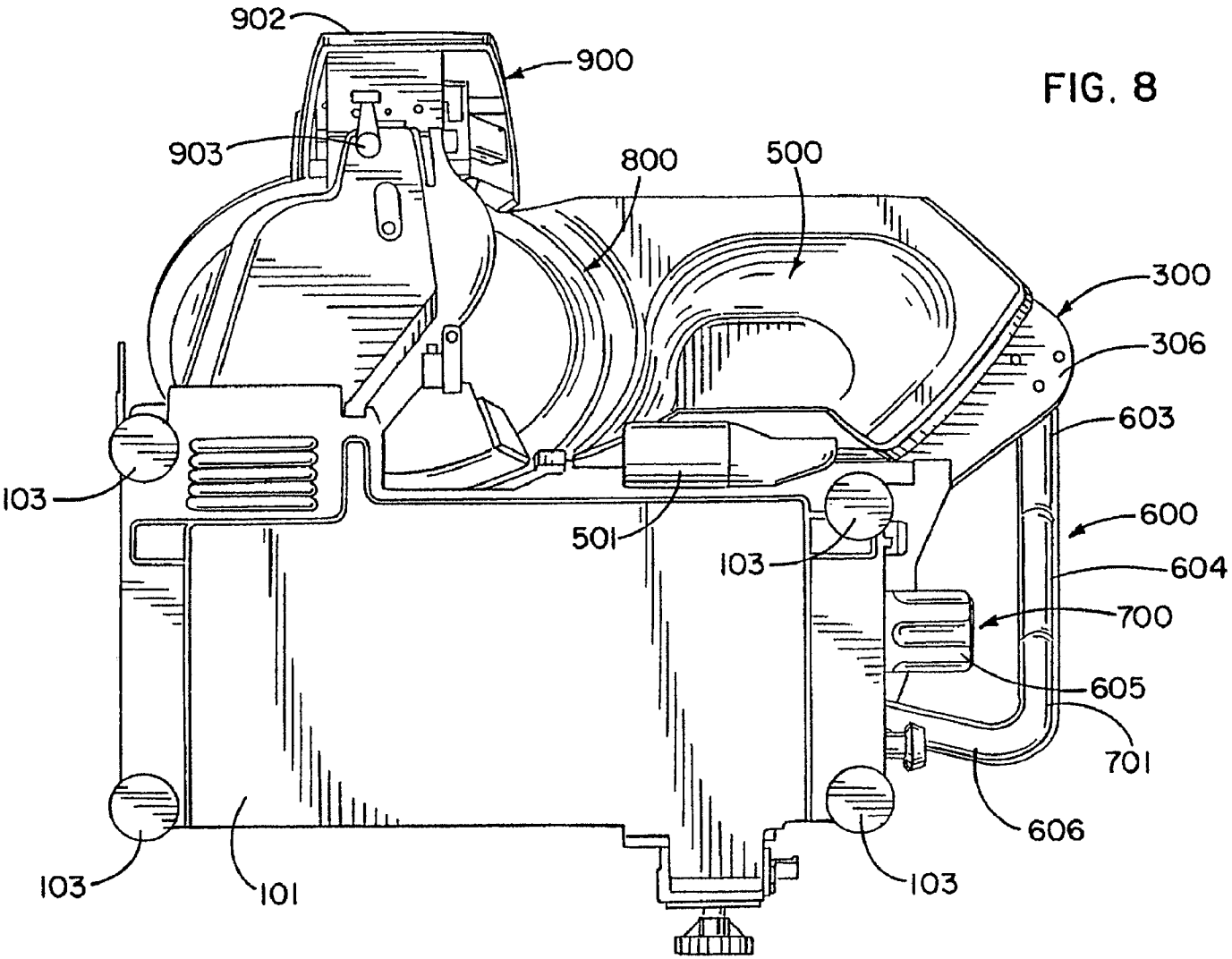
FIG. 8 is a bottom plan view of the slicing machine shown in FIGS. 1 and 2.
Figure 9:
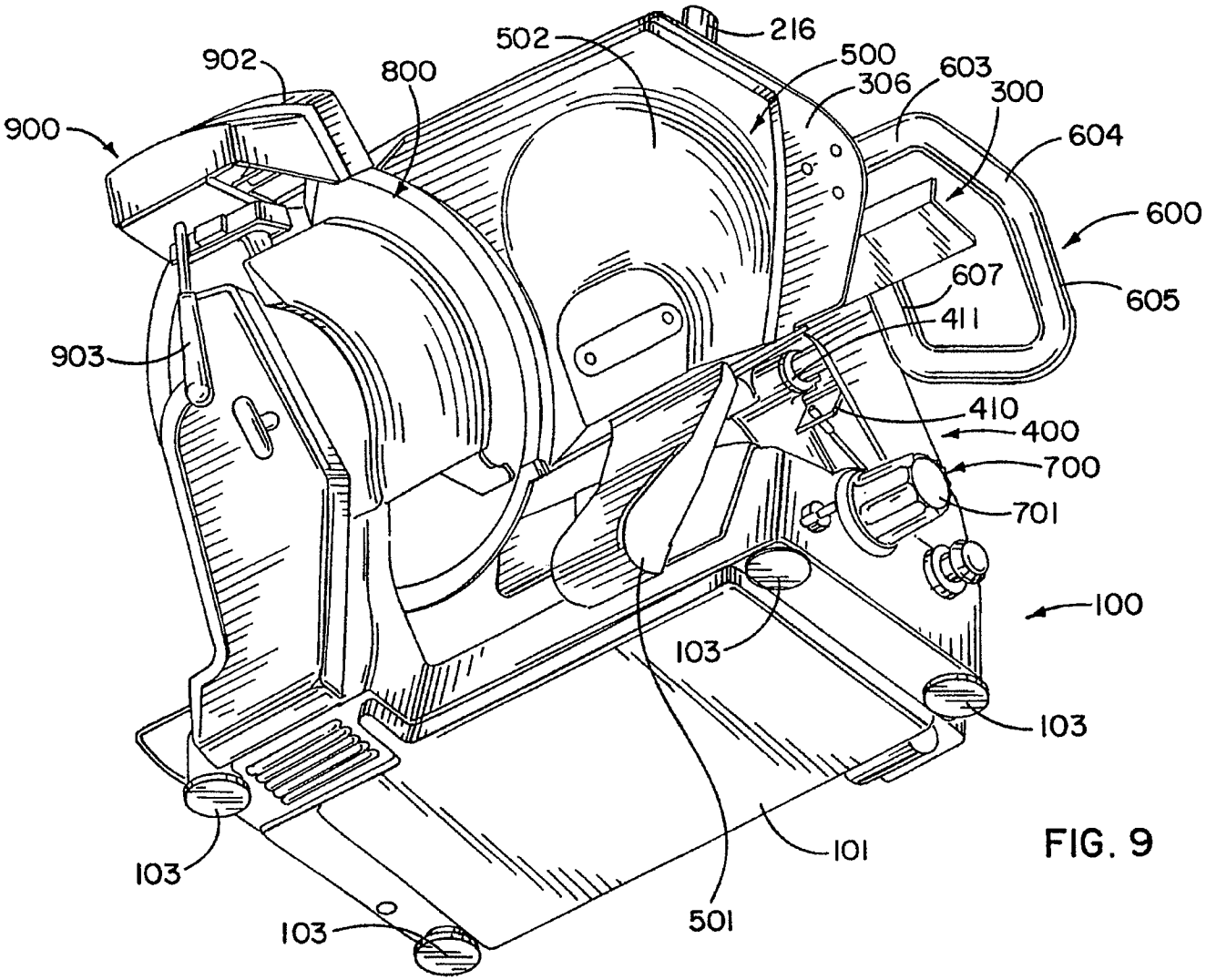
FIGS. 9-12 show additional perspective views of the slicing machine of FIGS. 1 and 2
Figure 10:
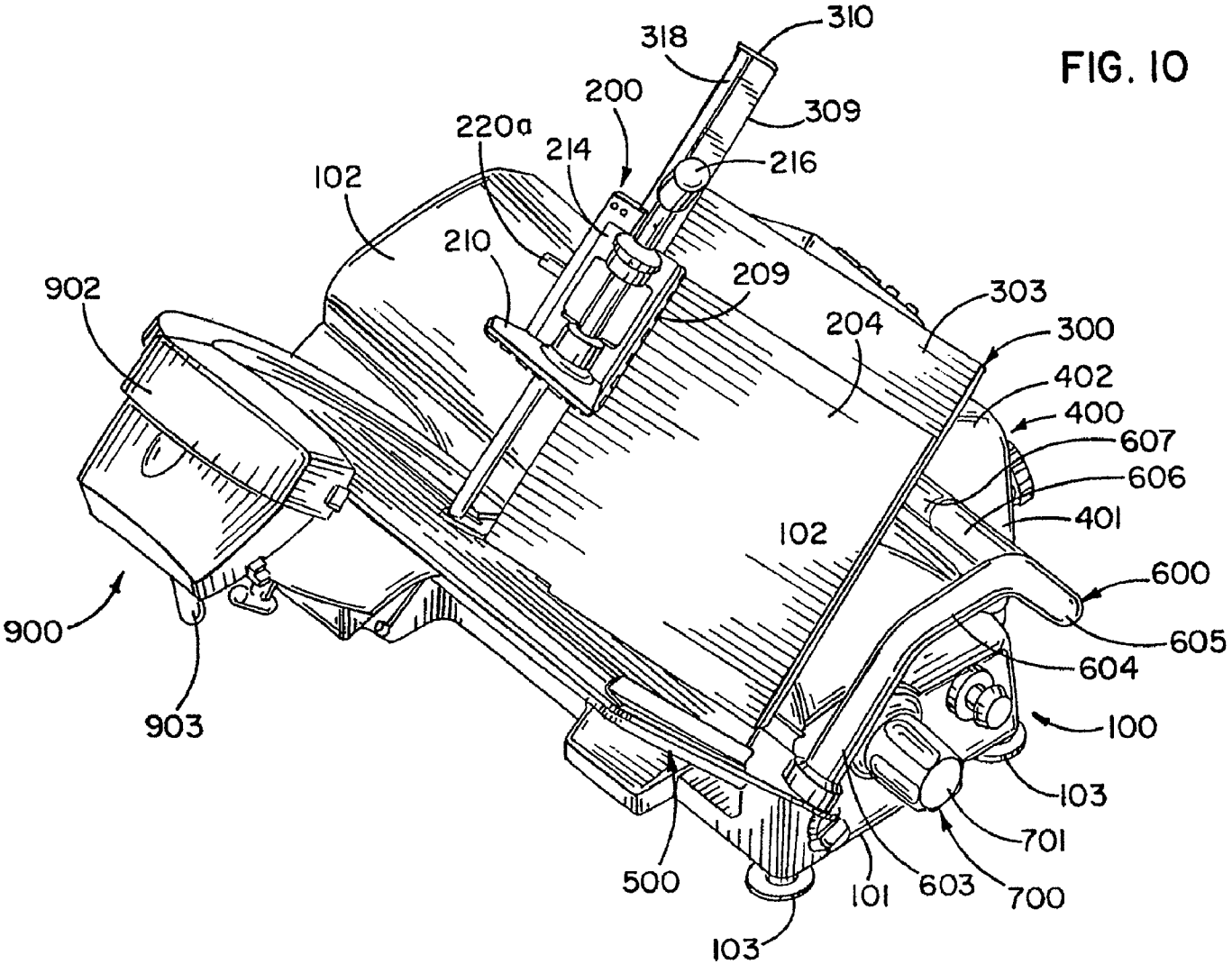
Figure 11:
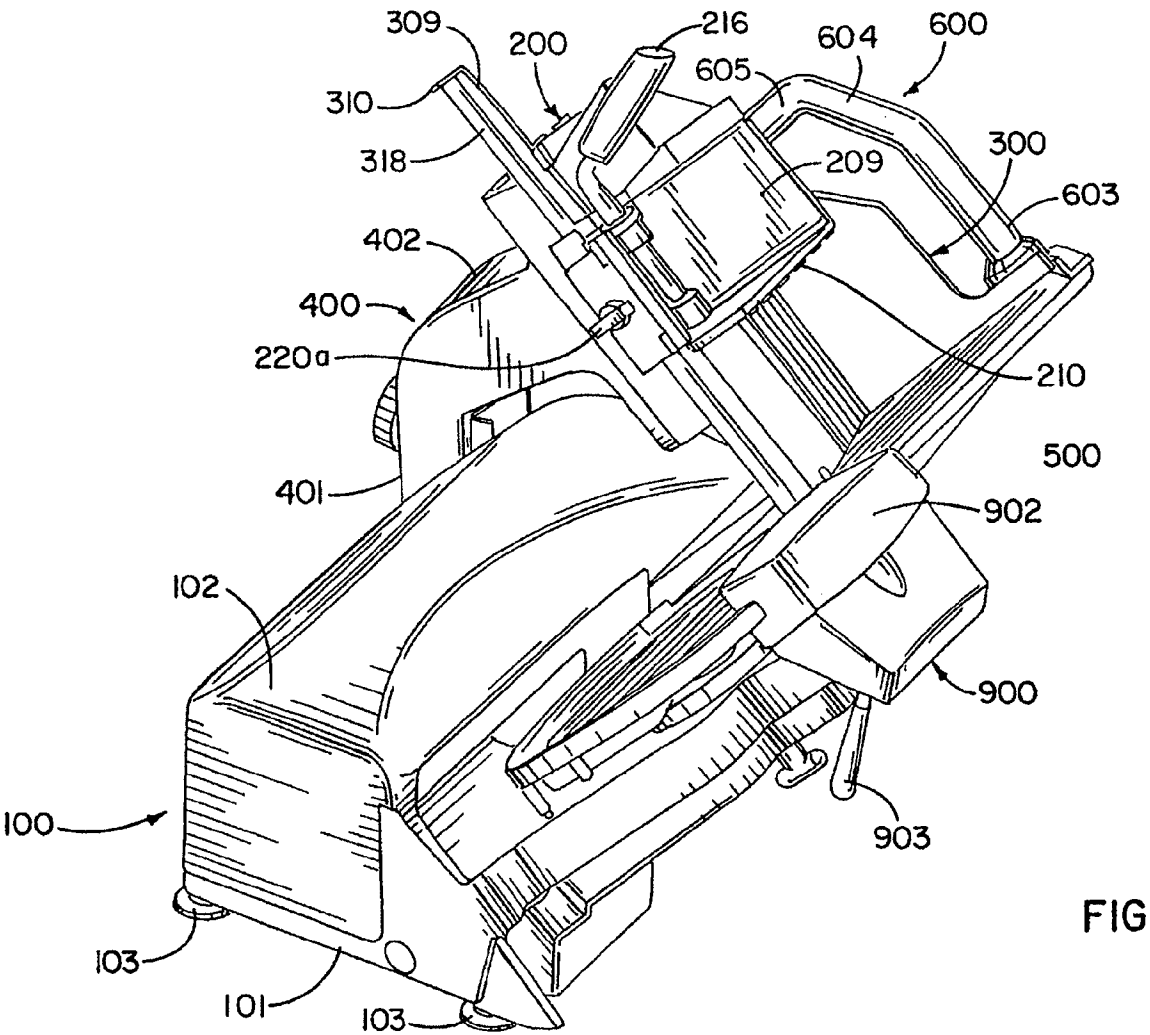
Figure 12:
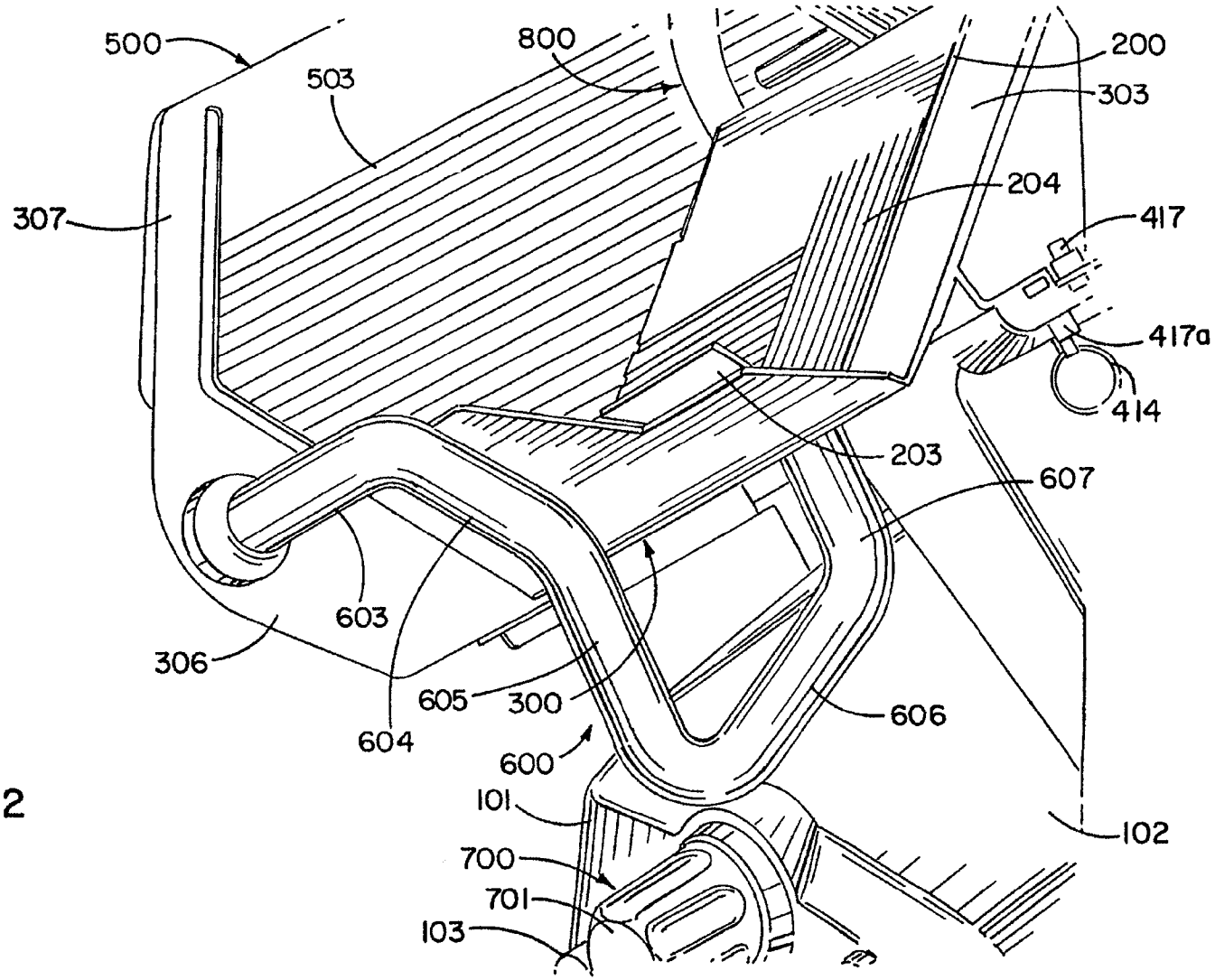

The slicing machine and various components according to the one embodiment of the invention are shown in FIGS. 1 through 8. In this embodiment, the slicing machine generally includes a housing 100, a pusher assembly 200, a table 300, a table arm 400, a gauge plate 500, a handle 600, an indexing assembly 700, a blade 800 and a sharpener assembly 900.

Base 100 generally includes a first portion 101, a cover 102 and a plurality of feet 103 for supporting the slicing machine on a surface, such as a counter.

Figure 13:
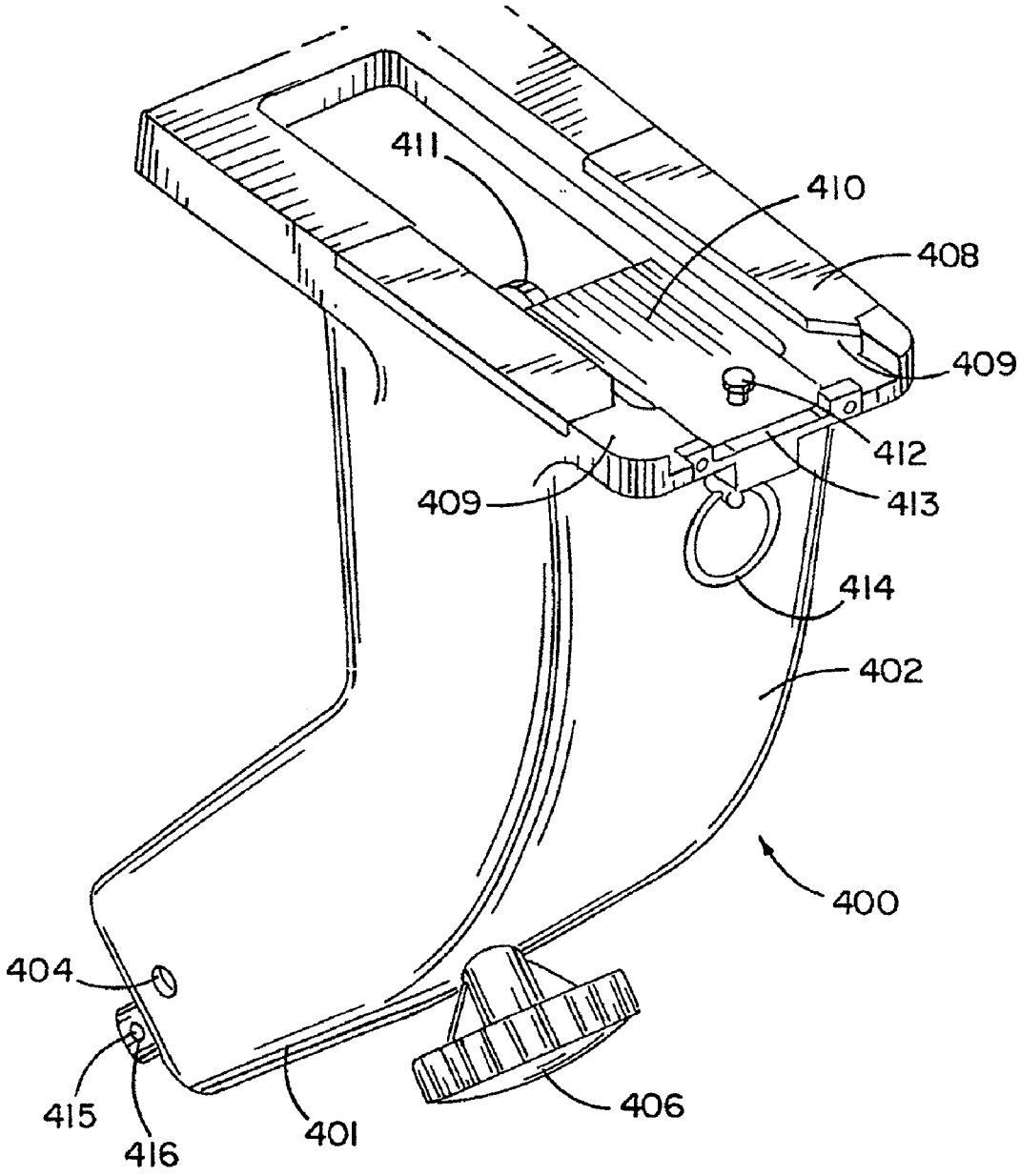
FIGS. 13 and 14 show a table arm according to one embodiment of the present invention.
Figure 14:
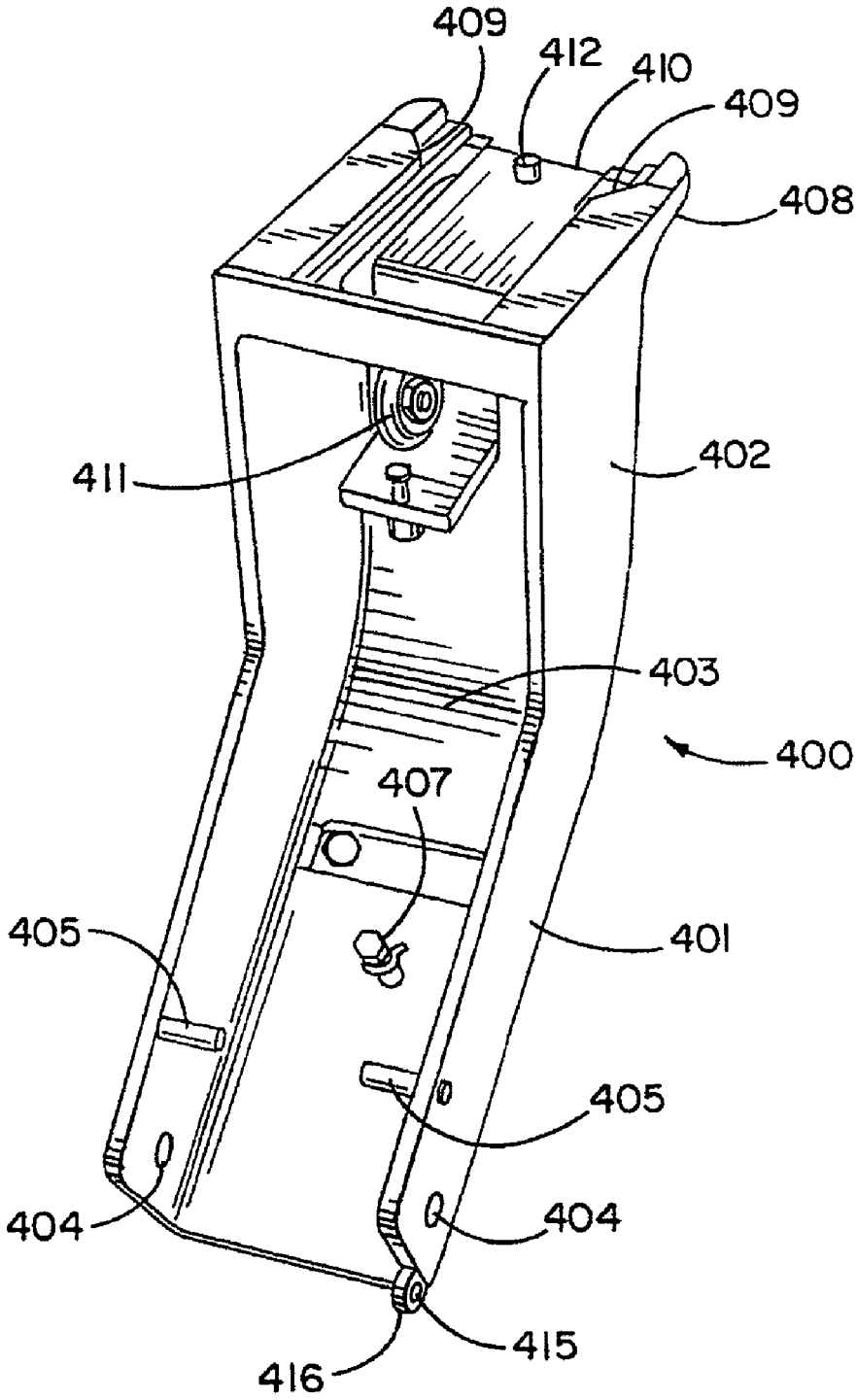
Figure 36:
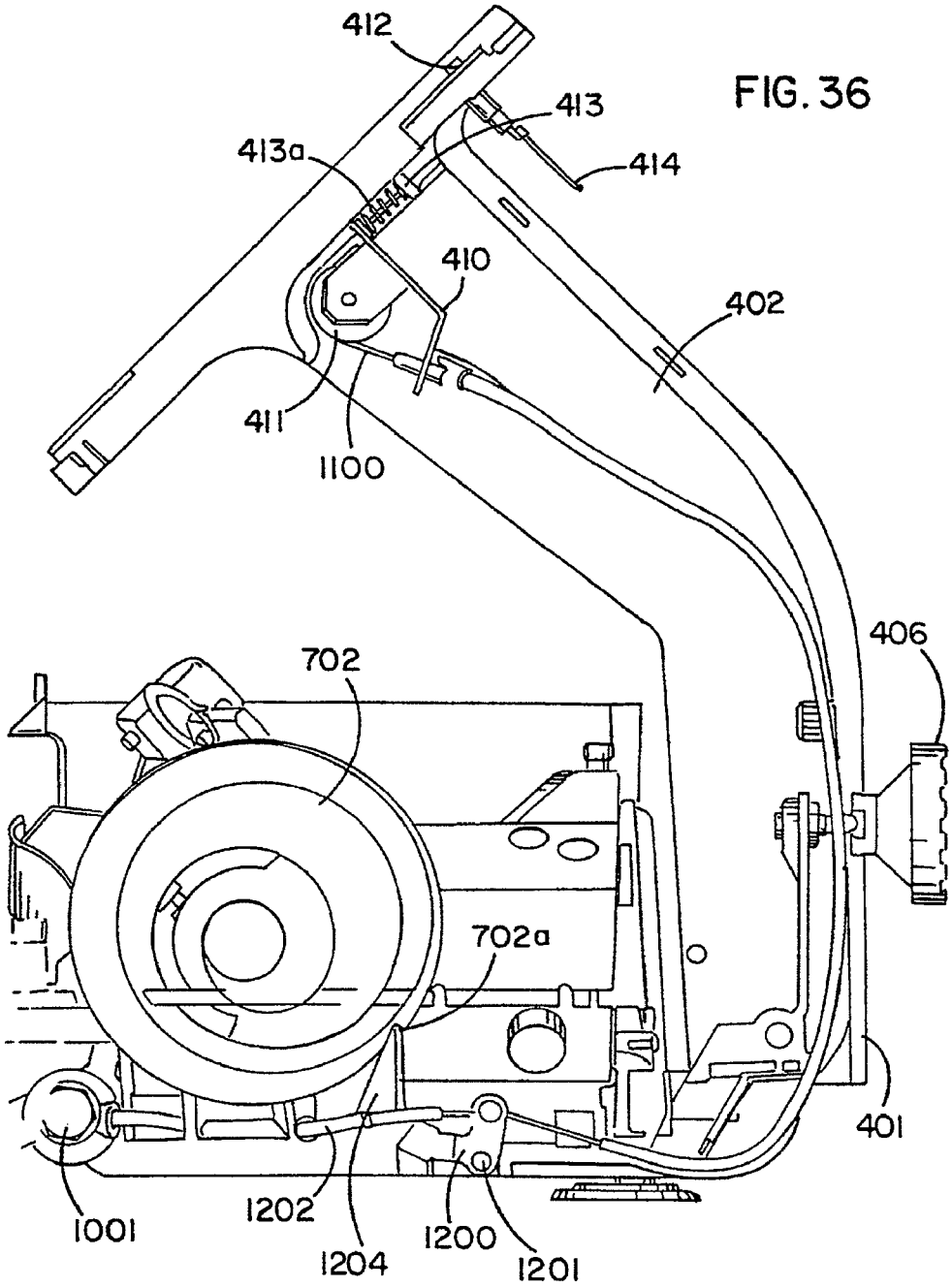
FIGS. 36-38 illustrate an interlock system according to one embodiment of the present invention.
Figure 37:
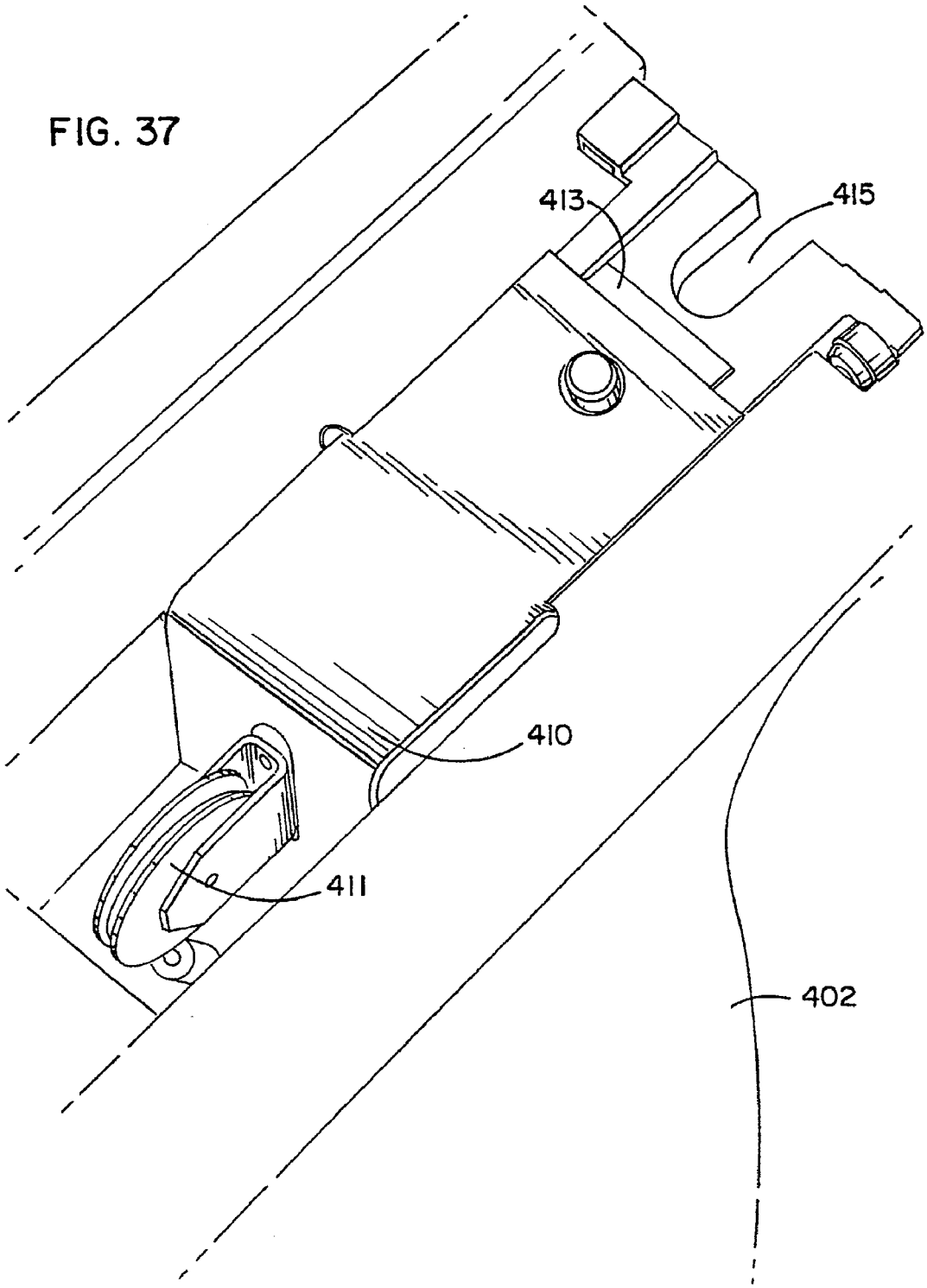

Table arm 400 (FIGS. 13 and 14) generally includes, in the embodiment shown, a generally hollow arm having a first portion 401 and a second portion 402 defining an interior cavity 403. Portions 401 and 402 are disposed at an angle to one another. Arm 400 includes a pair of openings 404 which are used to pivotally attach arm 400 to a carriage assembly located within base 100 of the slicing machine such that arm 400, table 300, pusher assembly 200 and handle 600 may travel along the length of the slicing machine. A pair of stop pins 405 are located within cavity 403 to limit movement of arm 400. A knob 406 having a post or shaft 407 attached thereto is secured to arm 400 such that post 407 extends into cavity 403. Post 407 engages the carriage assembly to fasten arm 400 thereto. Arm 400 further includes an upper face 408 on which table 300 and pusher assembly 200 are mounted as described below. A slot 409 is provided beneath face 408 for this purpose. Arm 400 further includes a plate 410 to which a pulley 411 is mounted within the interior of cavity 403. A pin 412 is secured to arm 400 so as to be biased, as by a spring or other device, into the position shown when table 300 is not secured to arm 400. A plate 413 is mounted to arm 400 beneath plate 410 as shown. Plate 413, as described in greater detail below, can move with respect to the remainder of arm 400. Plate 413 is provided with a slot to accommodate pin 412 as plate 413 moves. A spring 413*a* (FIG. 36) is provided to bias plate 413 into the position shown when table 300 is not attached to arm 400.

Figure 15:
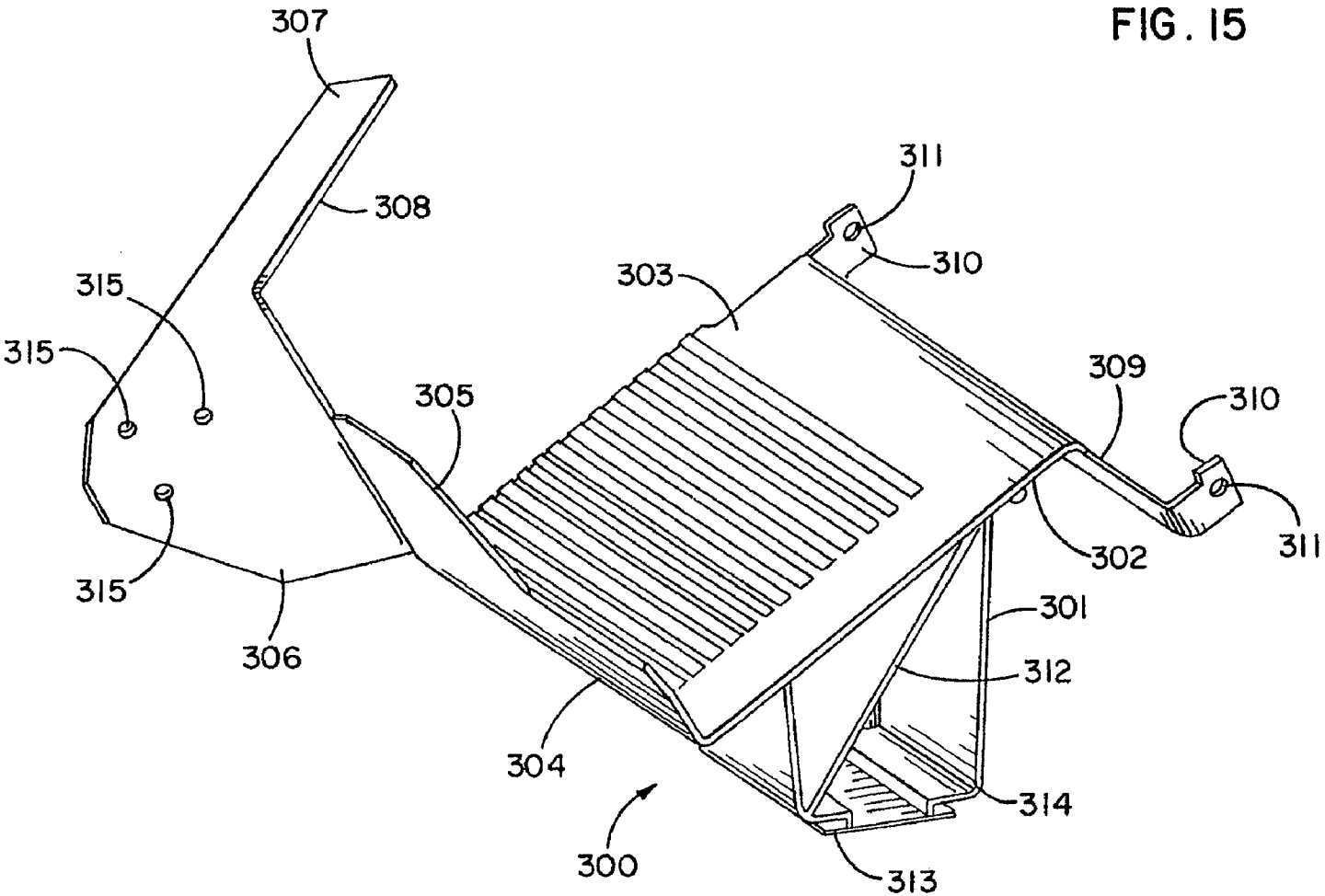
FIGS. 15 and 16 show a table according to one embodiment of the present invention.
Figure 16:
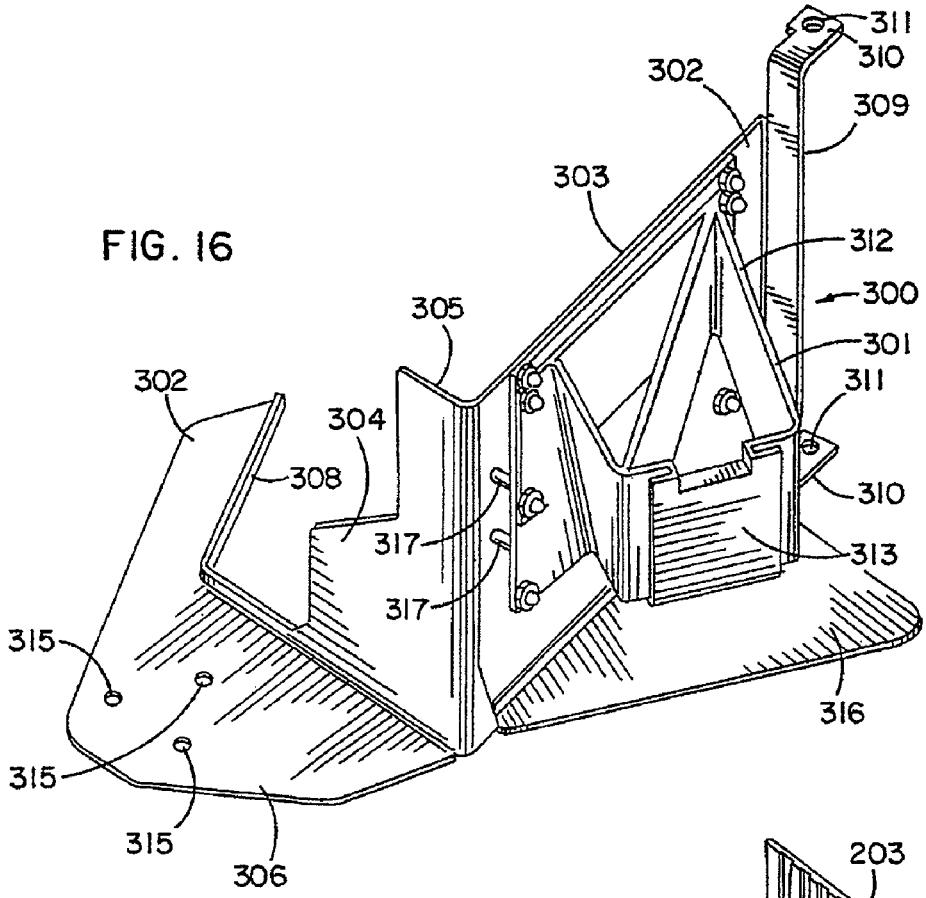

Table 300 (FIGS. 15 and 16) includes, in the embodiment shown, a body 301 having a first support 302 mounted thereto. First support 302 includes a surface 303. A second support 304 having a surface 305 is connected to first support 302 such that surfaces 303 and 305 are disposed at a generally 90° angle. A plate 306 is connected to second support 304 at a generally 90° angle thereto. An arm 307 extends from plate 306 and includes a surface 308 generally facing surface 303. Arm 307 helps contain the item being sliced on table 300 during use. An arm 309 is connected to support 302 and includes a pair of opposed flanges 310 with openings 311 formed therein. Openings 311 receive the shaft along which pusher assembly 200 moves, as described below. Body 301 may include a reinforcement 320 therein. Note that the embodiment of table 300 shown in FIGS. 15 and 16 differs from that shown in FIGS. 1-12 in this regard. Body 301 further includes a mounting flange 313 on the base thereof for attaching table 300 to arm 400 as described below. An opening 314 is formed within the base of body 301 to receive pin 412 as described below. A plurality of openings 315 are formed within plate 306 for securing handle 600 thereto as described below. A plate 316 is connected to the underside of support 302 as shown. A pair of mounting studs 317 are likewise secured to the underside of support 302 for securing handle 600 thereto.

To secure table 300 to arm 400, flange 313 is positioned below surface 408 adjacent slot 409. Ring 414 is pulled downwardly to lower pin 412 and body 301 is pushed inwardly such that it is located above pin 412. Body 300 is continually pushed inward until pin 412 is aligned with opening 314. Because pin 412 is biased upwardly, it will automatically extend through opening 314, thereby preventing body 300 from sliding outwardly. Note that in this position, flange 313 is located within slot 409 beneath face 408.

Figure 17:
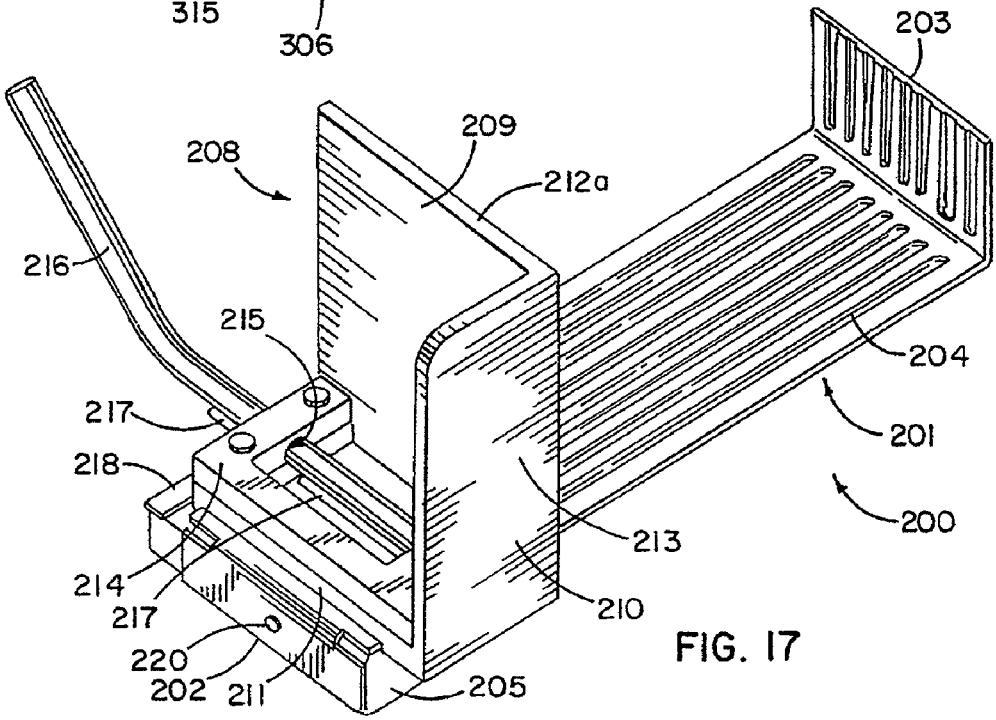
FIGS. 17-19 show a pusher assembly according to one embodiment of the present invention.
Figure 18:
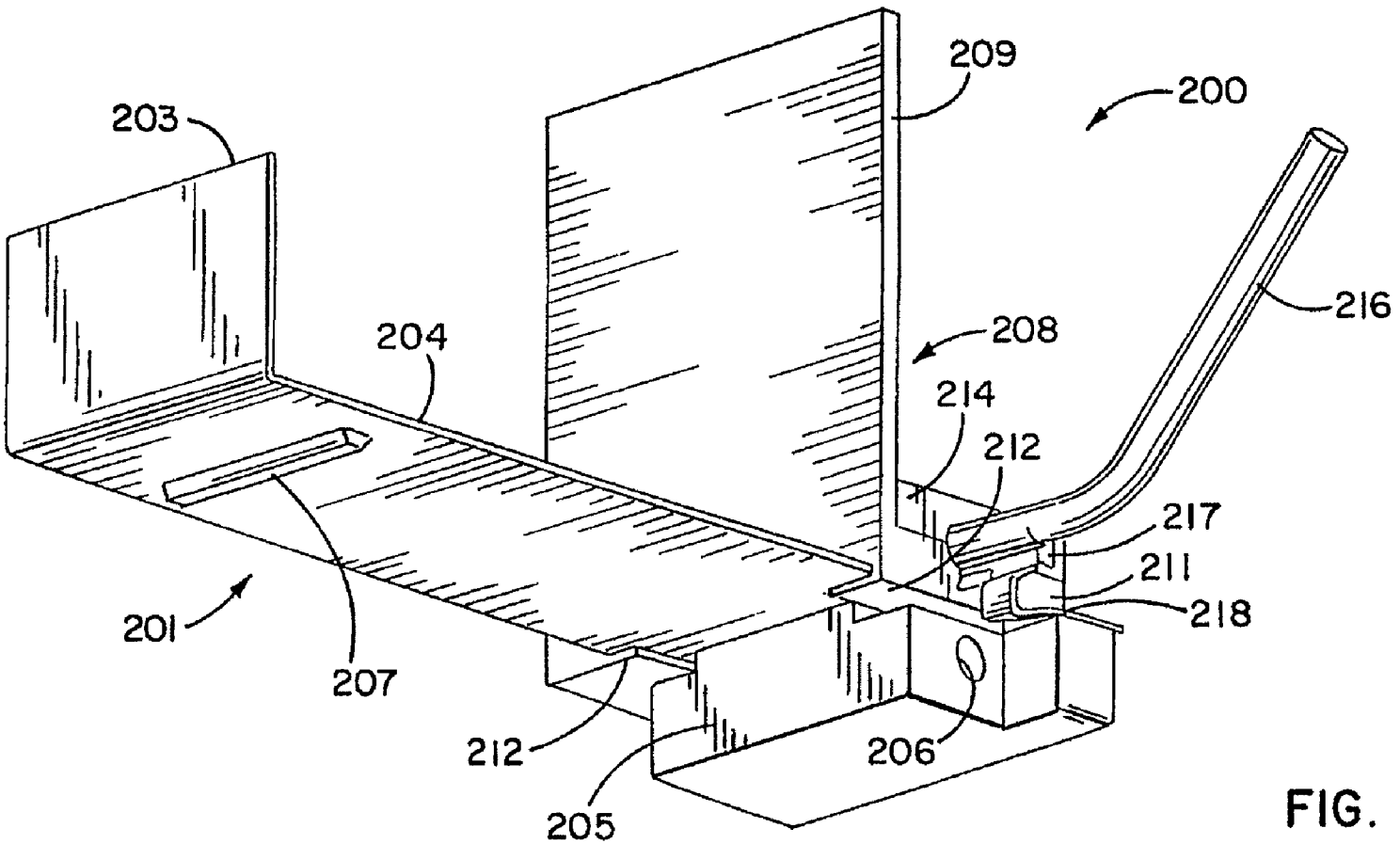
Figure 19:
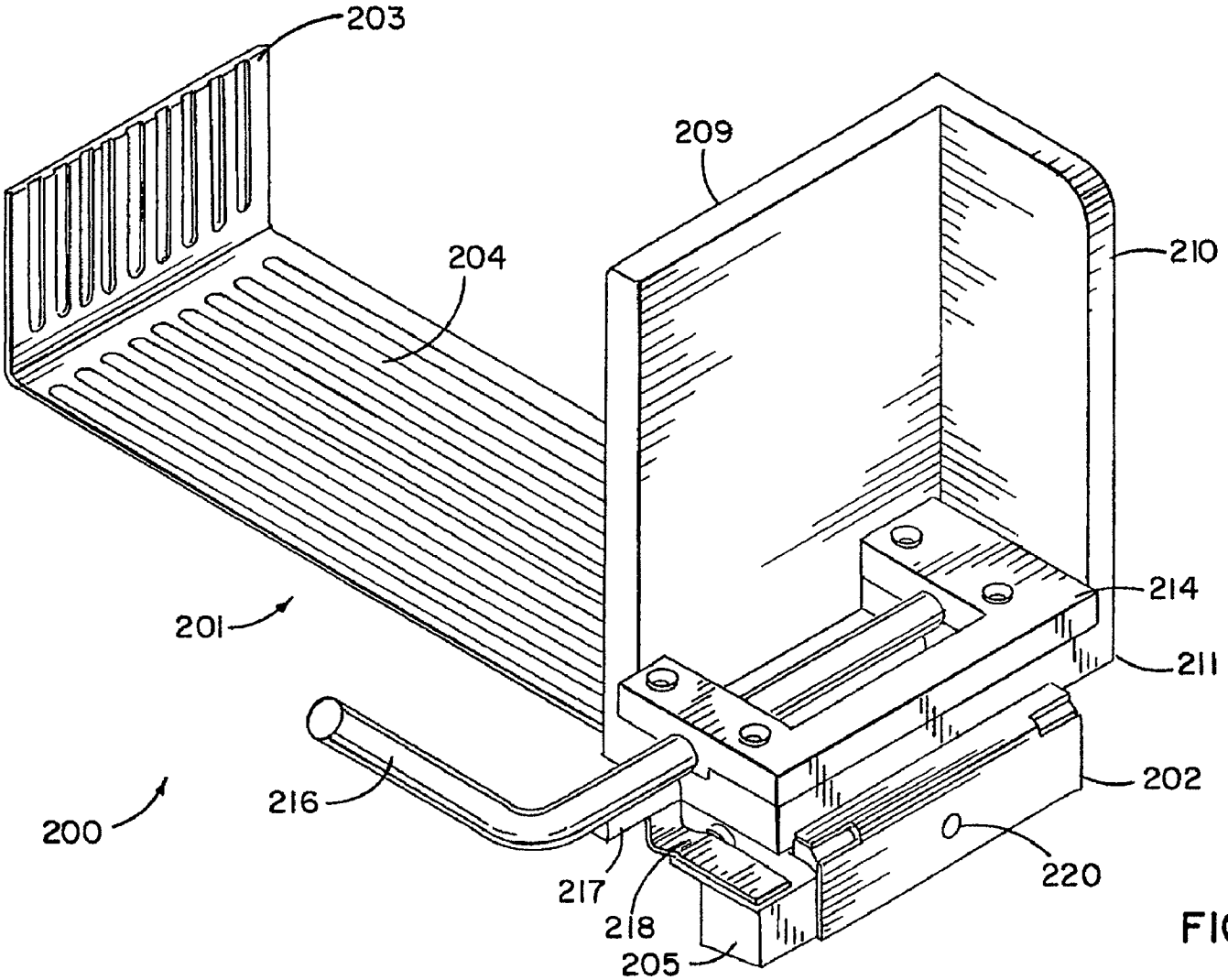

Pusher assembly 200 (FIGS. 17-19) includes a sled 201 having a first end 202, a second end 203 and a base 204. Note that end 203 is turned upward and disposed at a generally 90° angle to base 204 of sled 201. Sled 201 is secured at the opposite end to a translating block 205. Block 205 includes a bore 206 therethrough for receiving a shaft, as described below. A piece of nylon 207 is secured to the underside of base 204 to assist in movement of pusher assembly 200, as described below. A body 208 including a first plate 209 and a second plate 210 disposed at a right angle thereto is positioned on sled 201 and is movable with respect thereto. A base 211 is connected to body 208 as shown. A pair of flanges 212 extend beneath base 204 of sled 201 and form a slot, thereby allowing body 208 to slide back and forth along base 204. Plates 209 and 210 include, respectively, a first surface 212*a* and a second surface 213. These surfaces may contact the item to be sliced, as described below. A saddle 214 including a bore 215 extending therethrough is secured to base 211 of body 208. Note that the weight of saddle 214 may be selected to assist in the gravity feed of the items to be sliced as described below. Also, a plurality of removable weights may be provided to be stacked on saddle 214 to assist the gravity feed as desired. A handle 216 extends through bore 215 in saddle 214 and may rotate therein. A ridge 217 is formed on the underside of handle 216. Thus, when handle 216 is in the position shown in FIGS. 17-19, ridge 217 engages base 204 of sled 201, thereby preventing movement of body 208. To move body 208 with respect to base 204, handle 216 is rotated such that ridge 217 does not engage base 204. Body 208 may then be slid along base 204 to its desired position before again rotating handle 216 to engage ridge 217 with base 204 thereby locking body 208 in place. A spring 218 is secured to block 205 and is used to lock pusher assembly 200 along its shaft, as described below. Pusher assembly 200 is also provided with an opening 220 through sled 201 and block 205. Opening 220 accommodates fastener 220*a* to secure sled 201 and body 208 to block 205. When desired, as for cleaning, fastener 220*a* may be removed and sled 201, body 208, saddle 214 and handle 216 may be removed from block 205. Body 208, saddle 214 and handle 216 may then be removed from sled 201 by sliding body 208 off end 202.

Figure 20:
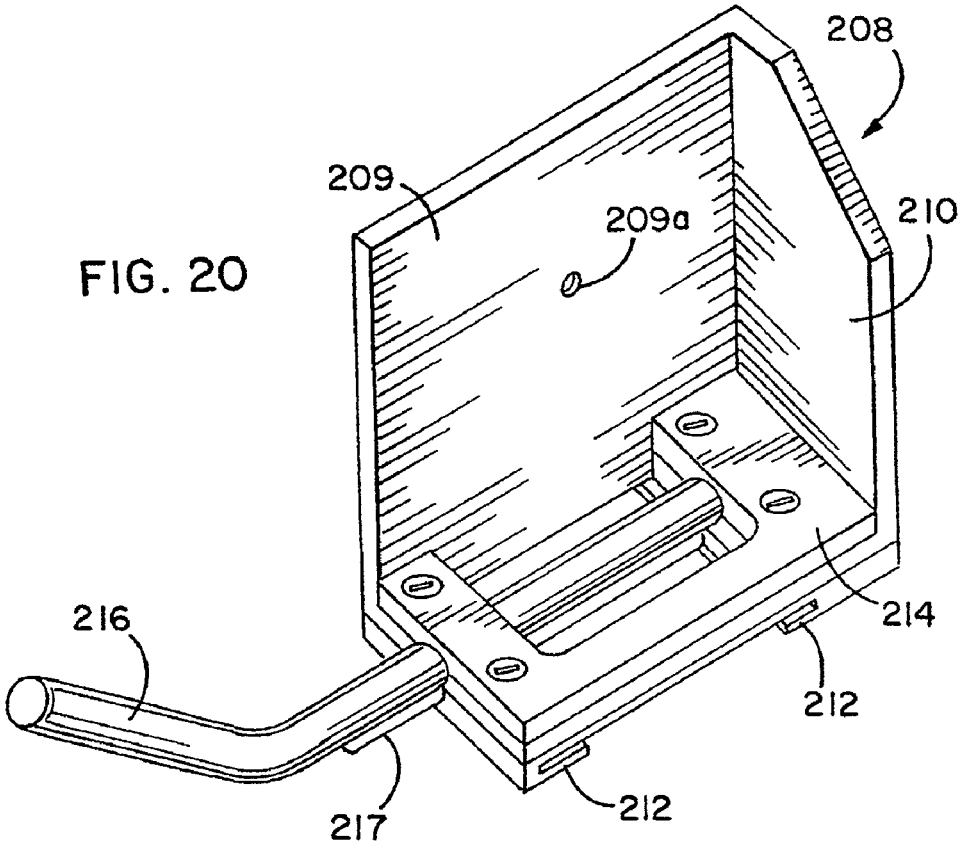
FIGS. 20 and 20*a* show an alternative embodiment of a portion of a pusher assembly according to the present invention.
Figure 20A:
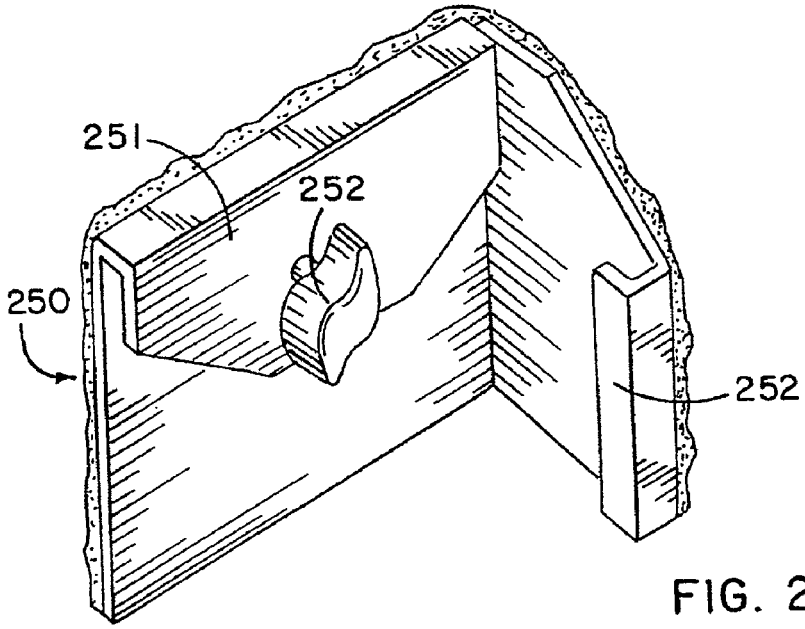
Figure 21:
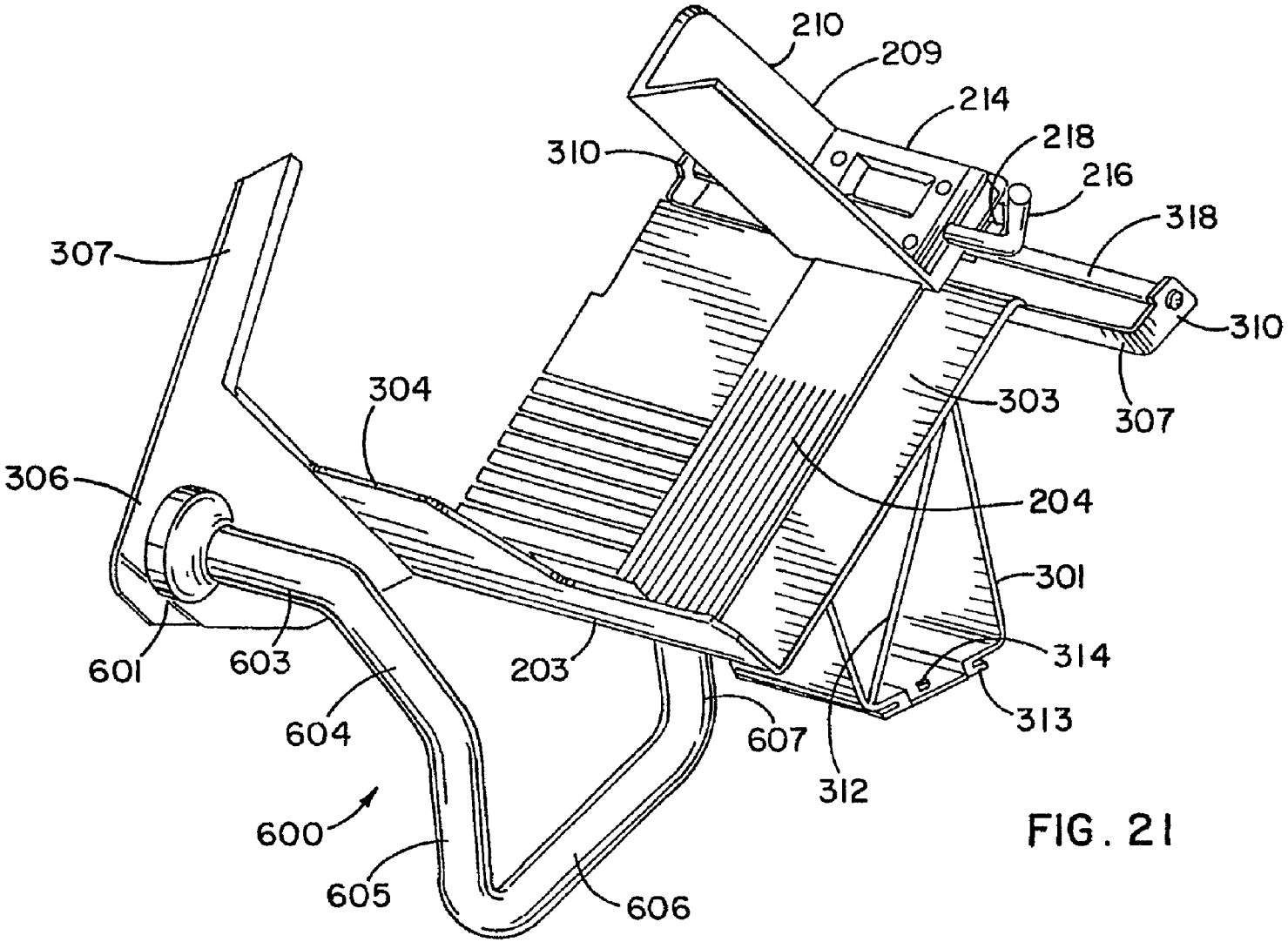
FIG. 21 shows the pusher assembly of FIGS. 17-19 secured to the table of FIGS. 15-16.

An alternative embodiment of body 208 is shown in FIGS. 20 and 20*a*. In this embodiment, plate 209 includes an opening 209*a* therein. A surface attachment 250 including a first flange 251 and a second flange 252 is provided to slip over plates 209 and 210 such that fastener 252*a* may engage opening 209*a*, thereby holding surface attachment 250 in place. In this manner, different surface attachments may be removably provided so that the surface provided on plates 209 and 210 may be changed as desired to accommodate different items to be sliced. Note also that it is not necessary that surface attachment 250 be a unitary piece as shown. It can be divided into one segment for plate 209 and a separate segment for plate 210. Alternatively, it could be divided into multiple segments with multiple fasteners in any combination desired.

Figure 22:
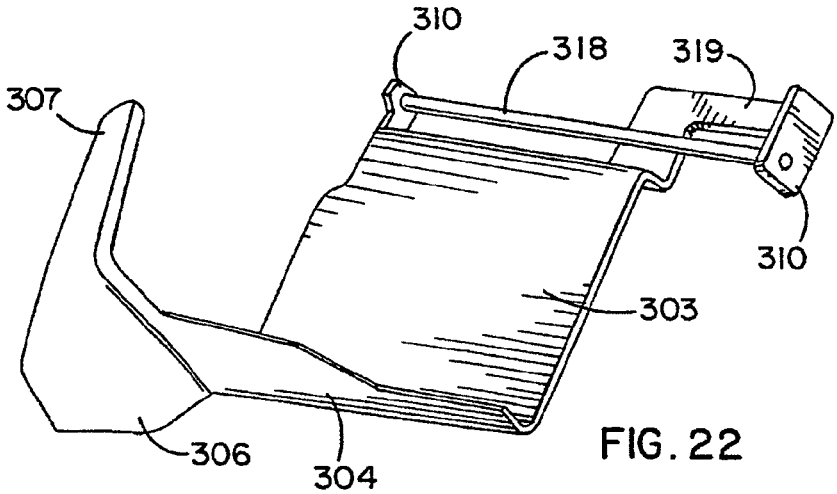
FIG. 22 shows another embodiment of a table according to the present invention.

Pusher assembly 200 may be secured to table 300 by positioning base 204 adjacent surface 303 of table 300 and positioning upturned end 203 adjacent surface 305 of table 300. In this position, bore 206 of translating block 205 is aligned with openings 311 in flanges 310. A shaft 318 is then inserted through openings 311 and bore 206 and secured to flanges 310. Note that in this manner, pusher assembly 200 is free to slide along the length of shaft 318. In another embodiment of the invention (FIG. 22), an optional stop member 319 may be provided to limit the backward rotation of sled 201.

Figures 31, 32, 33, 39:
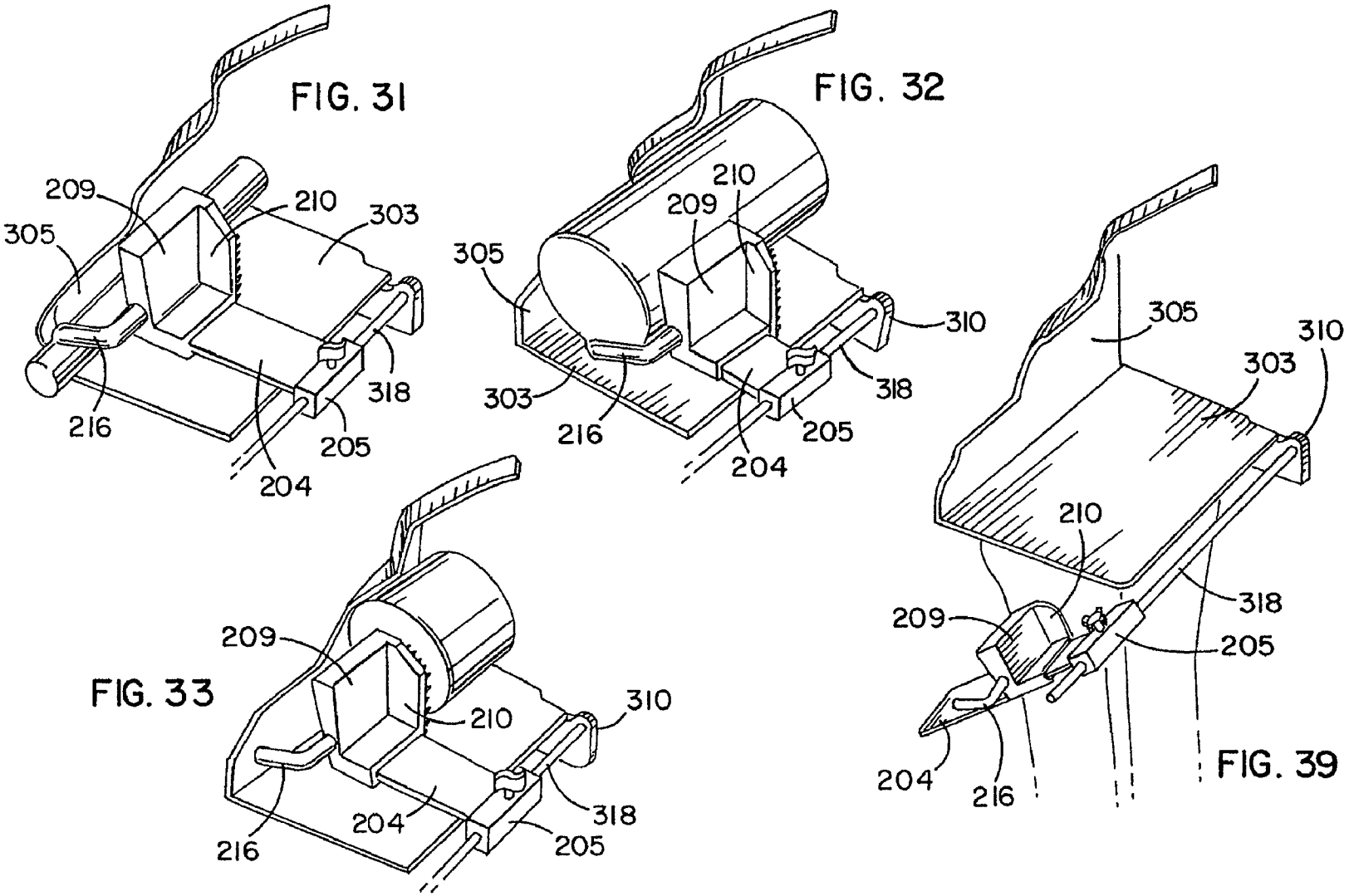
FIGS. 31-33 show various methods of loading product to be sliced into a slicing machine according to embodiments of the present invention.
FIG. 39 shows a pusher assembly according to one embodiment of the present invention pivoted away from a table according to one embodiment of the present invention.

Note that as secured to block 205, spring 218 is adjacent shaft 318. When body 208 is adjacent end 202 of sled 201 and arm 216 is rotated such that ridge 217 engages base 204 of sled 201, thereby locking body 208 in position with respect to sled 201, ridge 217 also engages spring 218 and presses it against shaft 318. This prevents pusher assembly 200 from moving with respect to shaft 318. Thus, pusher assembly 200 can be firmly locked in place in this manner. Also, pusher assembly 200 may be locked in place at any location along shaft 318. Note that the position of pusher handle 216 allows for a lower elbow position resulting in a more relaxed wrist and shoulder than in devices in which the handle is positioned higher. Note also that pusher assembly 200 is continuously adjustable along the entire surface of table 300. FIG. 39 shows pusher assembly 200 attached to shaft 318 but pivoted away from table 300 for access to table 300.

Handle 600 includes a first end 601 secured to table 300 via openings 315 and a second end 602 secured to the underside of table 300 via studs 317. Handle 600 further includes a first segment 603, a second segment 604 disposed at an angle thereto, a third segment 605 disposed at an angle to second segment 604, a fourth segment 606 disposed at an angle to segment 605, and a fifth segment 607 disposed at an angle to segment 606. Handle 600 may be used to manually move arm 400, table 300 and pusher assembly 200 along the length of the unit to manually slice items as described below.

Figure 23:
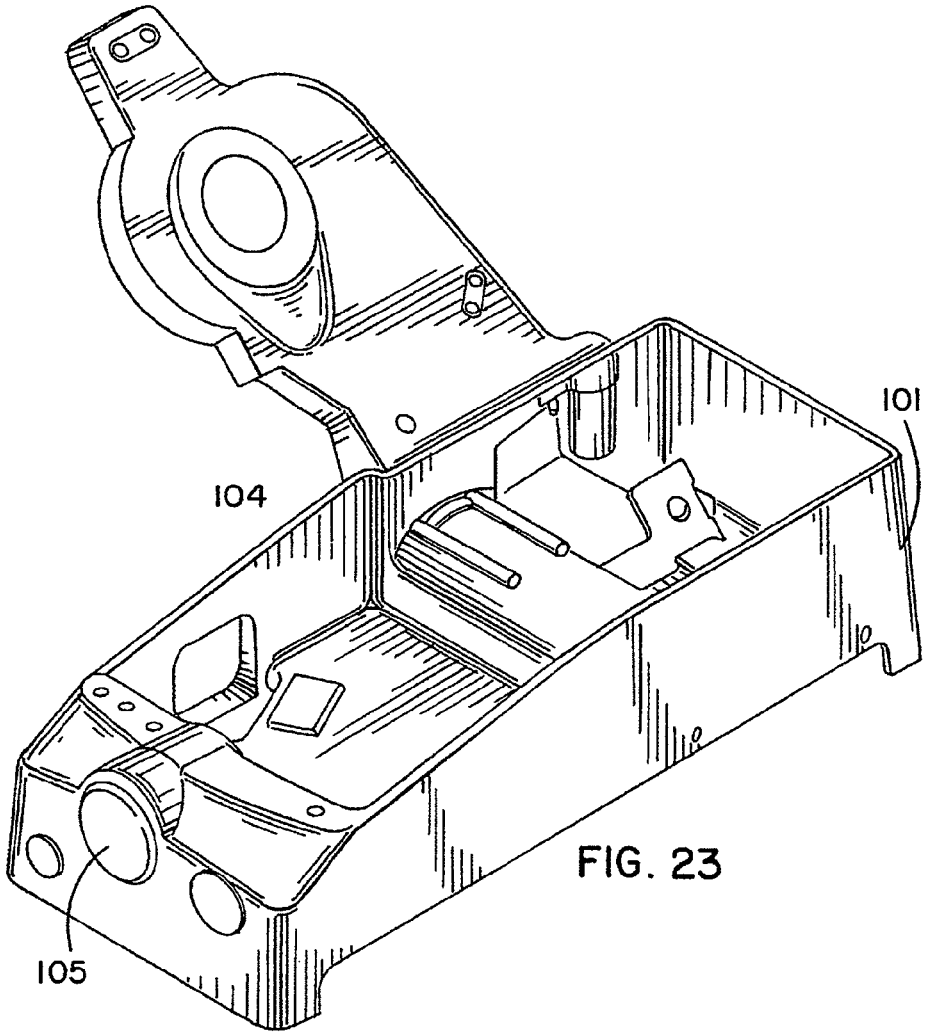
FIG. 23 shows a base according to one embodiment of the present invention.
Figure 24:
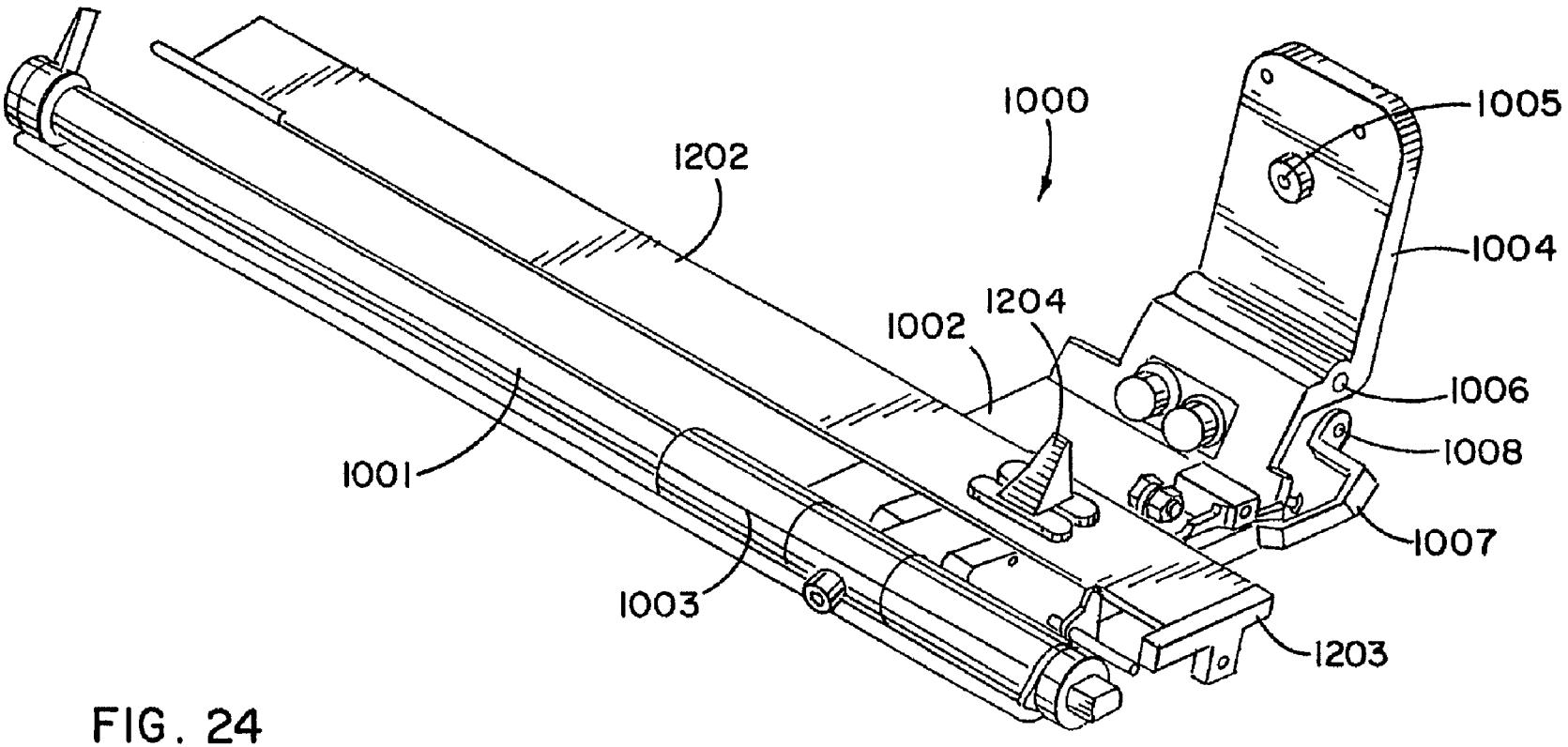
FIGS. 24-25 show a carriage assembly according to one embodiment of the present invention.
Figure 25:
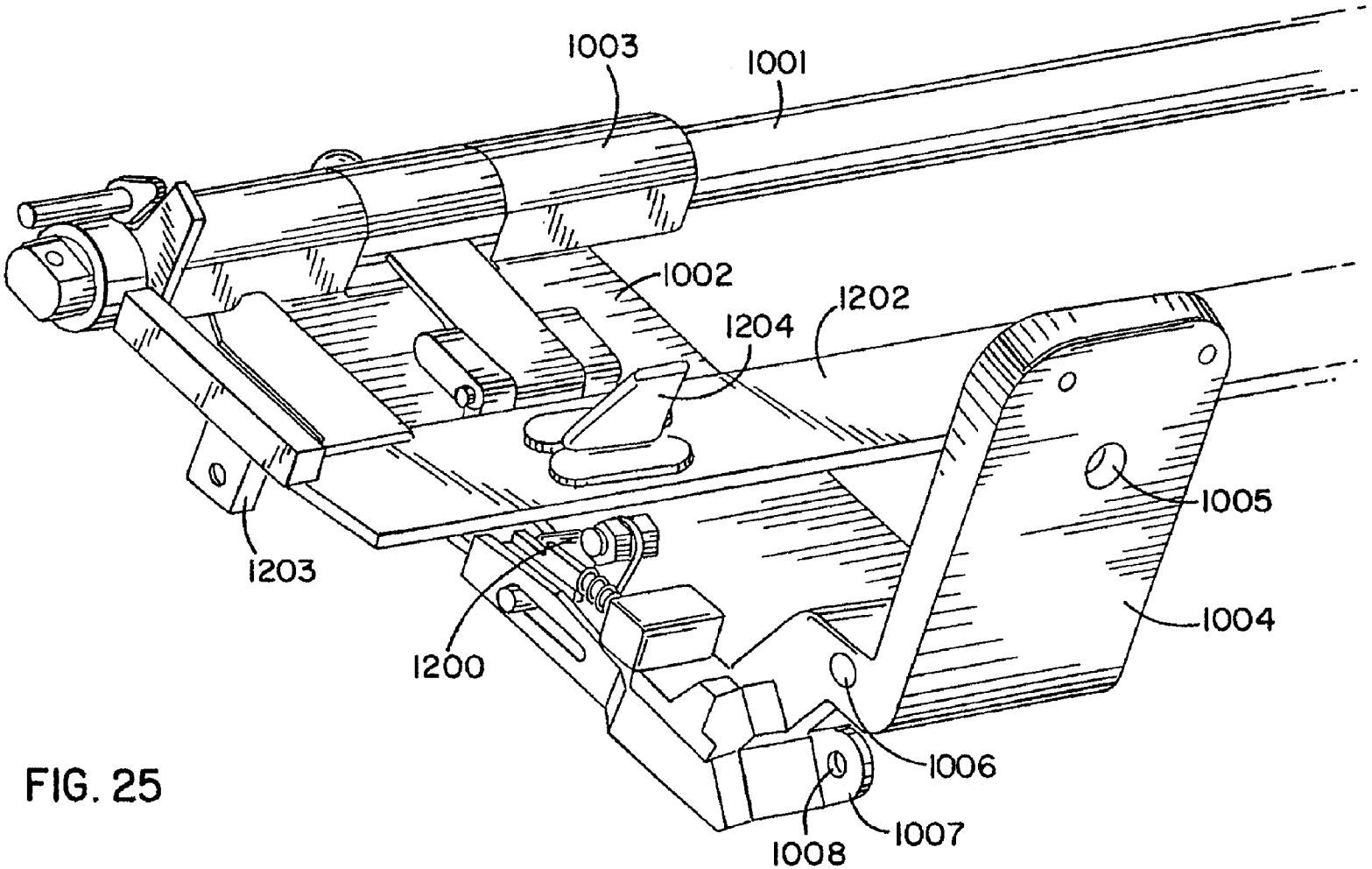
Figure 26:
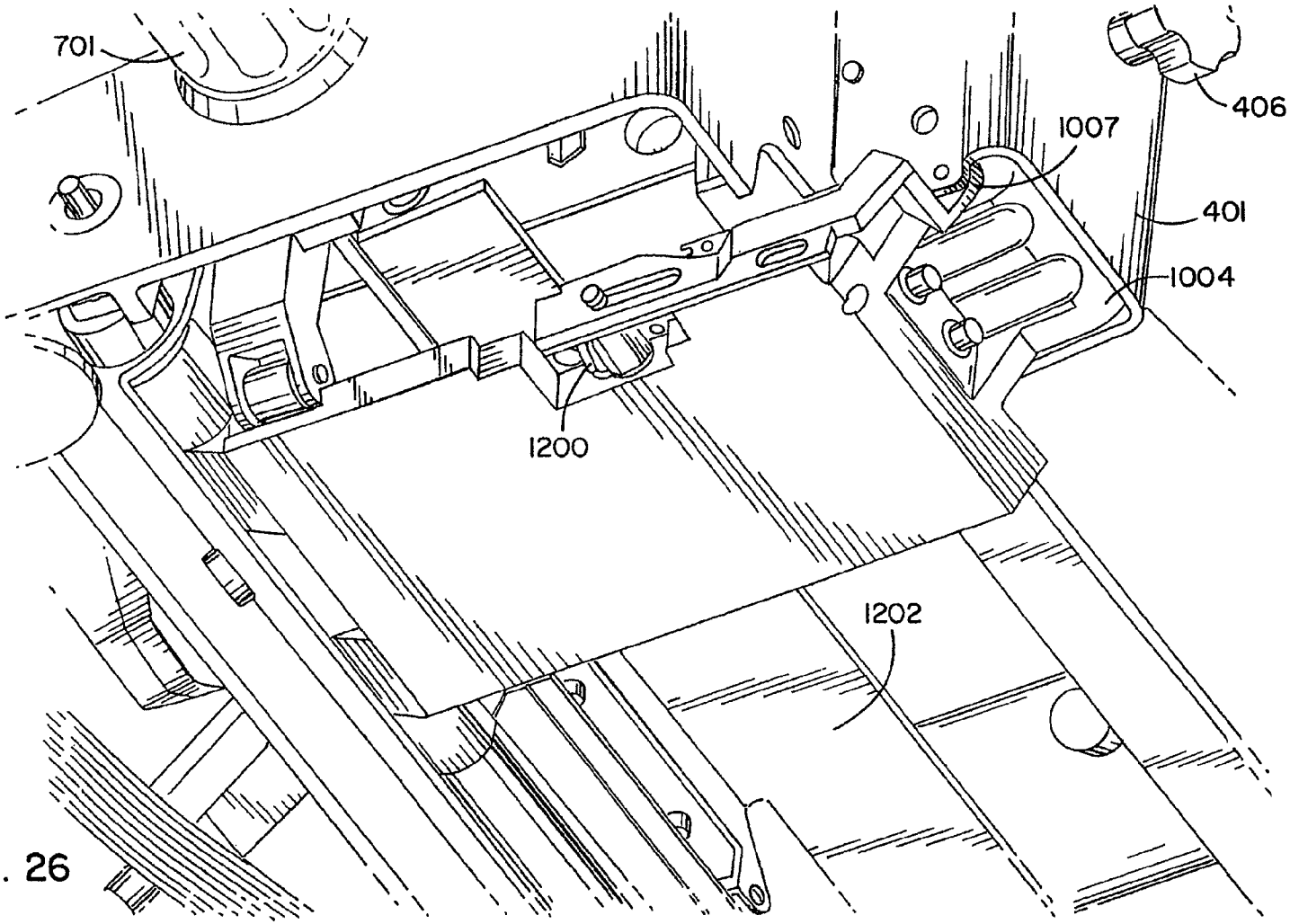
FIG. 26 shows an arm according to one embodiment of the present invention secured to a carriage assembly according to one embodiment of the present invention.

Base 101 (FIG. 23) further includes an interior cavity 104 for receiving the motor 1400. Carriage assembly 1000 (FIGS. 24 and 25) in the embodiment shown, generally includes a shaft 1001 which is received in opening 105 in base 101. A carriage body 1002 includes a cylindrical portion 1003 through which shaft 1001 extends. An arm 1004 extends from body 1002 as shown. Arm 1004 includes an opening 1005 for receiving shaft 407 when arm 1004 is positioned within cavity 403 as shown in FIG. 26. Arm 400 includes openings 404 for securing arm 400 to arm 1004 through openings 1006. Carriage assembly 1000 further includes an arm 1007 including an opening 1008 to which arm 400 is connected through opening 415 in ear 416. Thus, in this manner, arm 400, table 300 and pusher assembly 200 which are attached thereto may move along the length of the unit as carriage assembly 1000 slides along shaft 1001.

Figure 27:
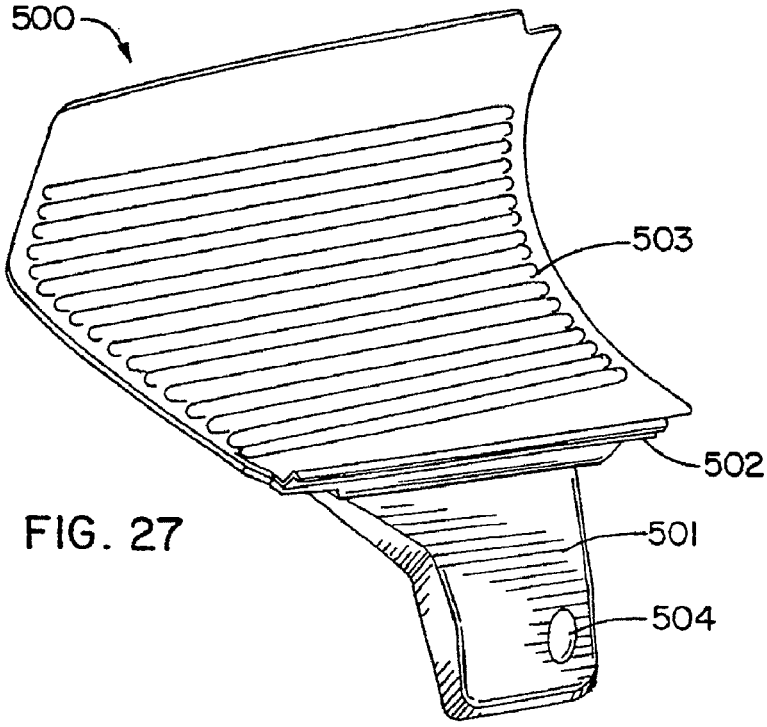
FIGS. 27-28 show a gauge plate according to one embodiment of the present invention.
Figure 28:
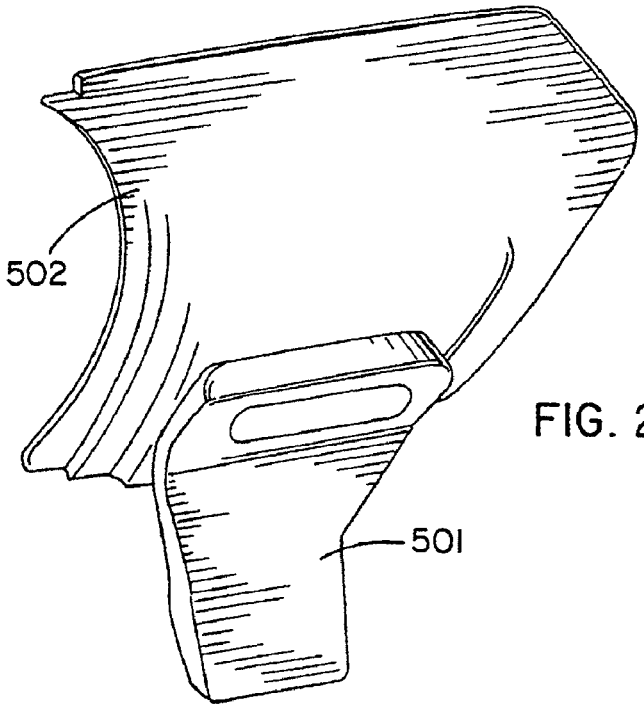

Gauge plate 500 (FIGS. 27 and 28) includes an arm 501 with a plate 502 mounted thereto. Plate 502 includes a surface 503 which engages the material to be sliced, as discussed below. A blind bore 504 is formed in arm 501 and is used for adjusting the position of surface 503 as described below. Plate 502 is positioned adjacent blade 800 as shown. During the slicing operation, the item to be sliced will be urged against surface 503 by gravity. Thus, the farther surface 503 is positioned behind blade 800, the thicker the slices of material. Conversely, the closer to flush with blade 800 surface 503 is positioned, the thinner the slices will be. Thus, by adjusting the position of surface 503, the thickness of the slices obtained can be selected as desired.

Figure 29:
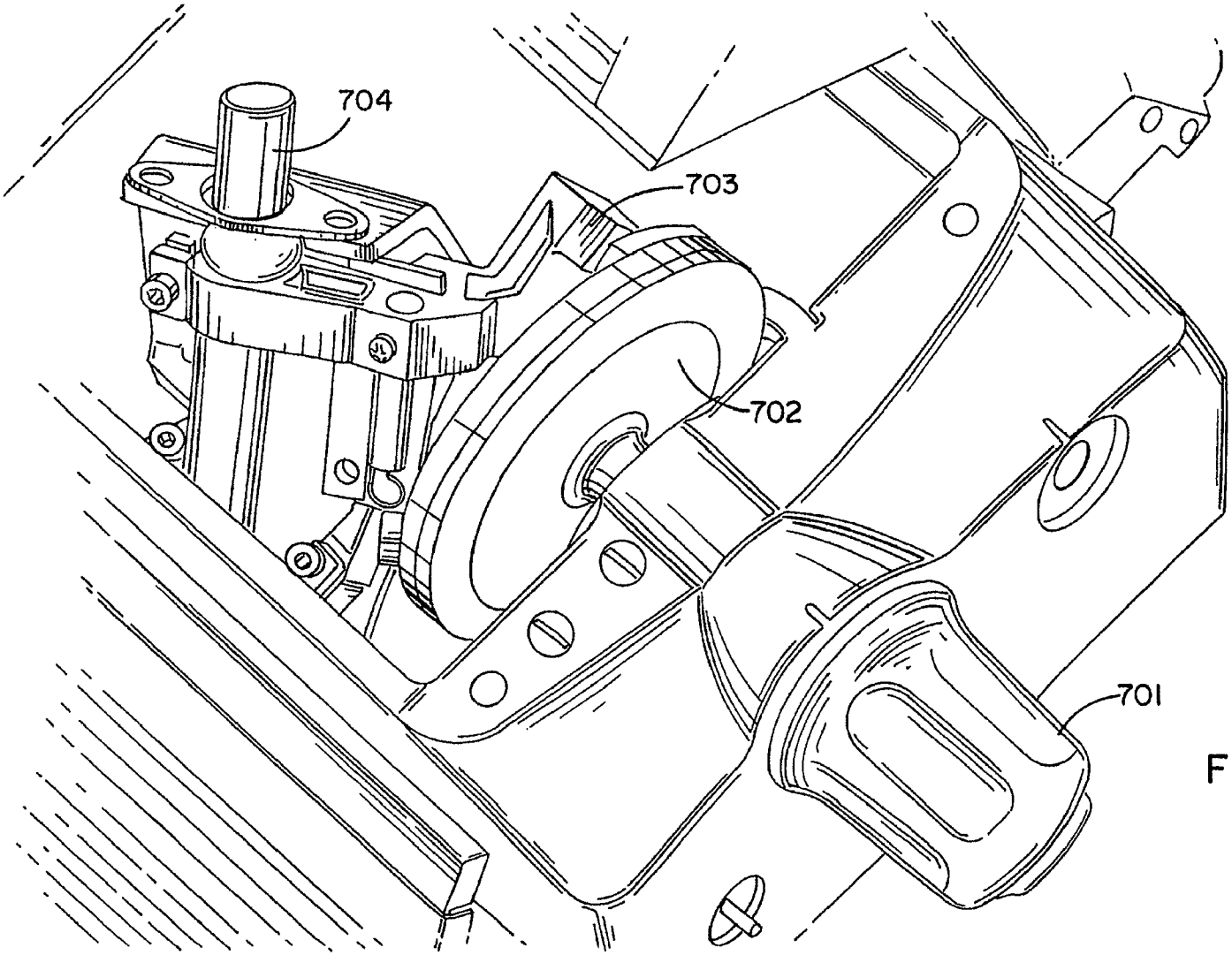
FIGS. 29-30 illustrate an indexing assembly according to one embodiment of the present invention.
Figure 30:
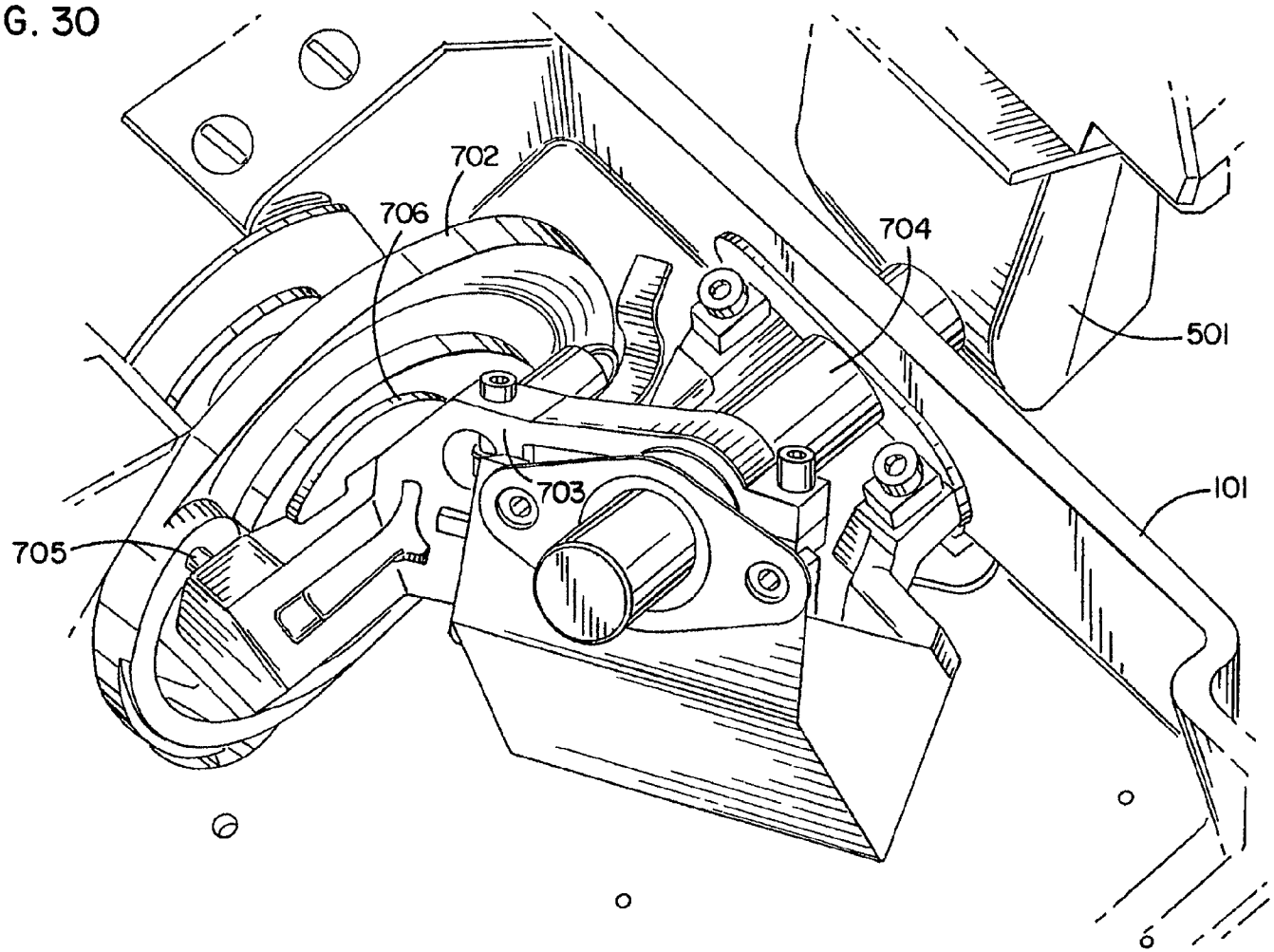

The position of surface 503 is adjusted through indexing assembly 700 FIGS. 29 and 30). Indexing assembly 700, in the embodiment shown, includes a knob 701 connected to a cam 702 which is located within the base of the unit. An arm member 703 is likewise located within the base and includes a pin 705 that engages groove or slot 706 within cam 702. The other end of arm 703 is secured to a shaft 704. Shaft 704 extends into and is secured within opening 504 in arm 501. Note that shaft 704 extends through base 101 in such a manner that it is free to slide in and out of cavity 104. As knob 701 is rotated, cam 702 turns. This movement of cam 702 causes pin 705 to move within slot 706. As pin 705 moves, it likewise causes movement of arm 703. This in turn causes movement of shaft 704. The movement of shaft 704 likewise causes movement of arm 501, thereby positioning surface 503 with respect to blade 800. Note that with the index assembly 700 of the embodiment shown, the thickness of the slices may be varied from 0 to 32 mm with one full rotation of knob 701.

In operation, the unit is fully assembled as shown in FIG. 1, for example. The desired thickness is set by adjusting gauge plate 500 through use of indexing assembly 700. That is, knob 701 is rotated so as to position surface 503 of gauge plate 500 as desired. The item to be sliced is then placed in pusher assembly 200. This may be done in at least two different ways. First, the item may be placed on base 204 of sled 201 and surface 303 of table 300 so as to be positioned between surface 212*a* of body 208 and surface 305 of table 300. When positioned, arm 216 is rotated to lock body 208 in place. This method is shown in FIGS. 31 and 32. Note that body 208 can be positioned to accommodate either large or small objects. Because of the angle at which both table 300, sled 201 and body 208 are positioned, gravity tends to urge the end of the product to be cut against surface 503.

Figure 43:
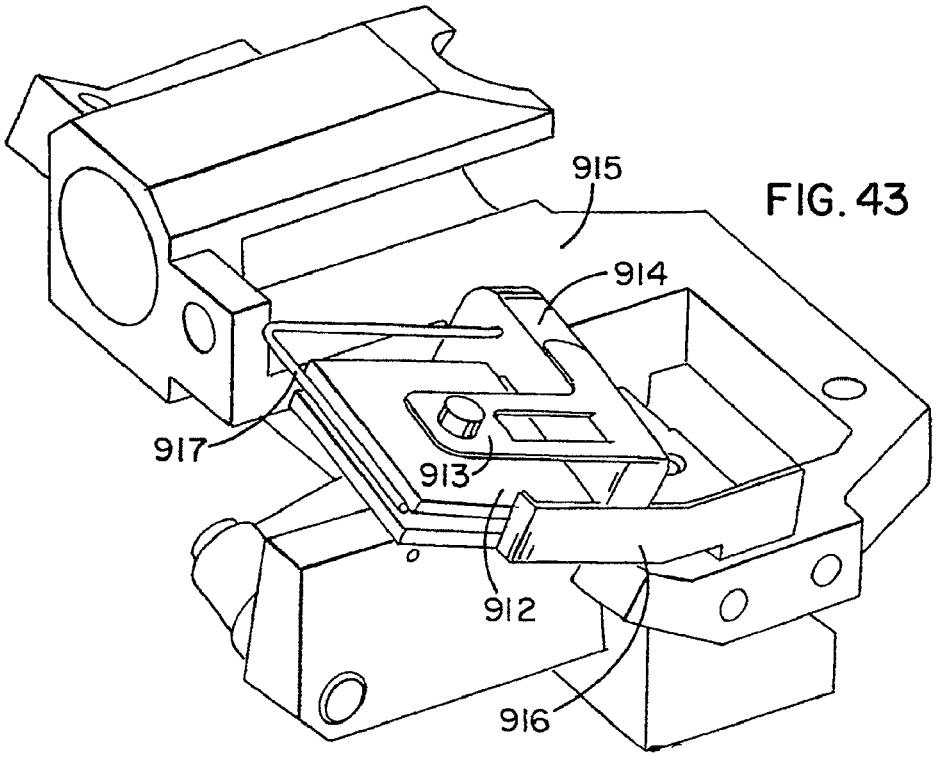

If the slicer is to be operated in the automatic mode, the motor 1400 is started, thereby causing blade 800 to rotate and arm 400 to moved back and forth along the length of the slicer via carriage assembly 1000. This forces the edge of the product against rotating blade 800, thereby slicing the product. Note that because the front of the unit is completely open beneath the output of blade 800, a larger stack of sliced product can accumulate before removal, as compared to units in which the base extends out underneath the output of blade 800. As shown in FIG. 43, blade 800 is connected to pulley 1401 which is in turn connected by drive belt 1402 to motor 1400 located directly below the slicing blade within housing 100. This arrangement of the motor below the blade allows the frame 2100 to be substantially free of the food slice receiving area located on the left side of the slicer directly below the blade 800. Prior slicing machine designs typically placed the motor and other inner working of the machine to the left of the slicing blade in a housing which extended into the food receiving area thereby limited the maximum stack height attainable in such designs.

The unit may also be operated in the manual mode. To do so, the blade is started but the carriage assembly 1000, arm 400, table 300 and pusher assembly 200 are pushed and pulled along the length of the unit via handle 600. Note that the design of handle 600 is such that it may be conveniently used with either the left or right hand or both hands. For example, segment 603 is positioned to be easily accessible and primarily used with the left hand. Segment 605 is positioned primarily for use with the right hand. Segment 604 may be used with either hand. Thus, the device may be easily manually operated by (1) using the left hand on segment 603 and/or the right hand on segment 605, (2) using the left hand on segment 603 and the right on segment 604, (3) using the left hand on segment 604 and the right hand on segment 605, or (5) using either hand on segment 604.

FIG. 33 shows an alternative method of loading the product to be cut. In this method, one end of the product is positioned against surface 213 of body 208. Again, the angle of pusher assembly 200 and table 300 gravity feeds the product against surface 503 for slicing.

Figure 35:
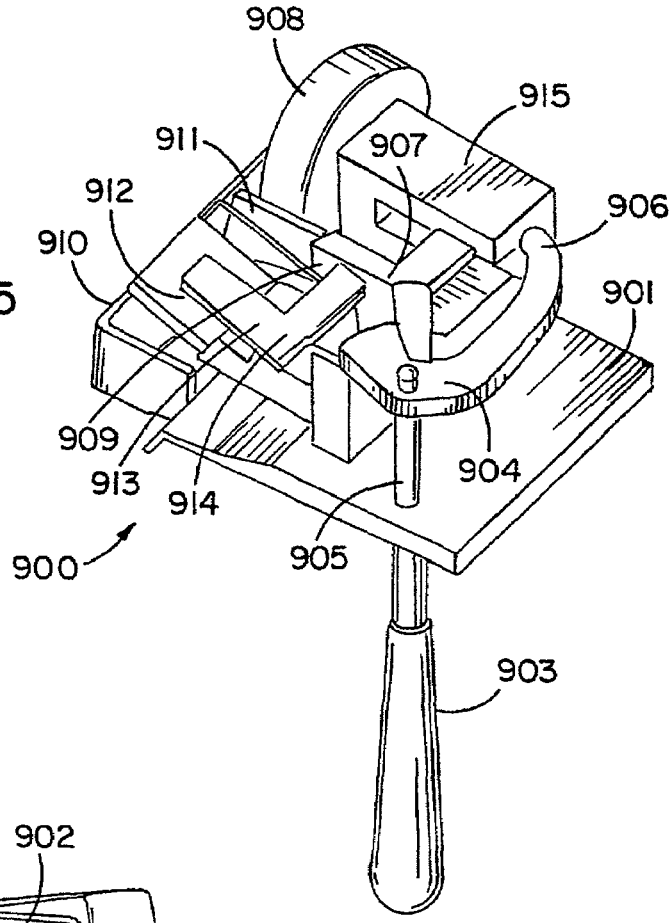
FIGS. 34-35 illustrate a sharpener assembly according to one embodiment of the present invention.
Figure 34:
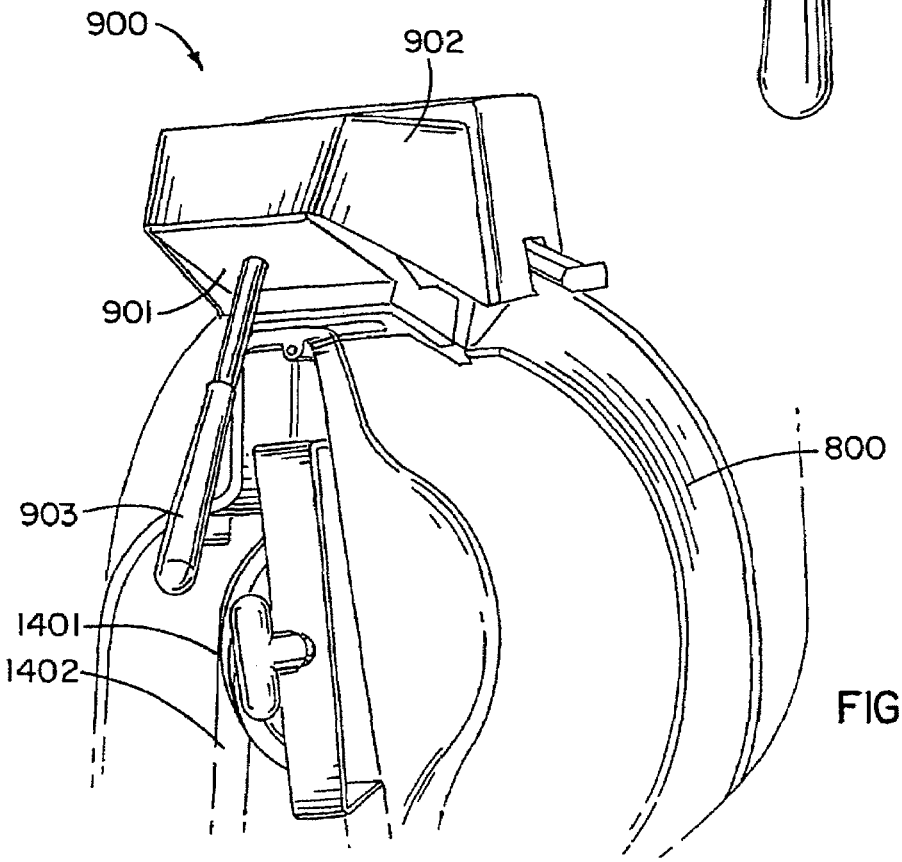

The sharpener assembly 900 is mounted on a base 901 adjacent blade 800 and is enclosed by a cover 902. An actuator lever 903 extends behind the unit and through base 901. As shown in FIG. 35, an actuator arm 904 is pivotally mounted to a post 905 connected to base 901. An end 906 of the actuator arm 904 contacts an arm assembly 907 connected to a sharpening stone 908. Arm 907 includes an extended portion or arm 909. A shield 910 is positioned in front of sharpening stone 908. An arm 911 is secured to shield 910 and is adjacent or in contact with arm 909. To actuate the sharpener, the blade is set in motion and lever 903 is pulled back, thereby bearing against arm 904 and causing it to rotate about post 905. This causes end 906 to rotate inwardly and press against arm 907. As this occurs, arm 909 contacts arm 911 of shield 910 and acts as a cam to push shield 910 down below sharpening stone 908, thereby pushing shield 910 out of the way. Arm 906 also pushes arm 907 so as to move sharpening stone 908 against blade 800, thereby sharpening the blade as it rotates.

Figure 41:
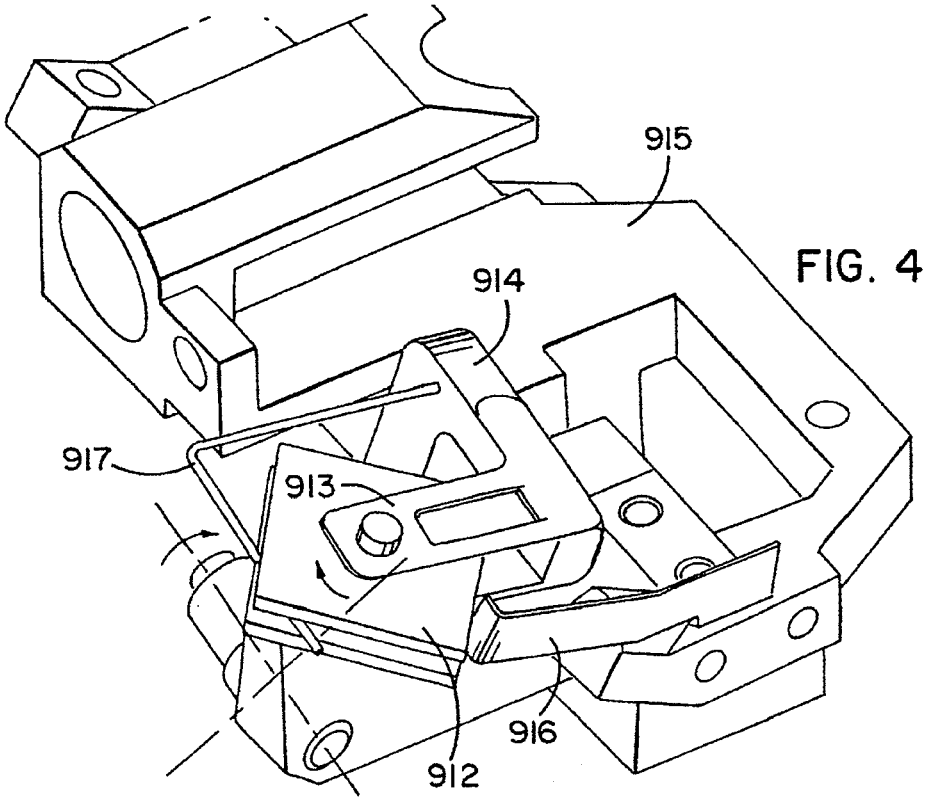
Figure 42:
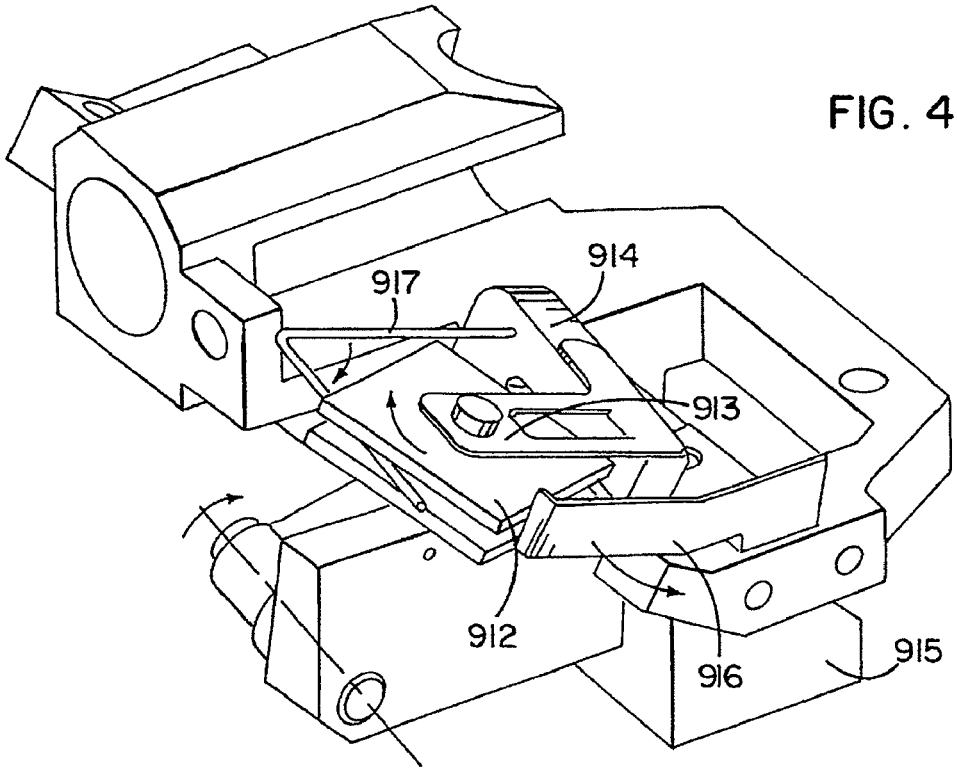

As an additional feature, sharpening assembly 900 may include a deburring pad 912. Deburring pad 912 is connected to leaf spring 913 which is in turn connected to an arm 914 pivotally mounted on housing 915. The operation of deburring pad 912 is best shown in FIGS. 40-43 in which sharpening stone 908, shield 910, arm 907, and arm 909 are removed from housing 915. When lever 903 is activated, arm 907 pushes arm 914 forward into the position shown in FIG. 40. This places deburring pad 912 in its operational position. When lever 903 is released such that arm 906 moves into its original position, arm 914 begins to rotate backward. As this occurs, deburring pad 912 contacts leaf spring 916. This causes deburring pad 912 to rotate as shown in FIG. 41. Note that a wire form 917 is provided to index the deburring pad during operation and to act as a pivot for the pad upon retraction. As arm 914 continues to retract, deburring pad 912 continues to rotate until it snaps into a rest position rotated 90° from its original position. Upon each successive actuation of the sharpening assembly, deburring pad 912 will rotate 90° upon retraction. Note that leaf spring 913 helps keep deburring pad 912 biased in the proper position during operation. The same is true with respect to wire form 917.

In operation, when table 300 is removed from table arm 400, plate 413 extends outwardly under the biasing force of spring 413*a* and covers slot 415. This pulls on cable 1100 which causes stop 1200 to pivot upwardly. As stop 1200 pivots upwardly, it pivots platform 1202 and projection 1204 upwardly such that projection 1204 engages notch 702*a*. In this position, gauge plate 500 is set for 0 thickness so that the blade is not exposed to inadvertent contact by the user. Also, in this position, cam 702 cannot be rotated to adjust gauge plate 500 because of the interaction of projection 1204 and notch 702*a*.

When table 300 is again positioned on arm 400, post 417 slides into slot 415, thereby pushing plate 413 inwardly. Note that post 417 and its associated knob 417*a* are shown in FIGS. 1, 2 and 4-7, although they are not shown on FIGS. 15 and 16. As plate 413 slides inwardly, it pushes cable 1100 forward and pivots stop 1200 downwardly, thereby permitting platform 1202 and locking projection 1204 to pivot downwardly, thereby disengaging locking projection 1204 from notch 702*a*.

Figure 44:
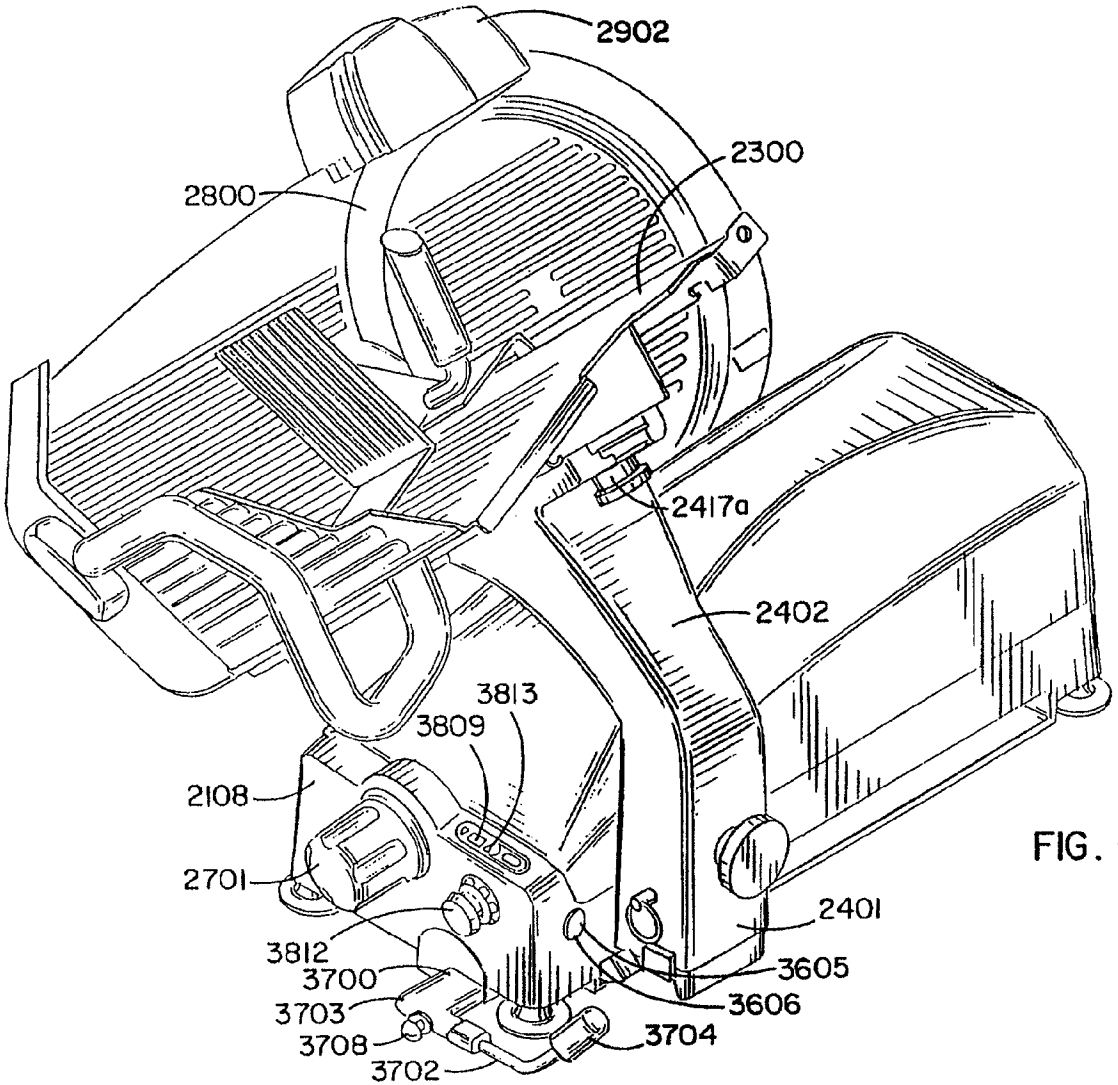
FIG. 44 is a perspective view of a slicing machine and its various components according to one embodiment of the invention.
Figure 45:
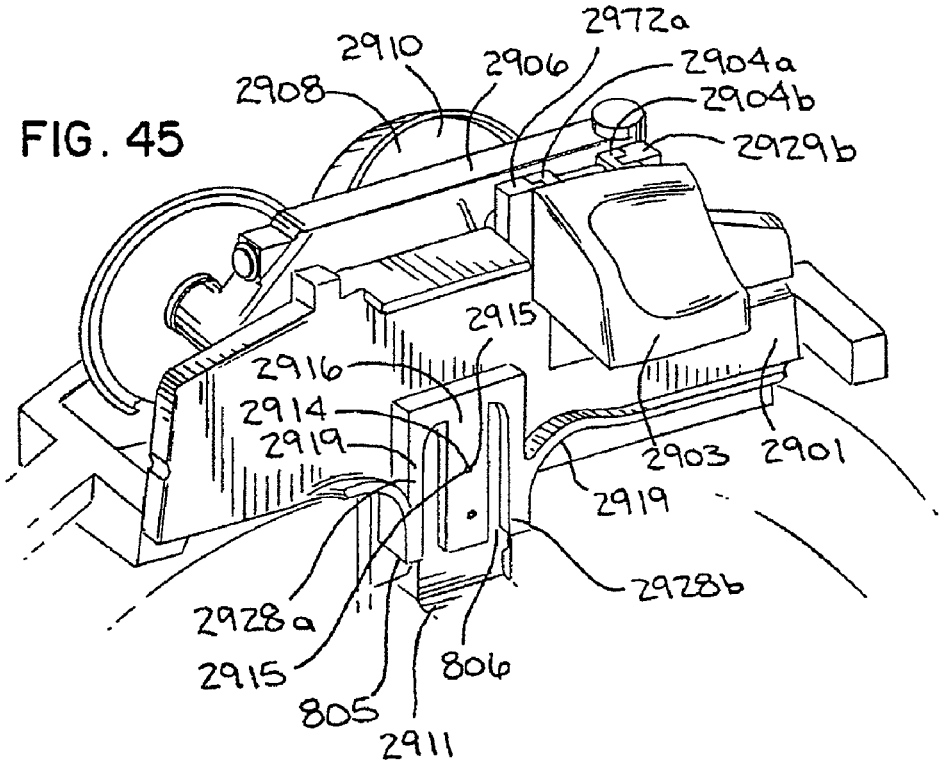
FIG. 45 illustrates a perspective view of a sharpening stone assembly according to one embodiment of the invention.
Figure 46:
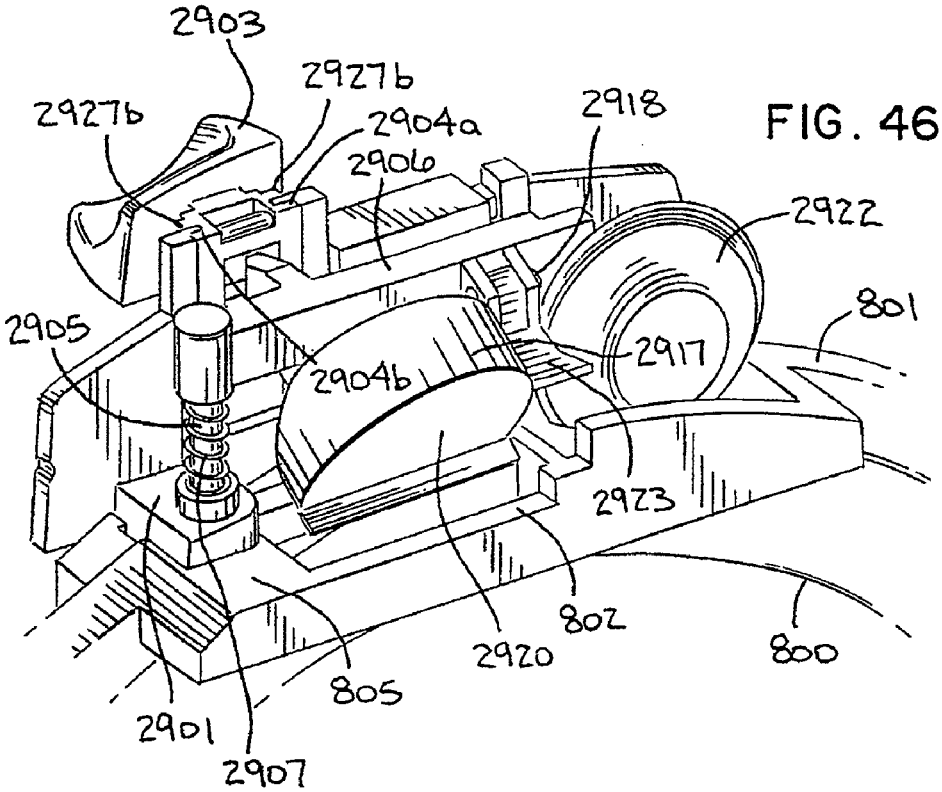
FIG. 46 illustrates a perspective view of a sharpening stone assembly of FIG. 45.

An alternate embodiment of the invention is shown in FIGS. 44 through 49, in which an alternate sharpener assembly 2900 is provided having a cover 2902. The assembly 2900 includes a base portion 2901 which is mounted to mounting surface 805 of blade guard arm 804. As can be seen in FIG. 46, blade guard 801 splits into a pair of arms 803 and 804 near the area where the assembly 2900 is mounted.

The assembly 2900 has an actuator 2903 for depressing the assembly downwardly along guide 2904. As best seen in FIGS. 45 and 46, guide 2904 has L-shaped tongues 2904*a* and 2904*b* for engaging grooves 2927*a* and 2927*b* on base 2901. The actuator 2903 is preferably provided with an indented upper surface 2903*a* which is configured to comfortably receive the operator's thumb when depressing the actuator 2903. Post 2905 extends from base 2901 and mounting surface 805 on blade guard 801 and provides a slidable mount for frame 2906. A spring 2907 is inserted around post 2905 and engages base 2901 and frame 2906 to bias the assembly 2900 upwardly away from blade 800. A sharpening stone 2908 is rotatably mounted to the frame 2906 by engagement of spindle 2909 with frame aperture 2906*a*, and a deburring stone 2910 is rotatably mounted to frame 2906 by engagement of spindle 2912 with frame aperture 2906*b*.

A dovetail projection (not shown) is formed on the periphery of blade guard guide 2928 at shoulders 2928*a* and 2928*b* for engaging tongue 806 having complimentary dovetail groove in its peripheral surface (not shown). Tongue 806 extends upwardly from mounting surface 805 of blade guard 801. As can be seen in FIG. 45, the tongue 806 is provided with a indentation 2914 which is engaged by projection 2915 on lip 2916 of blade guard guide 2928 to form a detent for holding the sharpener assembly 2900 in place.

Sharpening assembly has a stone assembly 2938 which generally includes spindle 2918, sharpening stone 2908, deburring stone 2910, shield 2917, pivot mounts 2932, and jaw member 2929. Shield 2917 is pivotally mounted to frame 2906 by engagement of spindle 2918 with frame aperture

2906*c*. As seen in FIG. 46, shield 2917 substantially covers the surface of sharpening stone 2908 and deburring stone 2910 when the assembly is retracted away from the blade 800. As a result, the stones 2908 and 2910 remain nearly completely free of cutting debris throughout extended periods of use of the slicing machine thereby eliminating the need to frequently wash the interior of the sharpening assembly. The shield 2917 is comprised of two lobes 2920 and 2922 joined by stay 2923. Arm 803 includes a shield engaging surface 802. Lobe 2920 of shield 2917 is provided with a flange 2924 which is spaced to engage shield engaging surface 802 of blade guard 801 when actuator 2903 is depressed into a sharpening position. Flange 2924 includes camming surface 2925 which engages shield engaging surface 802 in the depressed position causing shield 2917 to pivot upwardly and expose sharpening stone 2908 and deburring stone 2910 as the assembly 2900 is slid linearly downwardly into blade sharpening position.

Figure 47:
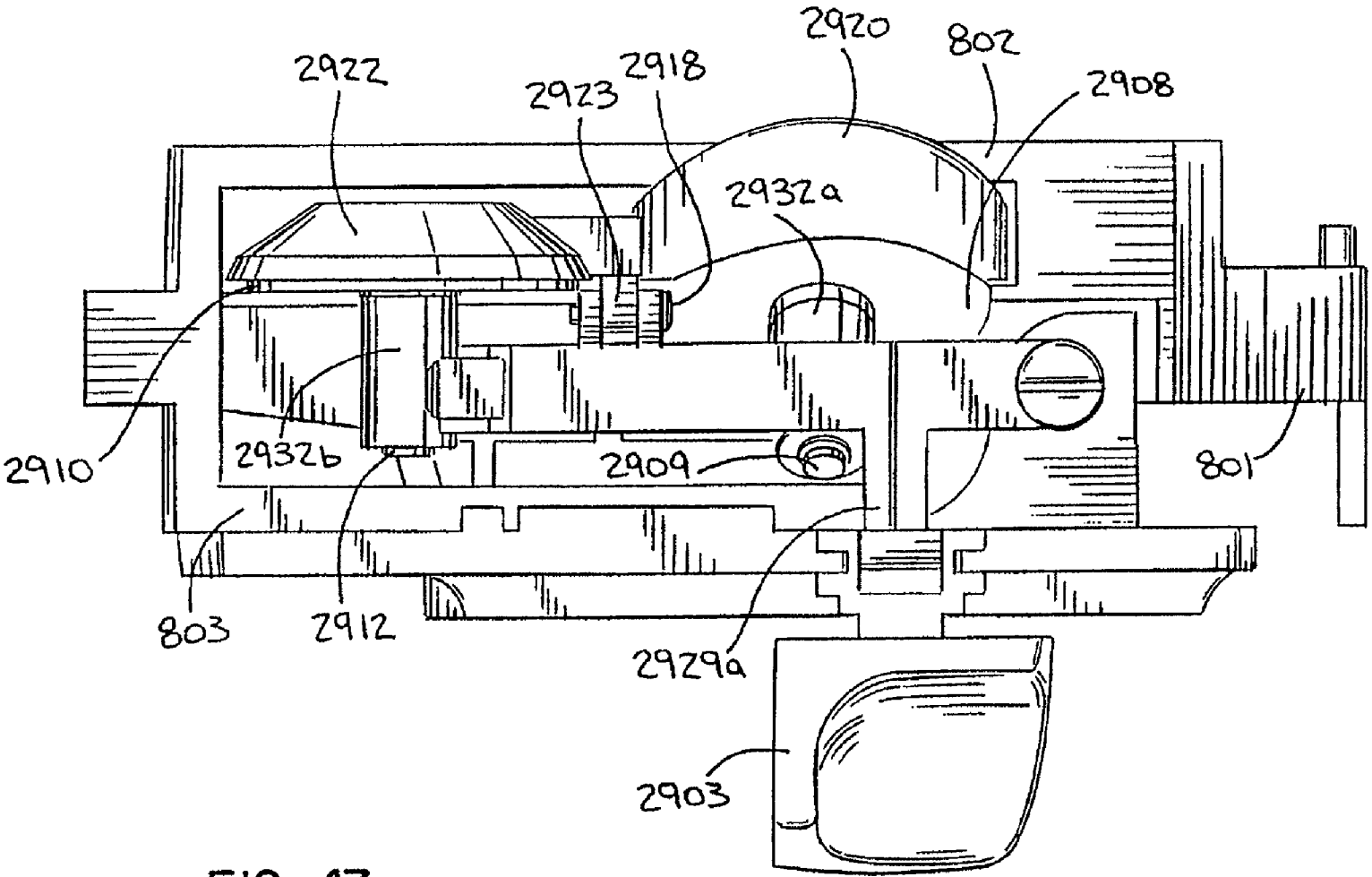
FIG. 47 illustrates a top view of a sharpening stone assembly of FIG. 45.
Figure 48:
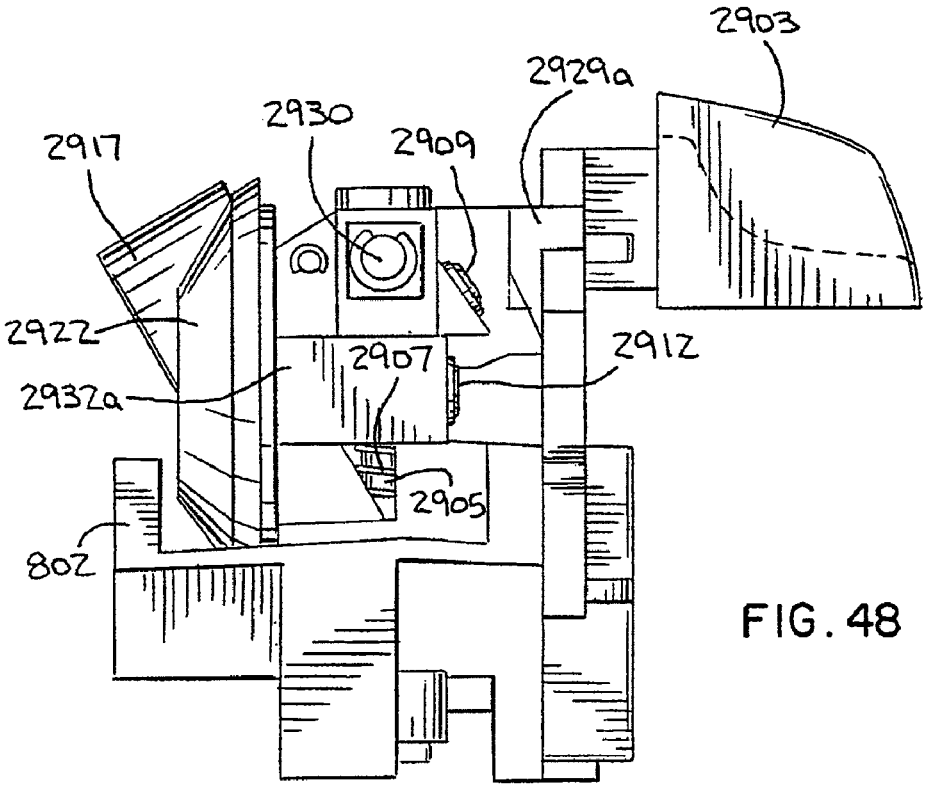
FIG. 48 illustrates a back view of a sharpening stone assembly of FIG. 45.
Figure 49B:
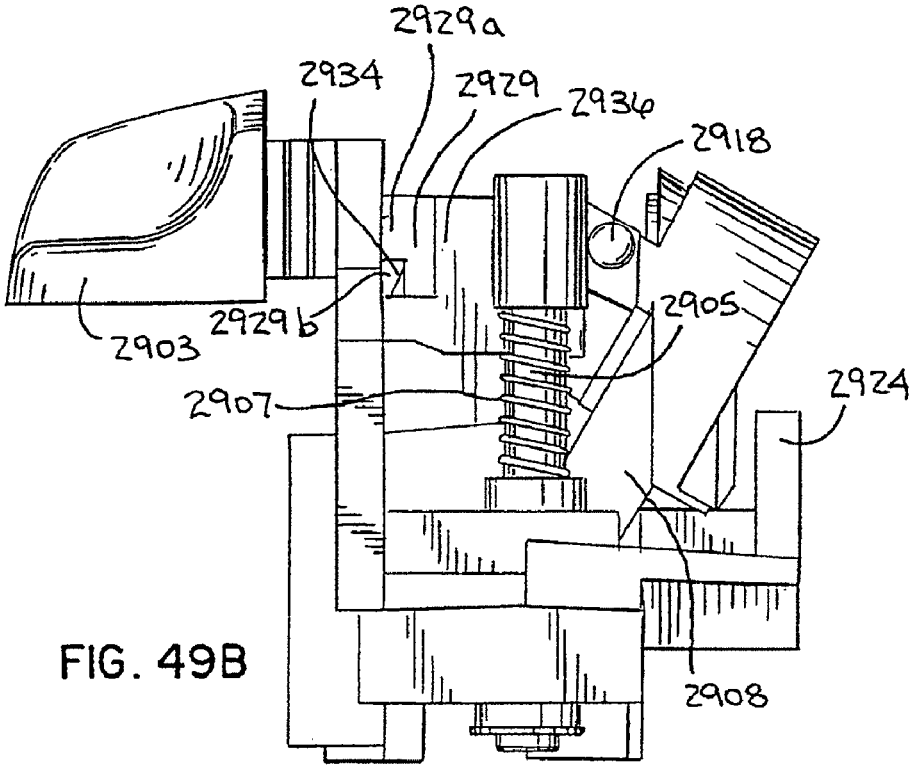
FIG. 49B illustrates a front view of a sharpening stone assembly of FIG. 45.
Figure 49A:
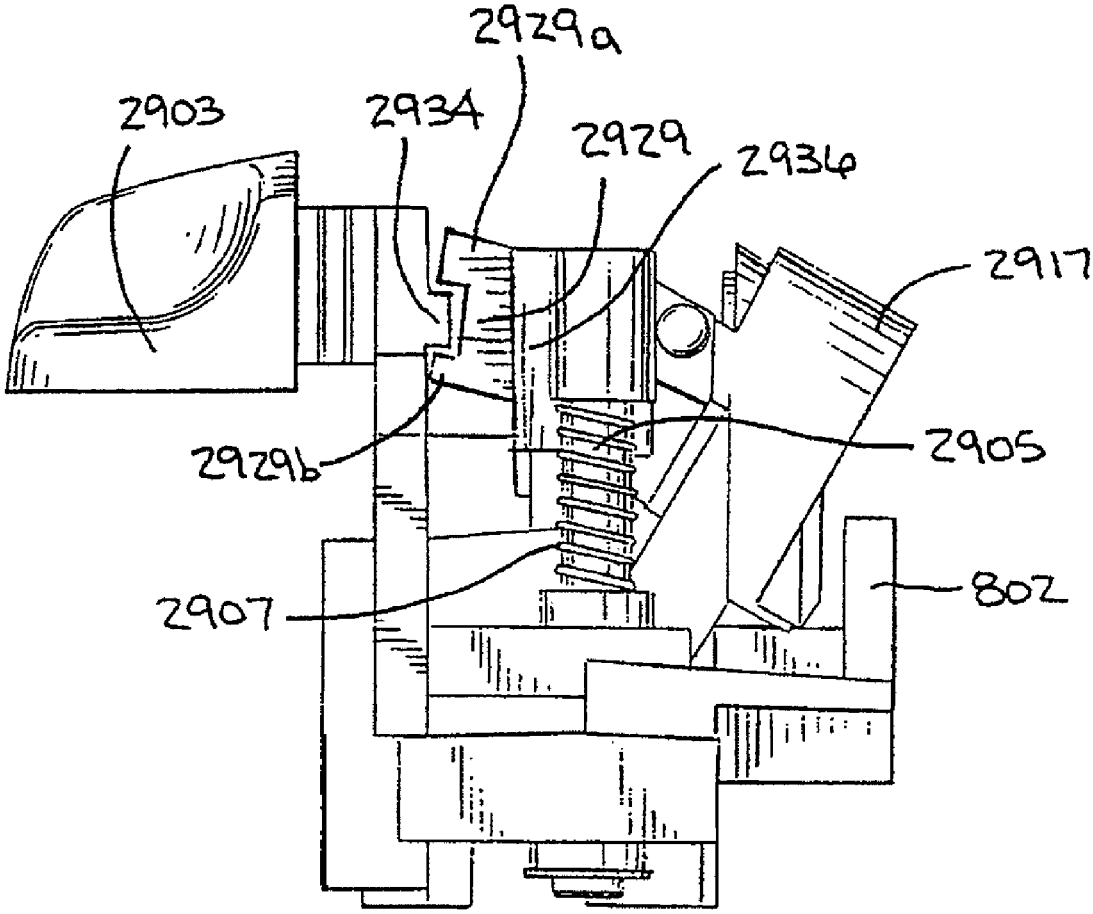
FIG. 49A illustrates a front view of a sharpening stone assembly of FIG. 45.

In addition to the linear travel described above, assembly 2900 has pivoting action in which the sharpening stone pivots from a retracted into its blade sharpening position. As shown in FIGS. 47 and 49, a U-shaped jaw member 2929 includes lower projection 2929*a* and upper projection 2929*b*. Jaw member 2929 is pivotally mounted to 2930 spindle and are pivot mounts 2932*a* and 2932*b* of stones 2908 and 2910. Thus, jaw member 2929 acts as a lever arm to pivot stone assembly 2938. Actuator 2903 is provided with driving plate 2934 which engages jaws 2929*b* when actuator 2903 is depressed as shown in FIG. 49A. The engagement between actuator driver 2934 and jaw member 2929*b* causes U-shaped member 2929 to pivot downwardly and pivot mounts 2932*a* and 2932*b* to pivot upwardly away from post 2905 into proper alignment for sharpening. As shown in FIG. 49B as actuator 2903 is depressed further, drive plate 2934 forces jaw member 2929*b* into contact with plate 2936 which is attached to frame 2906 causing plate 2906 to move linearly downwardly toward blade 800 for sharpening. When actuator 2903 is released, spring 2907 engages frame 2906 causing it to move linearly upwardly and bringing jaw 2929*b* into contact with actuator driver 2934. Spring bias further causing jaw 2929*b* to move along guide 2928 to its fully retracted position. In this position, the bottom of stones 2908 and 2910 are tilted farther away from the blade 800 so that they are almost completely shielded from slicing debris.

To sharpen the blade, the sharpening stone 2908 and deburring stone 2910 are brought into engagement with the edge of the blade 800. After the initial pivot of the stone assembly 2938, the movement of the sharpening assembly 2900 is substantially linear along guide 2904 due to engagement of shoulders 2904*a* and 2904*b* with tongue 806 and post 2905 with an annular portion 2906*a* of frame 2906. The assembly 2900 may be removed from the slicing machine by lifting on the frame 2906 which causes projection 2915 on lip 2916 to disengage from depression 807 on tongue 806. To facilitate removal of the assembly 2900, frame 2906 is provided with a pair of arcuate surfaces 2919 on its lower surface to provide a comfortable grip for the operator to remove the sharpening assembly 2900 for washing. The sharpener assembly may be removed for cleaning portions of the blade guard 801 as well as for sporadic cleaning of the assembly 2900 in a dishwasher or sink.

Removal of the assembly 2900 from the guide mount 805 activities safety switch 2926 which is wired to a microprocessor board 3802. Microprocessor 3802 is wired to table drive motor 3800. When safety switch 2926 is activated by the absence of the assembly 2900, it sends an assembly absent signal to the microprocessor 3802. Microprocessor 3802 is programmed to switch off the blade drive motor 3400 in response to said assembly absent signal. As a result, the blade 2800 will not rotate when the assembly 2900 has been removed from the slicer to enhance operator safety.

In the embodiment of the invention shown in FIGS. 44, 50 and 52-55, an alternate table arm 2400 is provided, which generally includes a hollow arm having a first portion 2401 and a second portion 2402 defining an interior cavity 2403. Portions 2401 and 2402 are disposed at an angle to one another. Arm 2400 includes a pair of bores 2404 which are used to pivotally attach arm 2400 to carriage assembly 3000 located within base 2100 of the slicing machine such that arm 2400, table 2300, pusher assembly 2200 and handle 2600 may travel along the length of the slicing machine. Similar to the embodiment of the table arm 400 shown in FIGS. 13 and 14, a pair of stop pins 2405 (not shown) are located within cavity 2403 to limit movement of arm 2400. A knob 2406 having a post or shaft 2407 (not shown) attached thereto is secured to arm 2400 such that post 2407 extends into cavity 2403. Post 2407 engages an aperture in the carriage assembly 3000 to fasten arm 2400 thereto.

Figure 55:
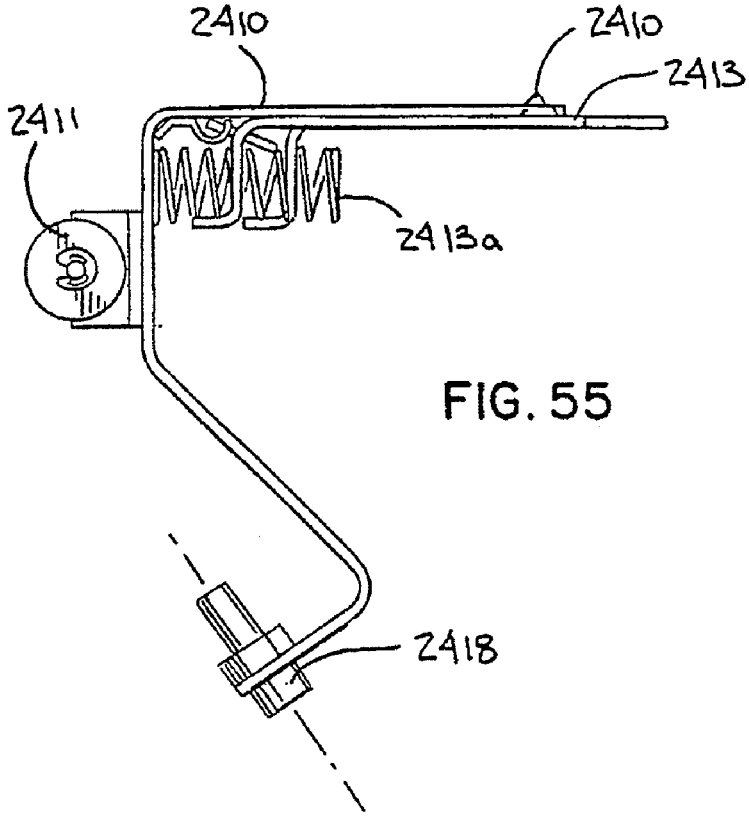
FIG. 55 is a side view of the table lock assembly of FIG. 54.

As can be best seen in FIGS. 44 and 50, arm 2400 further includes an upper face 2408 on which table 2300 and pusher assembly 2200 are mounted as described below. A slot 2409 is provided beneath face 2408 for this purpose. Arm 2400 further includes a plate 2410 to which a pair of pulleys 2411 are mounted within the interior of cavity 2403. A tab 2412 is secured to arm 2400 so as to be biased, as by a spring or other device, into the position shown in FIG. 50 when table 2300 is not secured to arm 2400. As can be seen in FIG. 55, plate 2413 is mounted to arm 2400 beneath plate 2410 as shown. Plate 2413, as described in greater detail below, can move with respect to the remainder of arm 2400. Plate 2410 is provided with a slot to accommodate tab 2412 as plate 2413 moves. Spring 2413*a* and *b* (FIG. 36) are provided to bias plate 2413 and 2426 into the position shown when table 2300 is not attached to arm 2400. A pair of cables 3100 are threaded through the arm 2400 through cable guides 2418. The cables 3100 have enlarged ends 3101 which engages an aperture in plates 2413 and 2426*a* adjacent to springs 2413*a* and 2426*a*. A pair of cables 3100*a* and 3100*b* are operably connected to interlock system which prevents removal of the table unless the gauge plate is set to its zero thickness setting.

Figure 53:
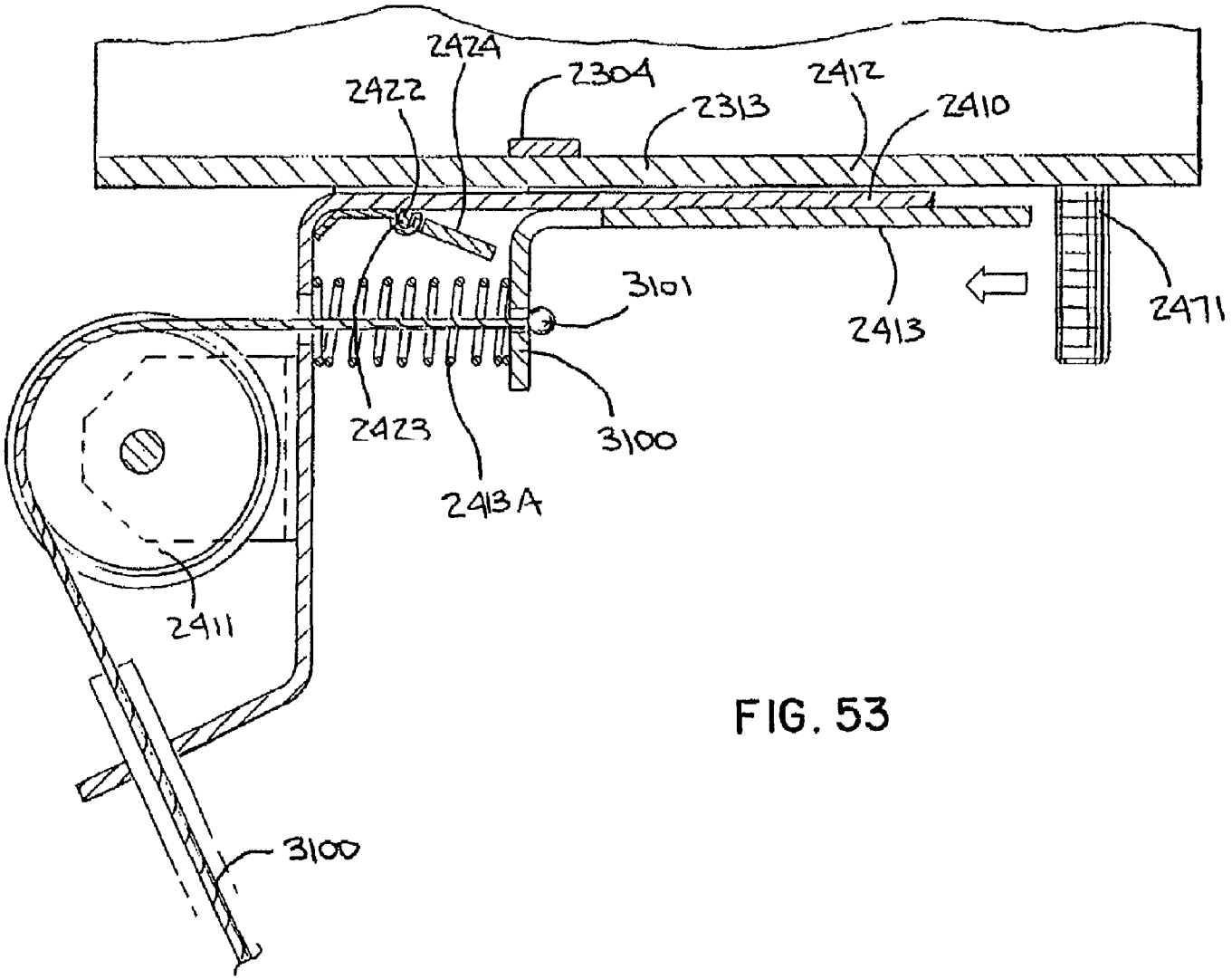
FIG. 53 is a cross-sectional view of a portion of the table lock assembly according to one embodiment of the invention.
Figure 54:
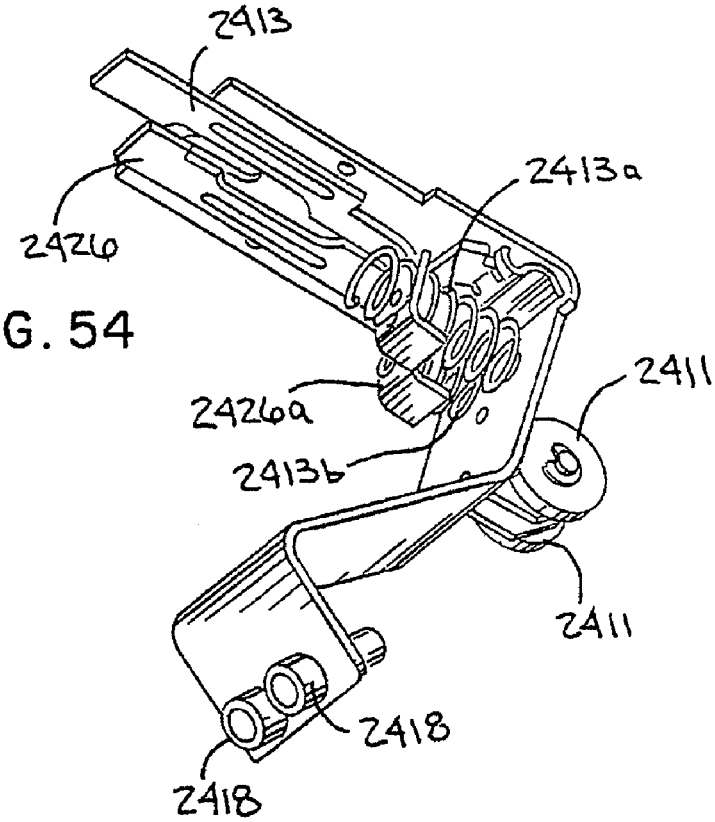
FIG. 54 is a perspective view of the table lock assembly of FIG. 53.

Arm 2400 further includes stop 2422 which consists of a hinge 2423 mounted to plate 2410 for pivoting a magnetic flapper 2424. As shown in FIG. 53, the flapper 2424 in the absence of the table drops into an open position in which it engages the back surface of plate 2413 preventing the plate from being depressed against its bias. This arrangement prevents the plate 2413 from being depressed by the operator when the table is removed. Table 2300 includes a mounting flange 2313 and a post 2417, with post 2417 having associated knob 2417*a* for disengaging the post. When table 2300 is slid into place in slot 2409 in arm 2400, post 2417 engages plate 2413 thereby pressing it downwardly against the bias of the spring 2413*a*. Magnet 2309 mounted to plate 2313 simultaneously attracts magnetic flapper 2424 and causes it to pivot into a position flush with the plate 2313. This allows plate 2413 to slide past flapper 2424 and become completely depressed against its bias which causes cable 3100*b* to disengage the interlock platform 3202.

Figure 52:
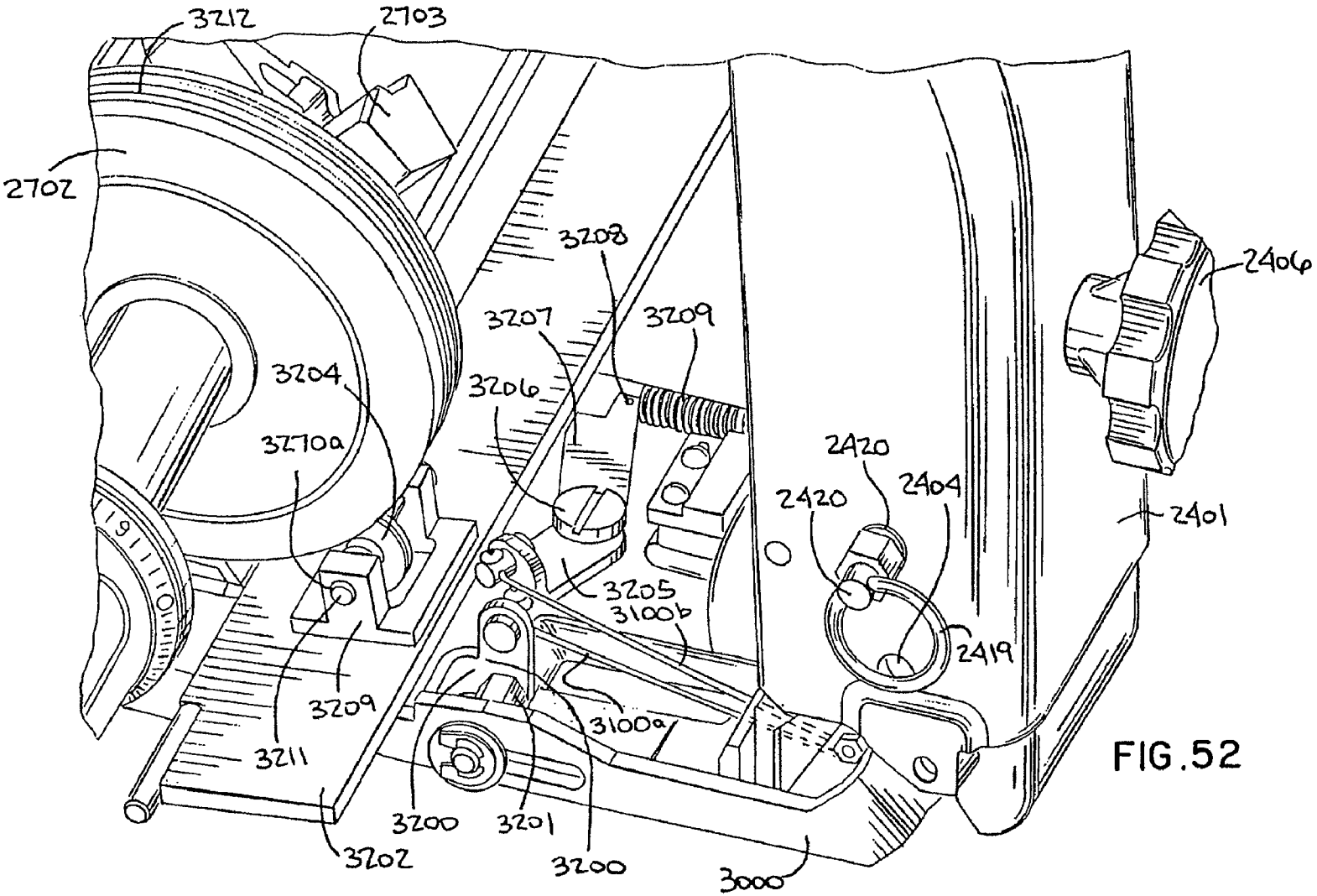
FIG. 52 is a partial cut-away view of the alternate indexing assembly, interlock and table assembly according to one embodiment of the invention.

As can be seen in FIG. 52, cable 3100*b* is connected to lever arm 3205 which is attached to threaded spindle 3206 which is screwed into a threaded aperture in the carriage assembly 3000. Second lever arm 3207 is provided with aperture 3208 to which spring 3209 is attached. Spring 3209 biases second lever arm 3207 away from platform 3202 toward the right side of the machine. The force of spring 2413*a* is substantially greater than the force generated by spring 3209 such that when table 2400 is not engaging plate 2413, the tension on cable 3100*b* is sufficient to overcome the biasing force of spring 3209. This causes lever arm 3207 to pivot forward toward the platform 3202 and become lodged underneath it such that platform 3202 cannot fall back to disengaged position. This prevents rolling member 3204 from becoming disengaged with cam 2702 unless table is present to push against plate 2413 and reduce the tension on cable 3100*b*.

Cam 2702 is provided with a spiral channel 3212 which wraps two revolutions around cam edge 2707 as shown in FIG. 52. At the terminus of channel 3212, the width and depth of the channel is substantially increased which allows roller member 3204 to lodge in channel. Roller member 3204 is mounted on frame 3209 which has apertures 3210*a* and 3210*b* for mounting axle 3211 of roller member 3204. Due to the lodging of the roller member in the deepened terminal channel roller member 3204 is engaged with the terminal end of cam groove 3212 preventing the indexing knob from being rotated until table 2300 is replaced on arm 2400.

Figure 50:
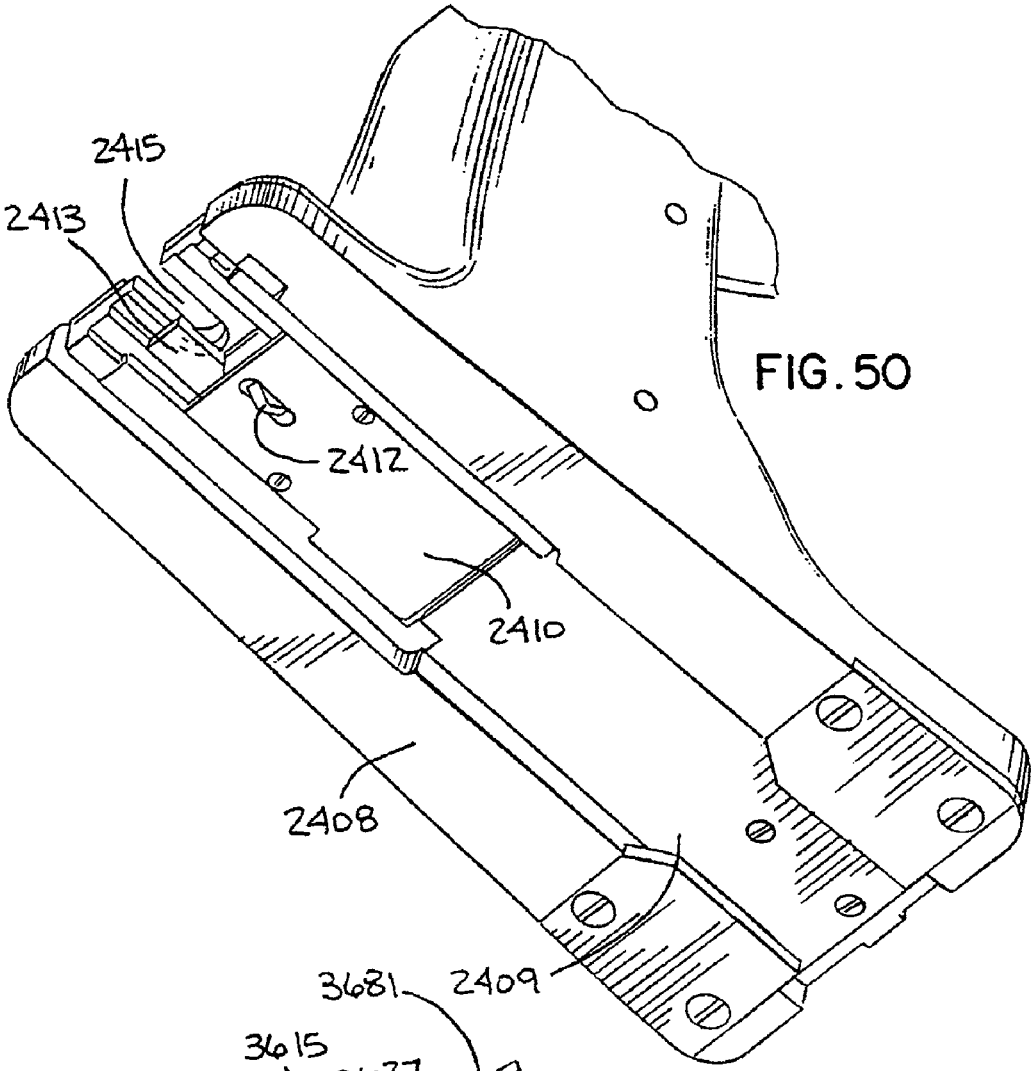
FIG. 50 illustrates a perspective view of a table arm assembly according to one embodiment of the invention taken from above, right.

An alternate embodiment of the gauge plate/table interlock system is illustrated in FIGS. 50 and 52-55. FIG. 53 illustrates that a pair of cables 3100 are connected to a down turned end of plate 2413. One of the cables 3100*a* is positioned about pulley 2411, runs through table arm 2400 and is connected to a stop member 3200. Stop member 3200 is pivotable about point 3201. When table 300 is not positioned on arm 2400, plate 2413 is biased outwardly, as shown in FIG. 50. As shown in FIG. 52, stop 3200 is positioned below platform 3202.

Figure 38:
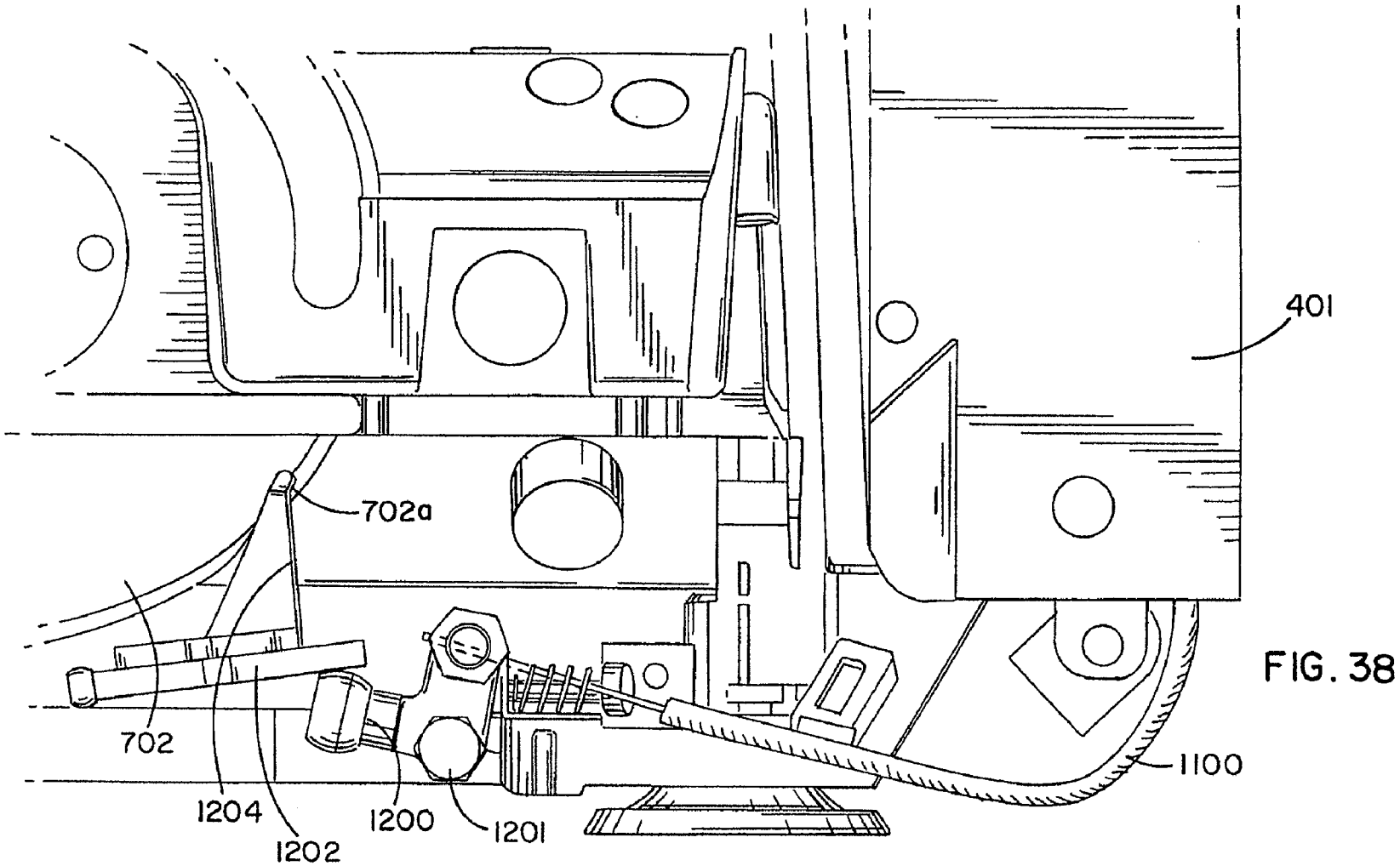
Figure 40:
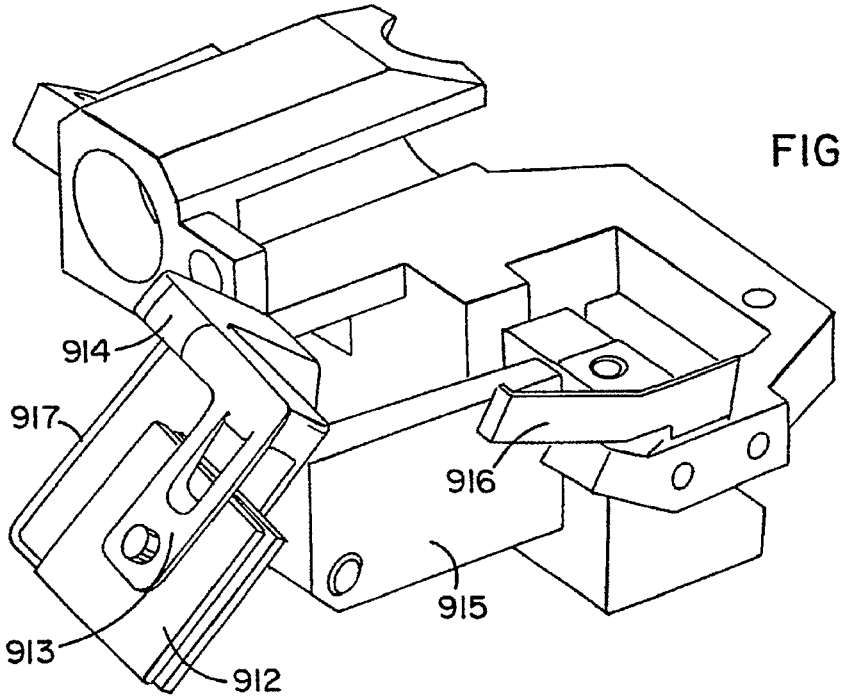
FIGS. 40-43 illustrate a deburring device according to one embodiment of the present invention.

Similar to the arrangement shown in FIG. 38, platform 3202 is pivotally connected to at least one arm which is in turn connected to shaft (not shown). As can be seen in FIG. 52, a locking projection 3204 is located on platform 3202. Stop 3200 is connected to carriage assembly 3000 such that it moves with carriage assembly 3000 as carriage assembly 3000 moves along shaft 3001. Thus, regardless of the position of table arm 2400, stop 3200 is located beneath platform 3202 at some point along its length. Locking projection 3204 remains stationary on platform 3202. Cam 2702 includes a notch therein (not shown). Similar to the notch 702 shown in FIG. 36, notch is sized to accommodate the end of locking projection 3204 when cam 2702 is positioned such that gauge plate 2500 is set for 0 thickness. Platform 3202 is biased such that locking projection 3204 maintains contact with the perimeter of cam 202 at all times.

Arm 2400 also includes a spring biased pin 2419 having a post portion 2420 slidably mounted and aperture 2421 in arm first portion 2401. The post 2420 engages an aperture 3007 in the carriage 3000 such that the arm 2400 may not be pivoted from its open position to a closed position unless the operator pulls the pin 2404 against its bias outwardly from the arm 2400. This feature requires the operator to pull the pin with one hand while pivoting the arm with the other hand so that the operator's free hand does not become pinched between the arm and the carriage while pivoting the arm to the closed position.

Figure 51:
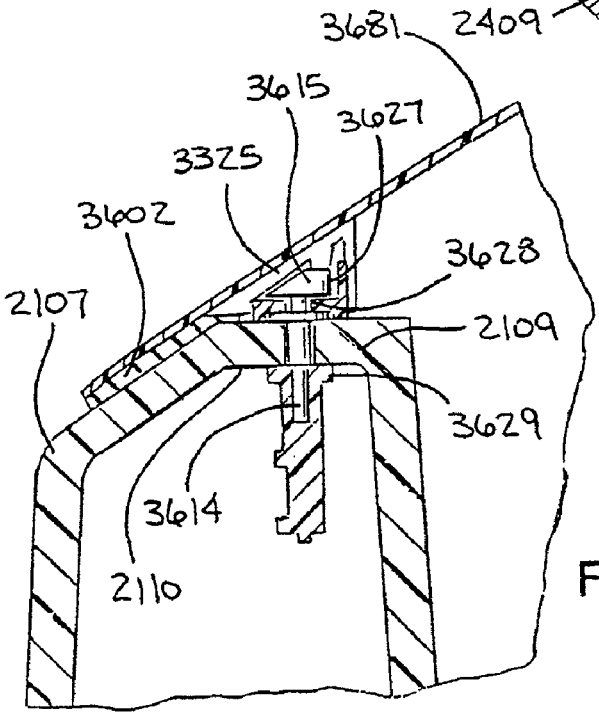
FIG. 51 is a cross-sectional view of the front wall, lip and cover according to one embodiment of the invention.
Figure 56:
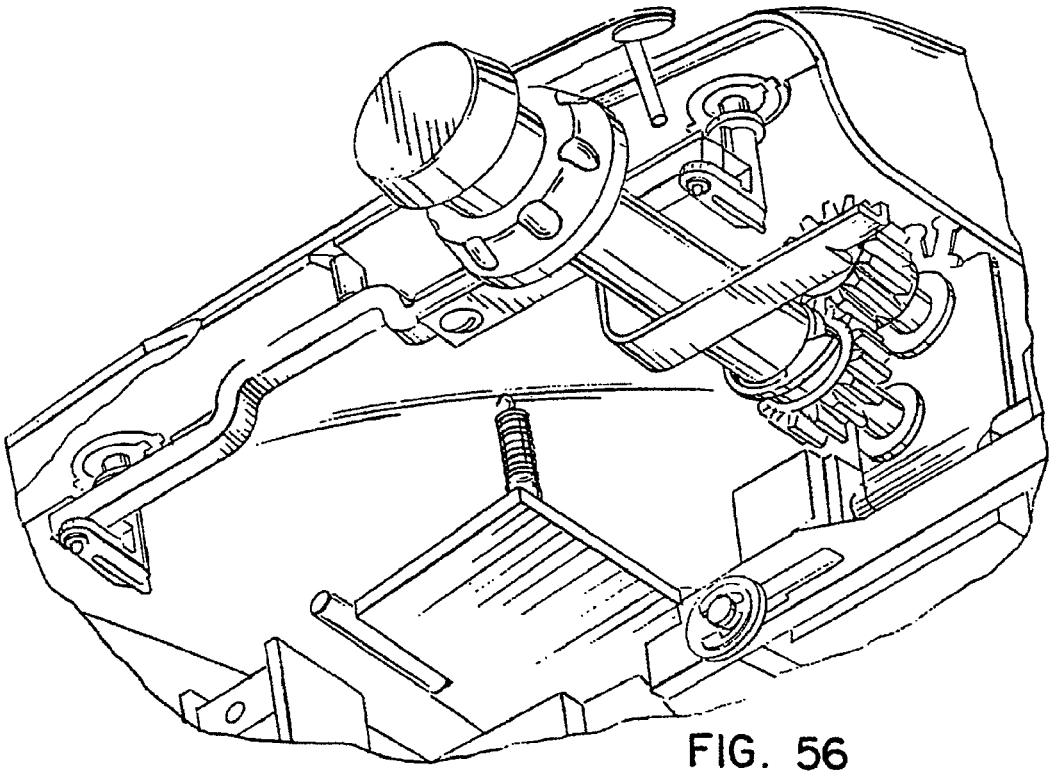
FIG. 56 is a partial cut-away view of the internal cover sealing system according to one embodiment of the invention.
Figure 57:
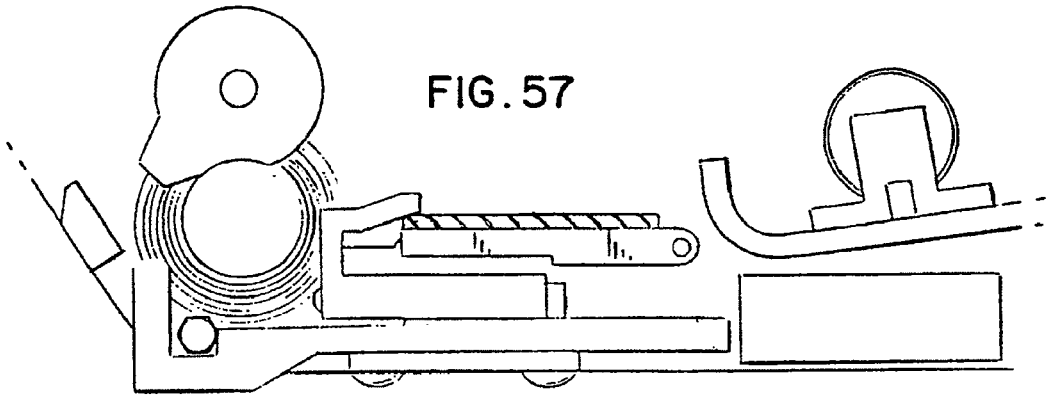
FIG. 57 is a exploded side view of the automatic mode interlock according to one embodiment of the invention.
Figure 61:
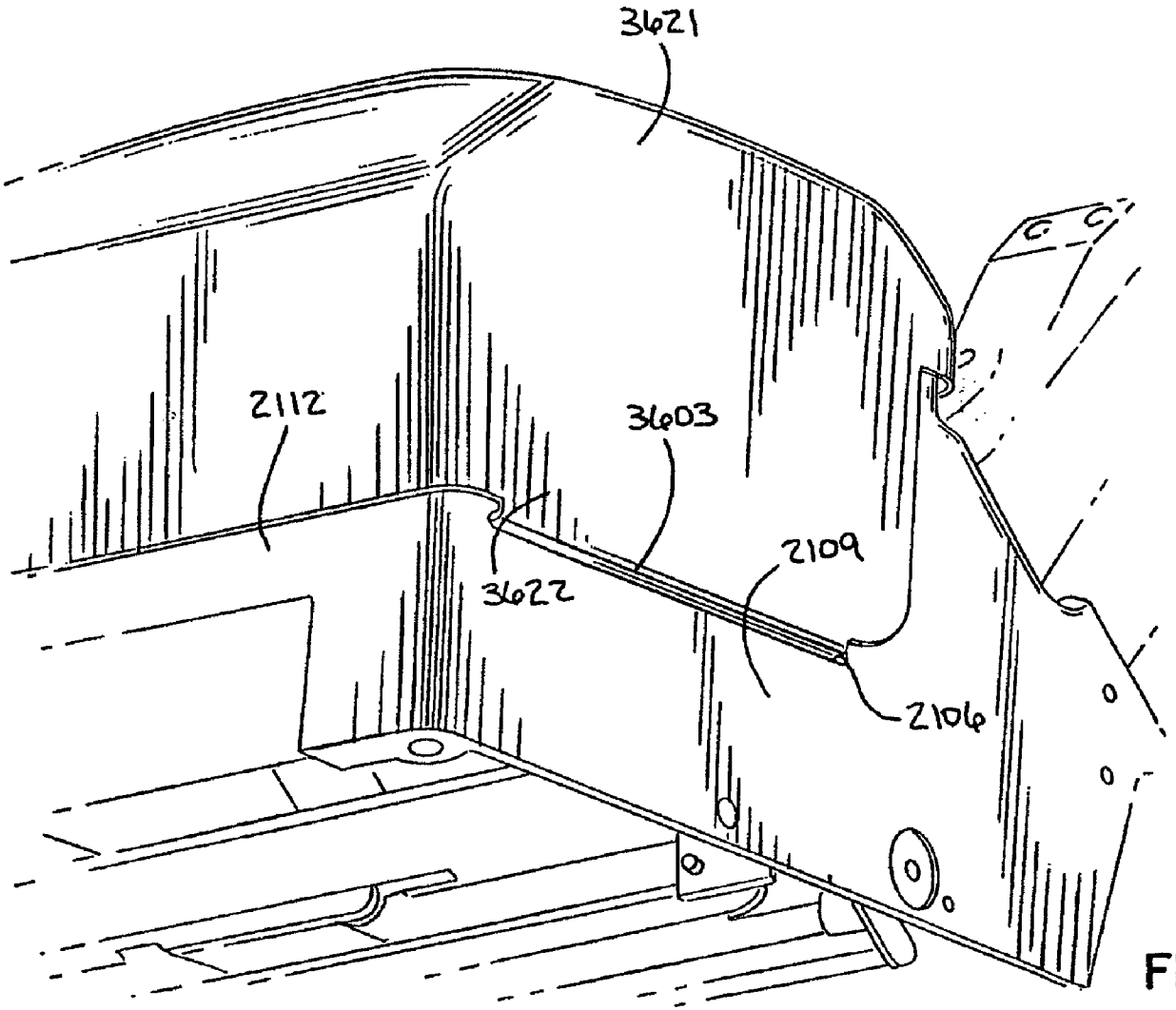
FIG. 61 is a perspective view of the back right corner of the slicing machine according to one embodiment of the invention.

In the embodiment of the invention shown in FIGS. 51, 56 and 61, an internal cover sealing system 3600 is provided. The system 3600 generally includes cover 3601, adhesive sealing foam 3602, hinge 3603, slot 2106 in housing 2100 for receipt of cover hinge 3603, and cam lock assembly 3604. Cover 3601 includes a front end 3617 having a flange 3618, a bottom surface 3619, top surface 3620, a back end 3621 where hinge 3603 is located and short sidewalls 3620 extending down from the bottom surface 3619 of the cover. Cover 3601 is removable from the base 2100 of the slicing machine to provide access to the interior of the machine to trained service personnel. Accordingly, it is designed to require the use of special tools to remove the front cover. To access the cam lock assembly 3604 and remove the cover 3601, plug 3605 must be removed from aperture 3606 from base 2100. Removal of plug 3605 exposes key 3607 recessed from the surface of the base 2100. Lock actuator 3607 preferably has an L-shaped cross section at its end adjacent to the aperture 3606 which is designed to be engaged by use of a key having a complementary L-shaped channel and a handle portion. The remainder of the actuator 3607 forms an L-shaped bar having apertures 3607*a* and 3607*b* at its other end.

Figure 60:
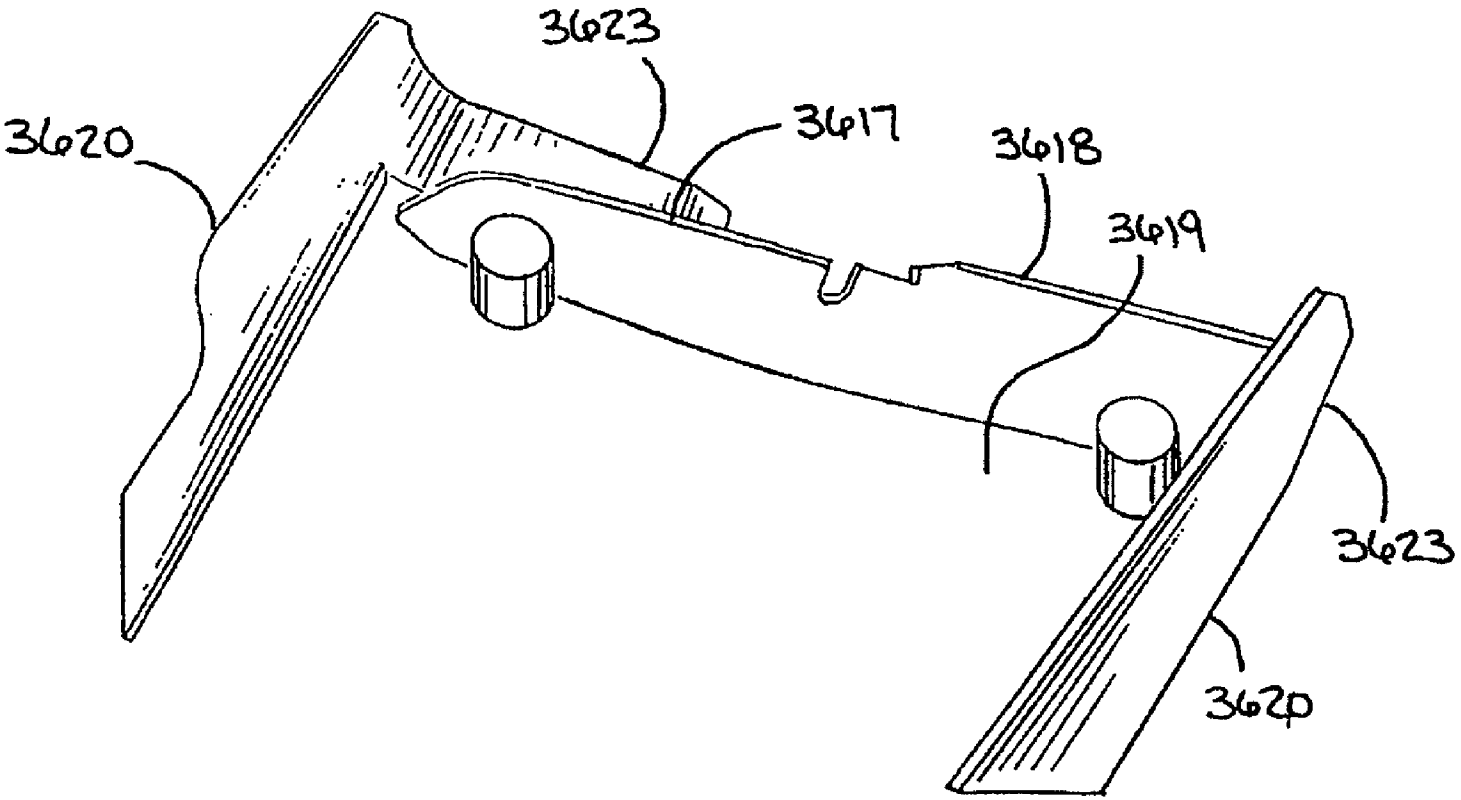
FIG. 60 is a perspective view of the bottom surface of the cover according to one embodiment of the invention.

As can be best seen in FIG. 56, cam lock assembly 3604 includes lock actuator 3607 which is pivotally mounted to linkage bar 3608 by bolts 3609*a* and 3609*b* engaging apertures 3607*a* and 3607*b* in the actuator 3607 and apertures 3610*a* and 3610 in the linkage bar 3608. Linkage bar 3608 is slidably mounted by stud 3611 to shelf 2107 extending from front wall 2108 of base 2100. A pair of cam locks 3612 include arms 3613 extend outwardly from axial shafts 3614. The arms 3613 are rotatably mounted to linkage bar 3608 by spindles 3616 engaging a pair of matching bores 3608*a*, 3613*a* and 3608*b*, 3613*b* in linkage bar 3608 and arms 3613, respectively. Shafts 3614 extend upwardly from arms 3613 and have a pair of bayonet end surfaces 3615 at their other ends which engage slots 3623 formed in camming members 3624. As can be seen in FIGS. 51 and 60, camming members 3623 are mounted in recesses 3625 in flange 3618 which runs from side to side along the bottom surface 3619 of the front portion 3617 of the cover 3601. Recess 3625 includes shoulder 3629 descending from bottom surface 2110 of shelf 2107. Camming member 3624 is provided with cam surface 3627 which when rotated against base surface 3628 causes shoulders 3629 to bear against shelf 2107 thereby drawing cover 3601 downward into sealing engagement with foam 3602.

To install the cover 3601 to the base 2100, back end 3621 of the cover 3601 is oriented over the back end 2109 of the base with hinge 3603 inserted into slot 3622. Cover 3601 is then pivoted downwardly toward the front of the machine such that front end 3617 rests against frame 2100 at foam sealing tape 3602 which is affixed along the periphery of the frame 2100. Lock actuator 3607 is then pushed inwardly toward the left wall 2112 of housing 2100. This motion causes linkage bar 3608 to move toward the left side of the machine and causes arms 3613 to move in an arcuate path which rotates shafts 3614. The rotating of the shafts 3614 causes bayonet surfaces 3615 to engage slots 3623 and rotate cam surface 3627 of camming member 3624 against base surface 3628 which causes shoulder 3629 to bear against shelf 2107 thereby causing cover 3601 to be pulled downwardly into firm sealing engagement with the foam seal tape 3602. The plug 3605 is then replaced in aperture 3606 so that and untrained operator cannot access the interior of the machine. To remove the cover 3601, the trained technician removes plug 3605 from aperture 3606 and using specially designed lock (not shown) pulls the lock actuator 3607 forward toward the right wall of the frame 2100. This causes linkage 3608 to move to the right and arcuate movement of arms 3613 with resulting rotation of shafts 3614, bayonets 3615, and cam surfaces 3627 such that shoulders 3629 disengage from bottom surface 2110 of shelf 2107 thereby allowing the front of the cover 3617 to be lifted from the frame 2100. The cover 3601 may then be pivoted upwardly until hinge 3603 can be removed from slot 2106.

Figure 62:
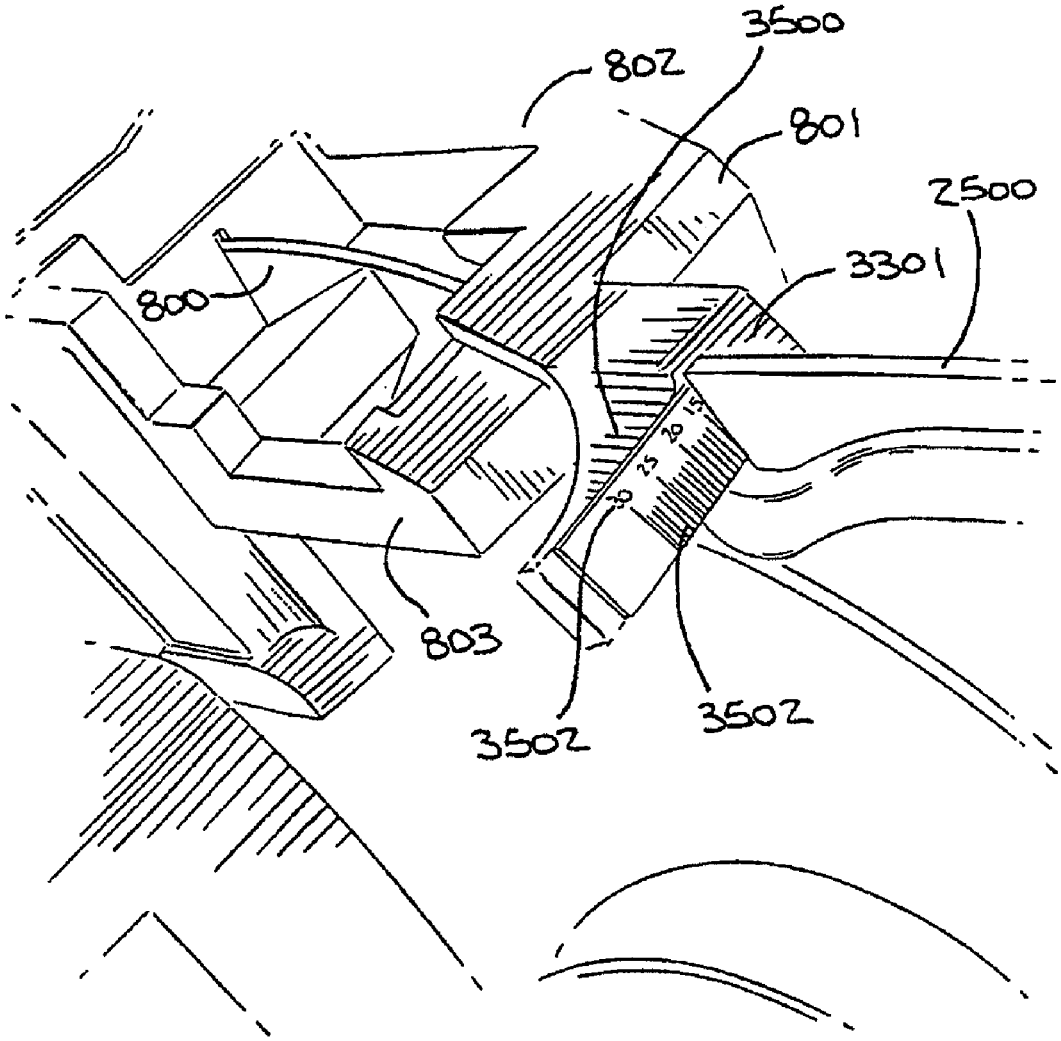
FIG. 62 is a perspective view of the slice thickness indicia according to one embodiment of the invention.

In the embodiment of the invention shown in FIG. 62, a slice thickness indicia system 3500 which is mounted to the blade guard 801 adjacent to the blade sharpening assembly 2900. The system 3500 includes a support surface 3501 which is oriented to face the front of the machine for easy viewing by the operator during slicing a food product. A gauge plate 2500 is located toward the front of the machine between the slice thickness indicia 3500 and operator's position. The support surface 3501 is provided with visible indicia 3502 which correlates to the distance between the gauge plate 2500 and the blade 800 and thereby to the thickness of slices produced by the slicer. It is preferred that the visible indicia 3502 correspond to a numerical indicia of slice thickness provided on the gauge plate adjustment knob.

In the embodiment shown in FIG. 62, the visible indicia are preferably placed on the support surface by adhering a sticker having graduated lines and numbers into proper alignment on the support surface. Alternately, the visible indicia may be etched into the surface of the support 3501. Visible indicia 3502 are shown in the embodiment illustrated in FIG. 62 as including graduated lines as well as numerical indicia. While this arrangement is preferred, it is contemplated that either graduated lines alone, numerical indicia alone, or some other form of markings indicating slice thickness may be provided on the support surface. In operation, the knob 2701 of the indexing assembly 2700 is rotated to vary the distance between the gauge plate 2500 and the blade 2800 for a desired width of food product, the operator sights down the length of the gauge plate 2500 and views a portion of the visible indicia 3502. The viewers sight line along the gauge plate 2500 reveals numerical indicia and graduated lines which may be read to indicate slice thickness of sliced product.

In the embodiment of the invention shown in FIGS. 44 and 52, an alternate indexing assembly 2700 to that shown in FIGS. 29 and 30 is provided. As shown in FIG. 52 the alternate indexing assembly 2700 is similar to the one shown in FIG. 29 with the following differences. The thickness of the slice can be selected between 0 and 35 mm with two rotations of the knob 2701 in the assembly of 2700. For this reason, cam 2702 is provided with an additional spiral in slot 2706 which provides for two rotations of cam 2702 in engagement with arm 2703.

In one preferred embodiment of the invention, table drive motor 3800 is provided which moves the table for automatic slicing. The table drive motor 3800 is a DC motor which is coupled to a position encoder 3801 which reads a position value of the table along the slicing table path and a microprocessor 3802. The microprocessor 3802 is electrically connected to receive signals from an automatic mode activation switch 3803 and an end position switch 3804, and generates and sends control signals to the motor 3800 to move the table. The microprocessor 3802 includes a central processing unit 3806 and either a processor memory cache 3802*a* or a separate memory chip 3802*b*. Processor 3806 reads and stores the position value signals generated by the encoder 3801.

The process of automatic slicing is as follows. A food product is engaged upon the slicing table. The operator activates switch on knob 3812 to place the slicer in automatic mode, whereupon an actuating arm operably engages a belt 3816 linking the slicing table to the motor 3800. The motor 3800 automatically moves the slicing table to the "0" position, the table position furthest from the blade, which trips the zero position switch 3807. The zero position switch 3807 sets the encoder 3801 counter value at zero. Next, the operator pushes the table towards the blade until the food product is adjacent the blade. Then, the operator activates the start/stop switch 3808 which signals the microprocessor 3802 to read a position value signal from the encoder as the start position for the table. The microprocessor 3802 stores this value in the memory as the start position, and generates a signal to the motor 3800 to move toward the blade to start slicing. Slicing commences, and the motor 3800 moves the table with the food product into engagement with the blade, thereby slicing the food product. When the table reaches the end position, the end position switch 3804 is tripped, which sends a signal to the microprocessor 3802. The microprocessor then generates and sends a signal to the motor 3800 to return the table to the start position. In response to the signal, the motor 3800 returns the table to the start position and then generates a stroke count signal which the microprocessor 3802 uses to calculate a count value for the number of strokes completed. When the table is returned to the start position, the microprocessor 3802 once again signals the motor 3800 to move the table to the end position, and the motor 3800 moves the table to the end position, slicing the food product again.

Figure 59:
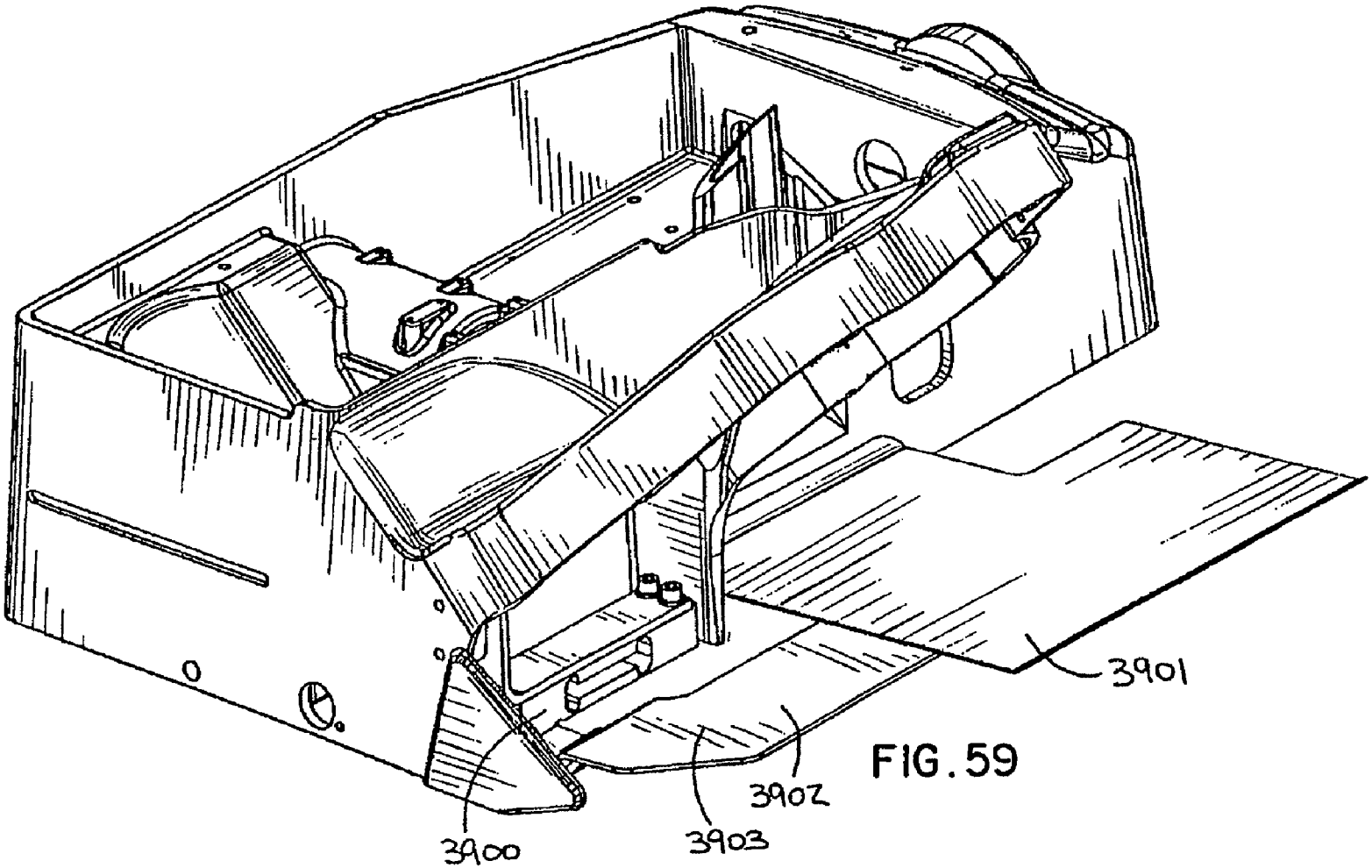
FIG. 59 is a perspective view of the base extrusion according to one embodiment of the invention.

The operator can set this process to continue until a fixed number of slices are sliced from the food product, or until a fixed weight of food product is sliced. The operator sets these values, which are stored in the microprocessor's memory. In one preferred embodiment of the invention, the value of slices may be set using counter 3809 which has LED display 3810. They counter value is set by manipulating up/down arrows 3813 which activates switches 3812 and displays numerical indicia of slices to be proper on display 3810. The count value is stored in memory on microprocessor 3802. If a fixed number of slices are set, when the microprocessor's stroke count for the number of slices reaches this value, the microprocessor 3802 signals the motor 3800 to return the table to the zero position. If a fixed weight of food product is desired, a scale reads the weight of the sliced food product and the microprocessor 3802 reads the value from the scale and stores this value. When the value of the weight sliced reaches the value set by the operator, the microprocessor 3802 signals the motor 3800 to return the table to the zero position. In one embodiment of the invention shown in FIG. 59, an integral scale 3900 is provided for weighing sliced food product. Scale 3900 is attached to receptacle by arm 3902.

Figure 58:
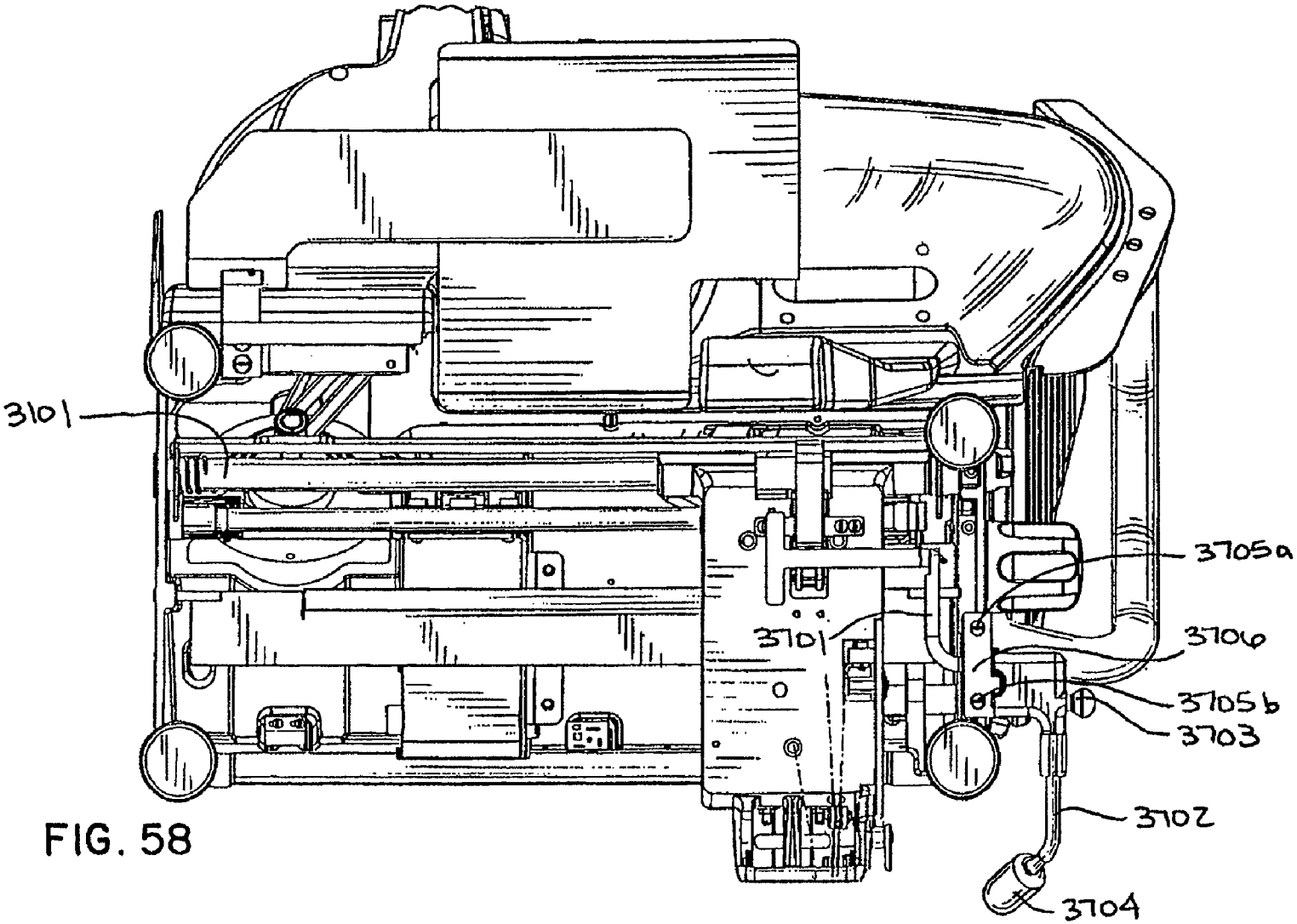
FIG. 58 is a bottom view of the slicing machine with bottom cover removed according to one embodiment of the invention.

The embodiment of the invention shown in FIGS. 44 and 58, lever lift mechanism 3700 is provided to accomplish the lifting of slicing machine frame 2100. The mechanism 3700 consists generally of retention leg 3701 and lever arm 3702, both pivotally attached to base 2100 intermediate adjacent feet 2103 situated on the front side of the housing adjacent to the operator station. Lift mechanism 3700 generally includes lever arm 3702, elbow 3703, and spring loaded pin 3708. Elbow 3703 is mounted adjacent to front wall 2108 of base 2100 which is situated next to operator station. As a result, the operator can more easily activate the lift mechanism without the long reach required to use the side mounted lift mechanism.

Lever arm 3702 is preferably a generally cylindrical rod which extends substantially radially from elbow 3703. Preferably, elbow 3703 extends away from front surface 2108 of base 2100 to provide spacing for ease of operation between the lever arm 3702 and base 2100. Lever arm 3702 also preferably includes grip 3704 at its distal end, opposite elbow 3703. Grip 3704 allows a user to firmly grasp lever arm 3702 to actuate the mechanism 3700.

As can be seen in FIG. 58, retention leg 3701 is preferably a bar of generally constant proportions. Retention leg 3701 is connected to mechanism 3700 and front wall 2108 on the side opposite from lever arm 3702 as is shown in FIG. 53. In the preferred embodiments, retention leg 3701 is connected to lever arm assembly 3700 by ordinary bolts 3705*a* and 3705*b* and a pair of retaining plates 3706. Retaining plates 3706 have semi-cylindrical channels in their inner surfaces which, when mounted together, form a cylindrical aperture for pivotally retaining retention leg 3701. Retention leg 3701 also extends generally radially from the longitudinal axis of elbow 3703. At its distal end, retention leg 3701 may optionally include roller 3707. Roller 3707 is preferably a generally circular wheel assembly which is rotatably mounted to retention leg 3701. Roller 3707 is preferably positioned such that its longitudinal axis is substantially parallel to the longitudinal axis of elbow 3703, and transverse to the longitudinal axis of retention leg 3701. Roller 3707 is preferably dimensioned such that its diameter is greater than the width of retention leg 3701, such that roller 3707 extends beyond retention leg 3701. Roller 3707 is mounted to retention leg 3701 such that it may turn freely.

Lever lift mechanism 3700 is provided with spring mounted pin 3708 which is biased toward base front wall 2108 by a spring mounted in elbow 3703. Elbow 3703 has an aperture at the end adjacent to front wall 2108 which allows spring mounted pin 3708 to protrude into apertures 2109*a* and 2109*b* in front wall 2108. The pin 3708 must be pulled away from the front wall 2108 against its bias in order to move the lift lever arm 3702. This prevents the operator from placing a hand near the base of the slicing machine when attempting to lift the machine. When the lift lever arm 3702 is fully raised and retention leg 3701 is in its fully deployed position, spring mounted pin 3708 is aligned with aperture 3709*b* and protrudes into aperture 3709*b*. This locks retention leg 3701 in place so that the operator can avoid inadvertently knocking lift lever arm 3702 into an involuntary withdrawal so that the machine might fall on the operator. To lower the machine, spring mounted pin 3708 is pulled back against its bias away from the front wall 2108 such that it clears aperture 3709*b* and the lift lever arm 3702 may be swung back down to the horizontal position. The operation of the spring mounted pin 3708 by the operator requires him to use both hands to lower the machine thereby avoiding the possibility that the operator place a hand underneath the machine while lower it.

Although the present invention has been shown and described in detail, the same is by way of example only and is not to be taken as a limitation on the invention. Numerous modifications can be made to the unit as a whole as well as the individual parts and components without departing from the scope of the invention. Numerous methods of operation that vary from those disclosed are also possible without departing from the scope of the invention.

The invention claimed is:

1. A bulk food product slicing machine comprising:

a base for supporting said slicing machine;

a rotatable blade for slicing a bulk food product;

a motor operably connected to said rotatable blade for rotating said blade against a bulk food product to slice the bulk food product into slices;

a carriage slidably mounted to said base for providing movement in a table movement direction toward said rotatable blade and away from said rotatable blade;

a support arm being pivotally mounted to said carriage; said support arm including a pivot actuator for selectively pivoting the support arm away from the base of the slicing machine to ease access for cleaning;

a table releasably mounted to said support arm and having a top surface supporting the bulk food product during slicing, said table having a release for disengaging said table from said support arm to allow separation of said table from said support arm to ease cleaning of said table and said support arm; and an adjustable gauge plate for varying the thickness of the slices; and an interlock system operably connecting said gauge plate and said table release such that said gauge plate must remain fully closed against said rotatable blade while said table is disengaged from said support arm.

2. The machine of claim 1, said interlock system further including a slidable plate and a hinged flapper which prevents operator override of said interlock system.

3. The machine of claim 1, further comprising a cable operably connected to said interlock system which prevents the removal of said table from said arm unless said gauge plate is set to its zero thickness setting.

4. A bulk food product slicing machine comprising:

a base for supporting said slicing machine;

a rotatable blade for slicing a bulk food product;

a motor operably connected to said rotatable blade for rotating said blade against a bulk food product to slice the bulk food product into slices;

a carriage slidably mounted to said base for providing movement in a table movement direction toward said rotatable blade and away from said rotatable blade;

a support arm being pivotally mounted to said carriage to promote selective pivot of the support arm away from the base of the slicing machine to ease access for cleaning; and a table releasably mounted to said support arm and having a top surface supporting the bulk food product during slicing, said table having a release for disengaging said table from said support arm to allow separation of said table from said support arm;

wherein said table is conveniently cleaned by pivoting said support arm away from the base, then utilizing said release to disengage said table from said support arm while leaving said support arm attached to said carriage; and an adjustable gauge plate for varying the thickness of the slices; and an interlock system operably connecting said gauge plate and said table release such that said gauge plate must remain fully closed against said rotatable blade while said table is disengaged from said support arm.

5. The machine of claim 4, said interlock system further including a slidable plate and a hinged flapper which prevents operator override of said interlock system.

6. The machine of claim 4, further comprising a cable operably connected to said interlock system which prevents the removal of said table from said arm unless said gauge plate is set to its zero thickness setting.

* * * * *